US006832694B2

(12) United States Patent
Goeking et al.

(10) Patent No.: US 6,832,694 B2
(45) Date of Patent: Dec. 21, 2004

(54) DISPENSER FOR CUTLERY UTENSILS

(75) Inventors: Harold J. Goeking, Oshkosh, WI (US); Ismael Gonzalez, Bellgardens, CA (US)

(73) Assignee: Fort James Corporation, Atlanta, GA (US)

( * ) Notice: Subject to any disclaimer, the term of this patent is extended or adjusted under 35 U.S.C. 154(b) by 57 days.

(21) Appl. No.: 10/289,348

(22) Filed: Nov. 7, 2002

(65) Prior Publication Data

US 2004/0089670 A1 May 13, 2004

(51) Int. Cl.[7] ..... B65H 3/00
(52) U.S. Cl. ..... 221/195; 221/239
(58) Field of Search ..... 221/41, 193, 268, 221/231, 276, 264, 131, 124, 133; 312/44, 42

(56) References Cited

U.S. PATENT DOCUMENTS 2,141,684 A * 12/1938 Diemer ..... 221/239
2,149,099 A 2/1939 Phinney et al.
2,188,573 A * 1/1940 Longo ..... 221/195
2,239,196 A * 4/1941 Lunvik ..... 221/131
2,325,604 A 8/1943 Gibbs et al.
2,421,782 A 6/1947 Gibbs et al.
2,911,127 A * 11/1959 Driss et al. ..... 221/258
3,115,992 A 12/1963 Menolasino et al.
5,564,594 A 10/1996 Monfredo
5,921,408 A 7/1999 Groenewold et al.
6,336,568 B1 1/2002 Tucker et al.
6,474,503 B2 11/2002 Davis

* cited by examiner

*Primary Examiner*—Kenneth Noland
(74) *Attorney, Agent, or Firm*—Finnegan, Henderson, Farabow, Garrett & Dunner, L.L.P.

(57) ABSTRACT

The present invention provides a utensil dispenser for dispensing a utensil. The dispenser includes a base, which defines at least one dispensing opening. At least one utensil is positioned on or adjacent to a top surface of the base. The dispenser includes a dispensing mechanism capable of moving the at least one utensil. The utensil is dispensed by the dispensing mechanism moving the utensil to fall through the dispensing opening.

364 Claims, 15 Drawing Sheets

DISPENSER FOR CUTLERY UTENSILS

FIELD OF THE INVENTION

The present invention is directed to a cutlery dispenser and, more particularly, to a cutlery dispenser that is capable of dispensing one utensil at a time in a sanitary manner.

BACKGROUND OF THE INVENTION

People are eating out now more often for breakfast, lunch, and dinner at public food establishments. Public food establishments generally provide eating utensils for their customers. In many fast food or other less formal types of food establishments, the food establishment provides disposable utensils, including spoons, forks, sporks, and knives, for its customers' use. (A spork is a cross between a fork and a spoon, having an eating portion comprised of a bowl portion with tines (i.e., a tine portion) extending therefrom.)

A significant expense incurred in these types of establishments is the costs associated with these disposable utensils and other tableware. While it is necessary to make the utensils readily accessible to customers, there is a need to dispense the utensils in a sanitary manner and in a way that discourages the customers from taking more than the necessary number of utensils.

Presently, in some instances, the utensils are wrapped in plastic wrap, either individually or in combination (such as a spoon, a fork, a spork, and/or a knife in one plastic wrap). While the utensils are kept sanitary in the plastic wrap, people sometimes take more utensils than they actually need for their meal. This adds to the overall operating costs of the food establishment. In addition, this uses a lot of plastic wrap, which is an environmental issue.

In other instances, the food establishment provides containers filled with utensils such that a customer reaches into the container to grab a utensil. The containers are typically bins that have open tops, which allow the customers to remove any number of utensils. Similar to above, people sometimes take more utensils than needed, which adds to the overall operating costs of the food establishment. In addition, because the utensils are exposed, this alternative may be less than adequately sanitary. For example, if someone with oils or other contaminants on his hands reaches into the container, these contaminants may be transferred to utensils in the container that are not grabbed by that person but are grabbed by a subsequent person. Also, dust and other contaminants may readily contact the utensils in the container.

Certain types of cutlery dispensers are known in the art, such as U.S. Pat. No. 2,141,684, issued to Diemer; U.S. Pat. No. 2,188,573, issued to Longo; U.S. Pat. No. 2,911,127, issued to Driss et al.; U.S. Pat. No. 5,921,408, issued to Groenewold et al.; and U.S. Pat. No. 6,336,568, issued to Tucker et al.

U.S. Pat. No. 2,141,684, issued to Diemer ("the '684 patent"), discloses a dispensing device. The '684 patent discloses a dispensing cabinet that has an interior that is divided into a plurality of vertical compartments by partitions. For each compartment, there are two opposed vertical guide channels that contact both end portions of the article to be dispensed. At the bottom of the forward guide channel, a horizontal shelf is provided that extends inwardly and against which the forward end of the lowermost article may rest to support the entire stack of articles. In the front wall of the forward guide channel just above the horizontal shelf, an aperture allowing the entrance of an ejecting plunger into the compartment is provided. The rear wall of the rear guide channel is provided with an aperture of a size to permit only the passage therethrough of the lowermost article. The upper portion of an end of the plunger is provided with a bevel. In the normal position of the plunger, the lowermost article is resting on the shelf. When the article is to be dispensed, the plunger is manually pressed inwardly against the force of a spring, and then the inner end of the plunger engages with the forward end of the article. At the same time, the front end of the article just above the lowermost one is engaged on the bevel so that the entire stack of articles is raised so that the weight of the stack is appreciably released from the lowermost article. The lowermost article is simultaneously slid backwardly so that its end passes through the aperture in the rear guide channel. After the forward end of the lowermost article is pushed off of the forward shelf, the article takes an angular suspended position where it may be grasped by the user inserting his hand through a suitable opening in the front wall of the cabinet.

U.S. Pat. No. 2,188,573, issued to Longo ("the '573 patent"), discloses a dispenser. The '573 patent discloses a cabinet that includes one or more holders therein, wherein each holder holds a particular type of cutlery utensil. The utensils are stacked in the holder so as to lay on lugs at each end of the bottom of the holder, which is otherwise open, and to lay on a block provided in a middle portion of the stack of utensils. In operation, a corresponding plunger for the desired utensil is thrust in using a button outside the dispenser. This actuates an appropriate lever and rocker arm, thereby turning an associated sleeve and moving an associated finger forward. This finger, engaging the handle of the utensil, will push such handle sideways through a cut-out in a vertical strip on one side of the holder and beyond the lug on that side into a downwardly and forwardly sloping slide. As the other end of the utensil is held back by a narrowed lower end of a vertical strip on the other side of the holder, a turning motion is imposed on the utensil to project its handle end over the slide. During this turning motion, as soon as the root end of the handle portion of the utensil is cleared away from the block below it, the tip of the utensil over the lug is freed from the holder and the utensil slides down along the slide onto a chute sloping downward and toward the bottom center of the cabinet.

U.S. Pat. No. 2,911,127, issued to Driss et al. ("the '127 patent"), discloses a machine for dispensing spoons or like articles. The '127 patent discloses a housing that has a front end that is open but is closed by a removable cover. In the housing, spoons are stacked together facing downward, with the front ends of the spoons confined in a first channel and the rear ends confined in a second channel. The front lip of the lowermost spoon rests on a ledge in the first channel and the rear handle of that spoon rests on an extension of a horizontal connecting wall. When an electromagnet is energized, an armature moves an actuating member inwardly or rearward and an inclined edge of the actuating member engages the rear handle of the lowermost spoon to move that spoon sideways at an angle so that it is pushed off the extension and over an open space. This causes the lowermost spoon to tilt down from its handle end and thereby disengage itself from the ledge and drop by gravity into a chute. The spoon then slides down the chute to be manually removed through an opening in the removable front cover of the housing. When the electromagnet is deenergized, the armature and the actuating member are retracted and the next lowermost spoon rests on the ledge and extension, and is ready for release upon the next actuation of the actuating member.

U.S. Pat. No. 5,921,408, issued to Groenewold et al. ("the '408 patent"), discloses a cutlery dispenser. This patent discloses a flatware dispensing unit including a housing having at least one compartment. The compartment has an elongated slot for exposing a portion of the flatware. A flatware cartridge is receivable in the compartment, and has a complementary elongated slot substantially aligned with the elongated slot of the compartment. A handle portion of the flatware extends from the elongated slots of the cartridge and the compartment to allow one to remove the flatware from the cartridge.

U.S. Pat. No. 6,336,568, issued to Tucker et al. ("the '568 patent"), discloses a cutlery utensil dispenser. The '568 patent discloses a dispenser including an interior compartment in communication with an exit opening and accessible through a closable door. A cartridge is accommodated in the interior compartment. The cartridge has at its lower end a removable cap member that provides a portal leading from the interior of the cartridge. The portal is sized such that a single cutlery utensil can pass therethrough. When the cartridge is in place in the interior compartment of the housing, the portal is situated in a pathway aligned with the exit opening. In one embodiment, dispensing a utensil is accomplished by the user rotating an externally accessible ejector such as a rotatable roller having at least one and, as shown in the drawings as four, ledges. Upon rotation of an external knob of the roller, one ledge engages a utensil situated in the portal to accomplish delivery of that utensil through the pathway and into the exit opening for user retrieval. In another embodiment, dispensing a utensil is accomplished by the user depressing an externally accessible ejector such as a lever that has a proximal end that is pushed downwardly by a user to retrieve a utensil. The lever has an internally protruding distal end, wherein upon pivotal movement of the lever on its pivot point, which occurs upon depression of the proximal end of the lever, the protruding distal end engages the dispensable utensil for ejecting the utensil from the portal to the exit opening.

The present invention provides a cutlery dispenser that is capable of dispensing one utensil at a time in a sanitary manner.

SUMMARY OF THE INVENTION

The present invention provides a utensil dispenser adapted for the dispensing of at least one utensil. In one embodiment, the dispenser includes a housing having at least a bottom wall comprising a base. In another embodiment, the dispenser includes a housing that defines an interior compartment. The housing may include at least one wall that defines an opening therein. In the interior compartment of the housing, the dispenser may include at least one base or at least one cassette assembly that has a base. A plurality of bases or cassette assemblies each having a base may be provided in the housing. At least one base defines at least one dispensing opening therein. At least one utensil is positioned on or adjacent to a top surface of the base. The dispenser also includes at least one dispensing mechanism capable of moving the at least one utensil. In one embodiment, a plurality of dispensing mechanisms are provided, each being associated with one of a plurality of cassette assemblies.

In one embodiment, a plurality of inclined portions are formed in at least a portion of a thickness of the base defining the dispensing opening. The inclined portions are inclined downward from a top surface of the base. Here, the at least one utensil is dispensed by the dispensing mechanism moving the at least one utensil downward along the inclined portions to fall through the dispensing opening.

In one embodiment, each inclined portion extends downward from the top surface of the base along a portion of an entire length of connecting edges of the dispensing opening. In another embodiment, each inclined portion extends downward from the top surface of the base along an entire length of connecting edges of the dispensing opening. The connecting edges connect a narrower portion of the dispensing opening and a wider portion of the dispensing opening. In one embodiment, each inclined portion is provided as about 20% to about 25% of the thickness of the base. In another embodiment, each inclined portion is provided along the entire thickness of the base. In one embodiment, each inclined portion is inclined downward at an angle of about 1 degree to about 89 degrees relative to the top surface of the base. In another embodiment, each inclined portion is inclined downward at an angle of about 45 degrees relative to the top surface of the base.

In one embodiment, edges defining the dispensing opening on the top surface of the base from which the inclined portions incline are curved and are connecting edges that connect a narrower portion of the dispensing opening and a wider portion of the dispensing opening.

The dispenser may include a plurality of alignment members that extend generally perpendicularly from the base. At least one of the alignment members is an alignment guard member that defines an opening at a bottom end of the alignment guard member. The alignment guard member opening may be configured to allow only one utensil to pass therethrough at a time.

In one embodiment, the at least one utensil may be dispensed by the dispensing mechanism moving the at least one utensil toward the alignment guard member to move through the alignment guard member opening to fall through the dispensing opening. In one embodiment, the utensil is dispensed by moving it toward the alignment guard member and downward along the inclined portions to move through the alignment guard member opening to fall through the dispensing opening. The utensil may be dispensed through an opening defined in a wall of the housing.

In one embodiment, the housing includes at least one side wall. In one embodiment, the dispensing mechanism includes an actuating member and a shaft portion. The actuating member is provided outside of the at least one side wall of the housing. The shaft portion is connected with the actuating member and extends through an opening defined in the at least one side wall of the housing into the interior compartment of the housing. In one embodiment, the at least one utensil is dispensed by a user moving the actuating member which moves the shaft portion which moves the at least one utensil downward along the inclined portion to move the at least one utensil to fall through the dispensing opening. The shaft portion may be configured to move only one utensil at a time.

In one embodiment, the dispensing mechanism may include a spring positioned around the shaft portion. A first end of the spring contacts the actuating member and a second end of the spring contacts an outer edge of the base. Before dispensing, the actuating member is biased away from the at least one wall of the housing so that the shaft portion is biased away from the at least one utensil. The user pushes the actuating member against the biasing force of the spring to dispense the at least one utensil.

In one embodiment, a plurality of utensils are provided in a stack. A bottommost utensil in the stack may be dispensed by the dispensing mechanism moving the bottommost utensil to fall through the dispensing opening. In one embodiment, the bottommost utensil is dispensed by the dispensing mechanism moving the bottommost utensil downward along the inclined portions to fall through the dispensing opening.

In one embodiment, the bottommost utensil is dispensed with no raising of any of the utensils positioned above the bottommost utensil in the stack. In another embodiment, the bottommost utensil is dispensed with only incidental raising of any of the utensils positioned above the bottommost utensil in the stack. In another embodiment, the bottommost utensil is dispensed without substantially raising any of the utensils positioned above the bottommost utensil. In addition, after the bottommost utensil falls through the dispensing opening, the stack of utensils may realign so that a utensil that had been adjacently above the dispensed bottommost utensil becomes a new bottommost utensil that is capable of being dispensed.

The present invention also provides a method of dispensing a utensil. In one embodiment, the method includes providing at least one base or, in another embodiment, providing a housing having at least a bottom wall comprising a base. The base defines at least one dispensing opening therein. In another embodiment, the method includes providing a housing having at least one wall that defines an opening therein. The housing defines an interior compartment, and at least one base or at least one cassette assembly having a base is provided in the interior compartment of the housing. At least one base defines at least one dispensing opening therein. A plurality of bases or cassette assemblies each having a base may be provided in the housing. At least one utensil is positioned on or adjacent to the top surface of the base. The method includes providing at least one dispensing mechanism capable of moving the at least one utensil. In one embodiment, a plurality of dispensing mechanisms are provided, each being associated with one of a plurality of bases or cassette assemblies.

In one embodiment, a plurality of inclined portions are formed in at least a portion of a thickness of the base defining the dispensing opening. The inclined portions are inclined downward from a top surface of the base. Here, the method further includes dispensing the at least one utensil by the dispensing mechanism moving the at least one utensil downward along the inclined portions to fall through the dispensing opening.

The method may also include providing a plurality of alignment members that extend generally perpendicularly from the base. At least one of the alignment members is an alignment guard member that defines an opening at a bottom end of the alignment guard member.

In another embodiment, the utensil dispenser includes a housing having at least a bottom wall comprising a base having at least one dispensing opening defined therein. A plurality of downwardly inclined support surfaces are formed in the base adjacent the dispensing opening. The dispenser also includes a plurality of alignment members that extend generally perpendicularly from the base. At least one of the alignment members is an alignment guard member that defines a lateral opening extending generally perpendicularly away from the base at an end of the alignment guard member adjacent the base. The alignment members are configured and disposed to restrain a stack of a plurality of utensils resting on the base closely adjacent to the dispensing opening in a supported configuration and restraining all but a bottommost utensil of the stack of utensils from being moved out of the supported configuration.

The bottommost utensil is positioned on or adjacent to a top surface of the base and is capable of being moved through the lateral opening out of the supported configuration. The dispenser further includes a dispensing mechanism capable of moving the bottommost utensil through the lateral opening out of the supported configuration.

The bottommost utensil of the stack of utensils is dispensed by the dispensing mechanism moving the bottommost utensil toward the alignment guard member and downward along the inclined support surfaces to move through the lateral opening to fall through the dispensing opening without imparting substantial upward movement to any of the utensils stacked above the bottommost utensil.

In another embodiment, the method of dispensing a utensil includes providing a housing and providing a base within the housing that has at least one dispensing opening defined therethrough. A plurality of downwardly inclined support surfaces are formed in the base adjacent the dispensing opening. A bottommost utensil of a stack of utensils is positioned on or adjacent to a top surface of the base. The method further includes providing a dispensing mechanism capable of moving the bottommost utensil.

In one embodiment, the method further includes providing a plurality of alignment members that extend generally perpendicularly from the base. At least one of the alignment members is an alignment guard member that defines a lateral opening extending generally perpendicularly away from the base at an end of the alignment guard member adjacent the base. The alignment members are configured and disposed to restrain the stack of a plurality of utensils resting on the base closely adjacent to the dispensing opening in a supported configuration and restraining all but a bottommost utensil of the stack of utensils from being moved out of the supported configuration.

The method further includes dispensing the bottommost utensil of the stack of utensils by the dispensing mechanism moving the bottommost utensil downward along the inclined support surfaces to fall through the dispensing opening without imparting substantial upward movement to any of the utensils stacked above the bottommost utensil.

In another embodiment, a length of the dispensing opening is greater than a length of a utensil to be dispensed from the utensil dispenser. At least one utensil is positioned on or adjacent to a top surface of the base. Before being dispensed, the at least one utensil partly lays over the dispensing opening. The at least one utensil is dispensed by the dispensing mechanism moving the at least one utensil to fall through the dispensing opening.

In one embodiment, the dispensing mechanism includes a translating mechanism for translating a motion from a first direction to a second direction perpendicular to the first direction. Here, the at least one utensil may be dispensed by the dispensing mechanism moving the at least one utensil toward the alignment guard member to move through the alignment guard member opening to fall through the dispensing opening.

The translating mechanism includes a translating portion having a first end and a second end, and a pushing portion. The first end of the translating portion is connected with the shaft portion. The second end of the translating portion is connected with the pushing portion. The second end of the translating portion and the pushing portion are connected together with the base at a pivot point. The pushing portion is capable of moving the at least one utensil.

In one embodiment, the at least one utensil is dispensed by a user moving the actuating member which moves the shaft portion which moves the translating portion. This causes the first end of the translating portion to move in the first direction and causes the second end of the translating portion to rotate at the pivot point. This causes the pushing portion to rotate toward the at least one utensil and then to move the at least one utensil to fall through the dispensing opening. The pushing portion may be configured to move only one utensil at a time.

In one embodiment, at least one inclined portion is formed in at least a portion of a thickness of the base defining the dispensing opening. The inclined portion is inclined downward from the top surface of the base.

In one embodiment, a size and a shape of the dispensing opening is dependent on the type of utensil to be dispensed.

The housing may be mounted on a wall. A bin or tray may be positioned under the housing so that a utensil dispensed from the housing falls into the bin or tray. The bin or tray may also be mounted on a wall.

A holding member may be provided in the housing to support the base or the cassette assembly, or a plurality of bases or cassette assemblies. The holding member may be spaced from the bottom of the housing.

A slider member may be provided under the housing, or within the housing, so that a utensil is capable of sliding down the slider member after falling through the dispensing opening. In one embodiment, the sliding member may include a stopping member. In another embodiment, a stopping member may be provided that extends outward and upward from a bottom of at least one wall of the housing. The utensil may be stopped from sliding down the slider member by the stopping member.

In one embodiment, at least a portion of at least one side wall of the housing is transparent. In another embodiment, the side wall of the housing is transparent.

In one embodiment, one or more cassette assemblies are replenished by providing at least one new utensil in the cassette assemblies. In another embodiment, one or more cassette assemblies are removed from the housing and replaced with other cassette assemblies.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present embodiments of the invention, examples of which are illustrated in the accompanying drawings. Wherever possible, the same reference numbers will be used throughout the drawings to refer to the same or like parts.

Figure 1:
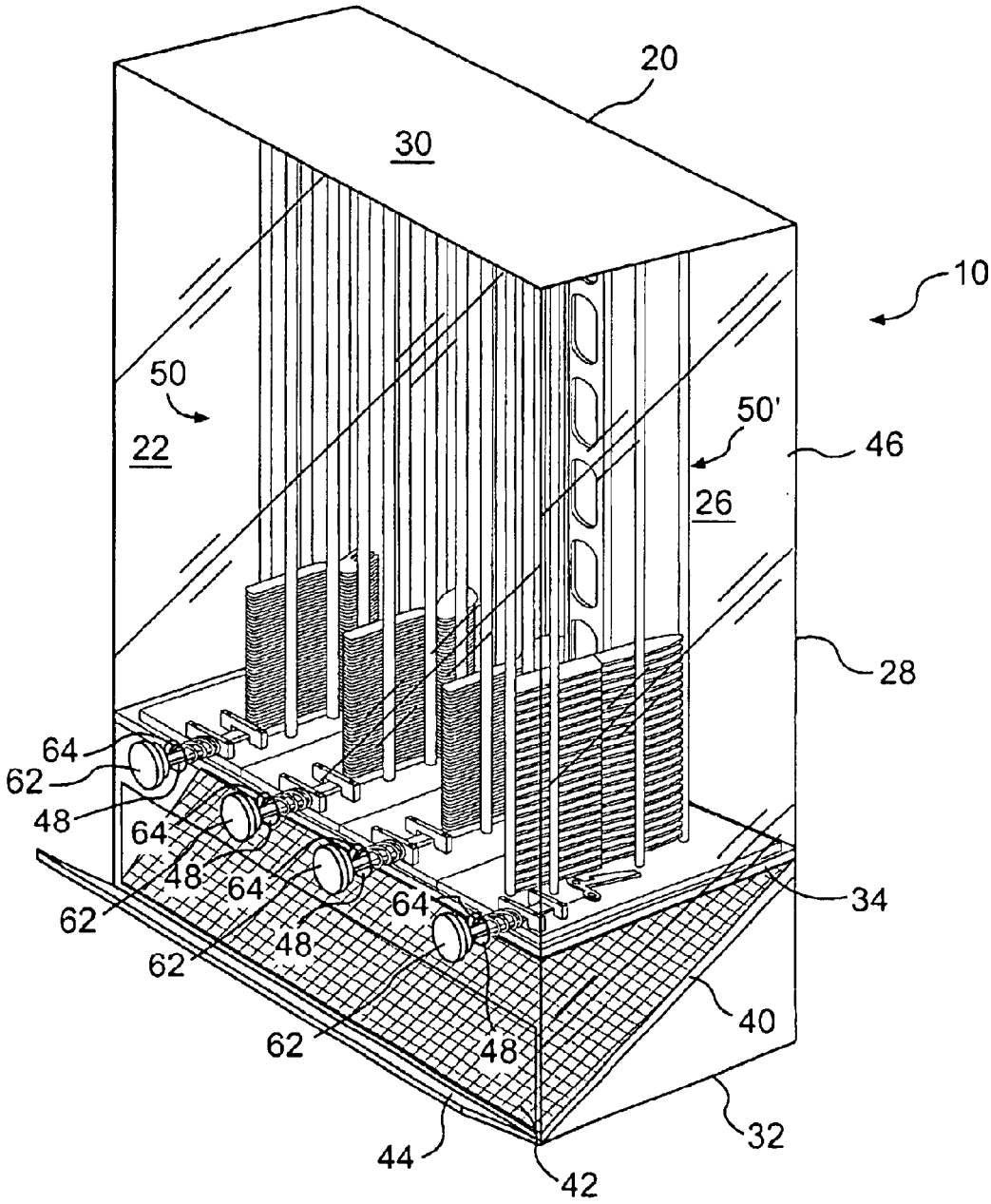
FIG. 1 is a perspective view of a cutlery dispenser of the present invention, illustrating a plurality of cassette assemblies provided within the dispenser.
Figure 2:
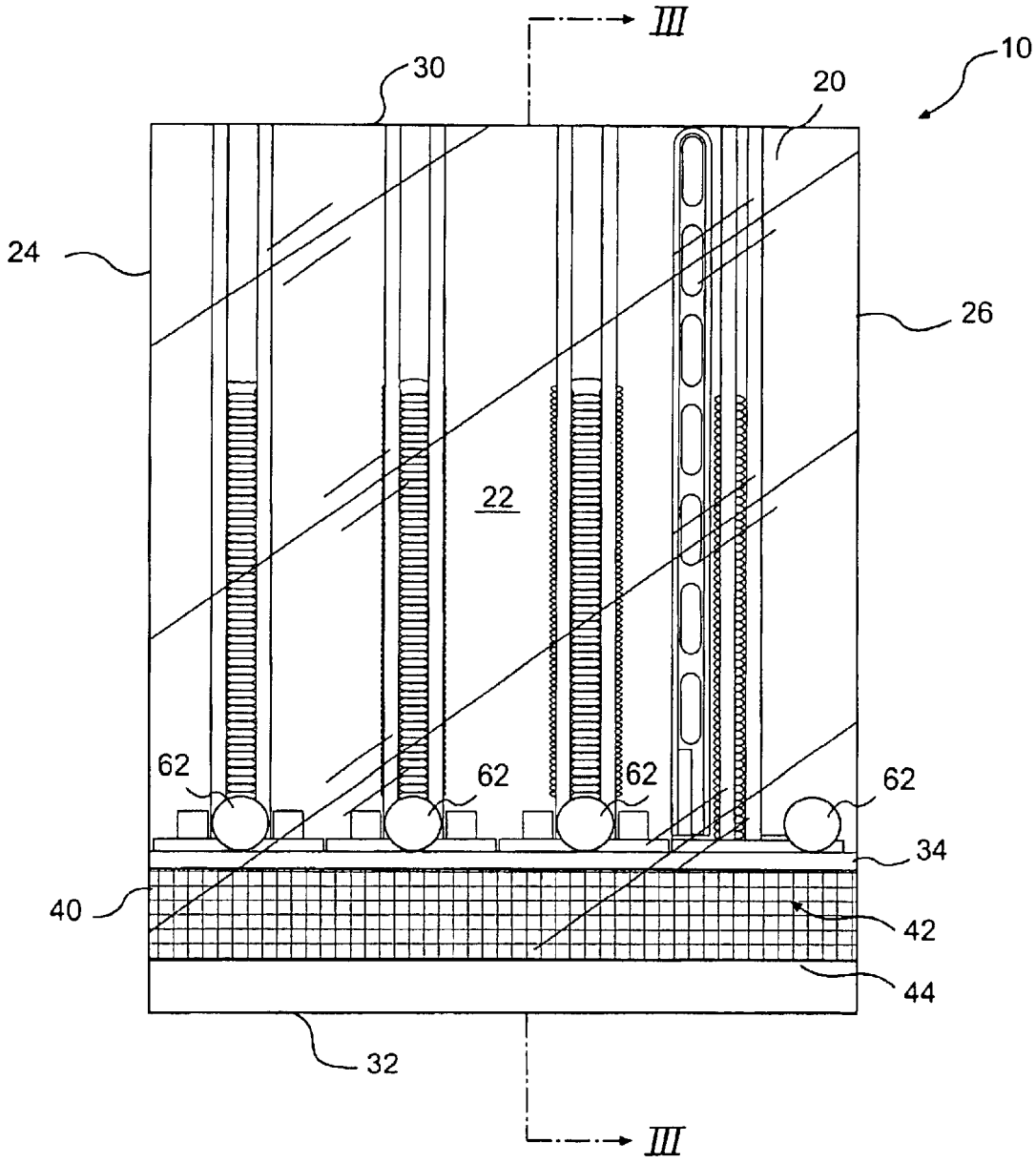
FIG. 2 is a front plan view of the dispenser shown in FIG. 1.
Figure 3:
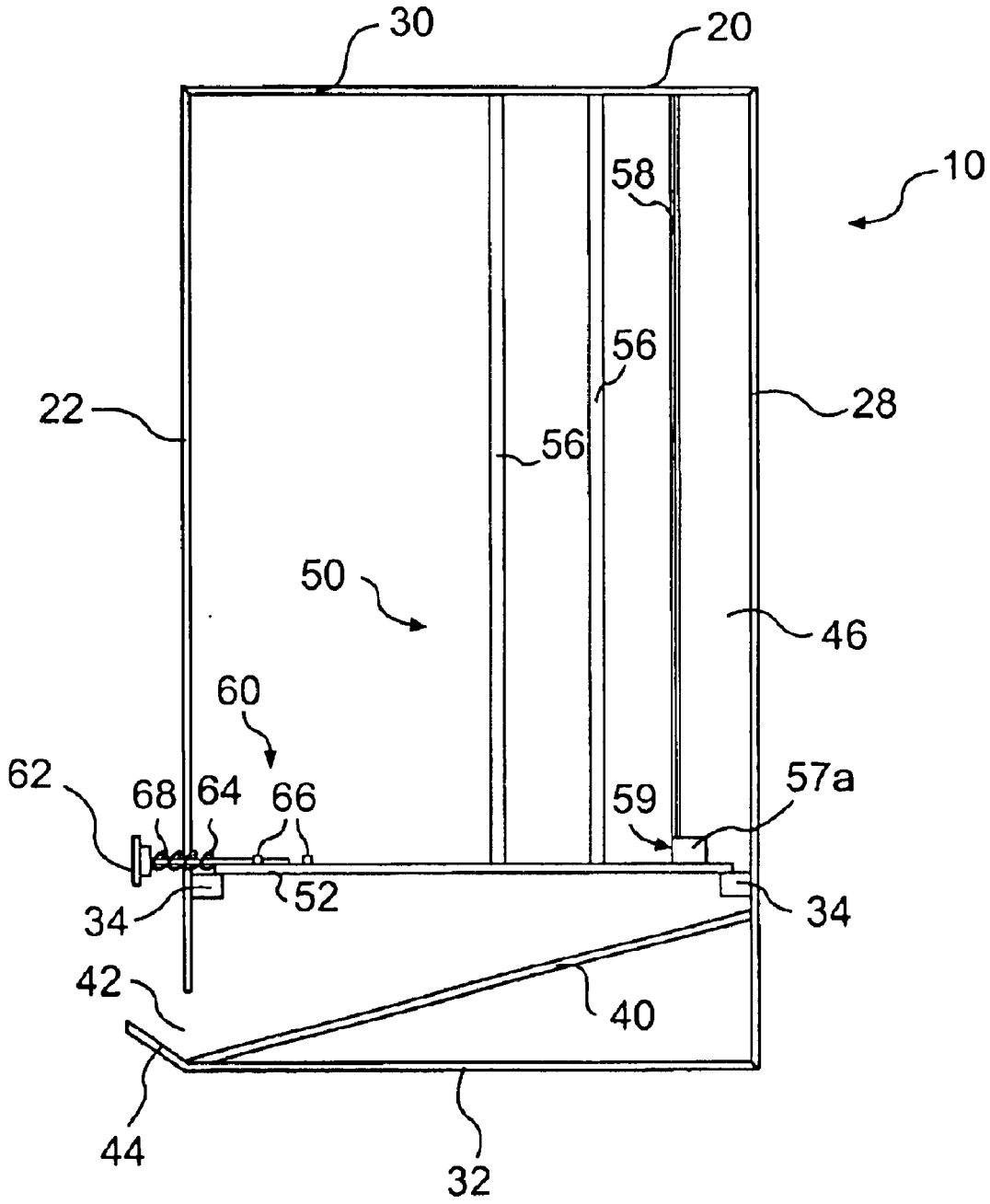
FIG. 3 is sectional side view of the dispenser shown in FIG. 1 taken along the lines III—III in FIG. 2 (although empty of any utensils)

As shown in the FIGS., the present invention is directed to a dispenser 10 that generally comprises a housing 20 having at least a bottom wall 32 comprising a base 52. In one embodiment, the dispenser 10 may include at least one cassette assembly 50 that includes a base 52. A dispensing mechanism 60 is provided that is capable of moving at least one utensil. FIGS. 1–3 illustrate the housing 20, FIGS. 4–13 illustrate one embodiment of a cassette assembly 50, and FIGS. 14–21 illustrate another embodiment of a cassette assembly 50'.

As shown in FIGS. 1–3, the housing 20 comprises at least one wall and preferably four side walls 22, 24, 26, 28, a top wall 30, and a bottom wall 32. The walls may be integrally formed together or one or more of the walls may be movably attached to other of the walls. The walls define an interior compartment 46 of the housing 20. The shape and size of the housing 20 may be dependent on the dimensions of the one or more cassette assemblies 50 contained therein, as well as the number of cassette assemblies 50 contained therein. As shown, the housing 20 has a square or rectangular shape. The housing 20, however, is not limited to being square or rectangular, and may have a variety of shapes, such as, circular, triangular, pentagonal, and the like. In one embodiment, the size of the housing 20 ranges from about 10 to about 17 inches in length (as shown, between walls 24 and 26), about 8 to about 14 inches in width (as shown, between walls 22 and 28), and about 20 to about 30 inches in height (as shown, between top wall 30 and bottom wall 32). In an exemplary embodiment, the housing 20 is about 14 inches in length, about 12 inches in width, and about 24 inches in height. The housing 20, however, is not limited to these dimensions, but may comprise a variety of sizes which would be readily apparent to the skilled artisan. The housing 20 may be comprised of a variety of materials, such as plastic, metal, or wood.

In one embodiment, a portion of the dispensing mechanism 60 is inserted through a side wall of the housing 20, and utensils are dispensed through a side wall of the housing 20. As shown, a portion of the dispensing mechanism 60 is inserted through the side wall 22 and utensils are dispensed through the same side wall 22. The side wall 22 may be considered to be the "front" side wall when it is the wall facing a user when the user utilizes the dispenser 10 to obtain a utensil. It should be appreciated, however, that any side wall may have the dispensing mechanism 60 inserted therethrough and any side wall may have the utensils dispensed therethrough. In addition, in an alternative embodiment, utensils may be dispensed through the bottom wall 32 of the housing 20.

As shown in FIGS. 1–3, one or more actuating members 62 of the dispensing mechanism 60 are positioned outside the side wall 22 of the housing 20. Each actuating member 62 is connected with a shaft portion 68 that extends through an opening 48 (see FIG. 1) in the side wall 22 and into the interior compartment 46 of the housing 20. A spring 64 of the dispensing mechanism 60 is positioned around the shaft portion 68 and may be positioned partly outside the housing 20. As discussed in more detail below, the user presses one of the actuating members 62 in order to dispense a desired utensil. In one embodiment, labels or other indicia are provided on the outside surface of the side wall 22 proximal to each actuating member 62 or on the actuating member 62 itself in order for the user to associate each actuating member 62 with the particular type of utensil dispensed if that actuating member 62 is pressed.

As shown in FIGS. 1–3, in one embodiment, the side wall 22 of the housing 20 defines an opening 42 therein. The opening 42 is where utensils are dispensed from the dispenser 10. The opening 42 is generally positioned proximal to a bottom of the side wall 22. While the opening 42 as shown is rectangular or square in shape, it should be appreciated that the opening 42 is not limited to these shapes, but may comprise a variety of shapes. The opening 42 generally extends upward from the bottom of the side wall 22 and extends along the entire length of the side wall 22 (i.e., between wall 24 and wall 26). Thus, the opening 42 may generally have the same length as that of the side wall 22. In one embodiment, the opening 42 is about 6 inches in height and about 14 inches in length (from side wall 24 to side wall 26). Again, it should be appreciated that the opening 42 is not limited to these dimensions, but may comprise a variety of sizes.

In one embodiment (not shown), a portion of the front wall 22 is transparent so that one may look through the front wall 22 to see if additional utensils need to be supplied to the one or more cassette assemblies in the housing or, in the alternative, if additional cassette assemblies need to be provided in the housing. As shown in FIGS. 1 and 2, the entire wall 22 is transparent. Also, for convenience to see the interior compartment 46 of the housing 20, the wall 26 is also shown as being transparent.

In one embodiment (not shown), the dispenser 10 is capable of being positioned on a surface, such as a table or counter. In another embodiment (also not shown), the dispenser 10 is capable of being mounted. The dispenser may be mounted to, for example, a wall of a room or a side wall of a counter in a food establishment or other entity. In particular, one of the walls of the housing defines one or more openings that are engageable with brackets or the like attached to the wall, or vice versa, to mount the dispenser to the wall. In another embodiment (also not shown), the dispenser 10 is capable of being mounted on a stand or post.

As shown in FIGS. 1–3, in one embodiment, a stopping member 44 is provided near the bottom of the side wall 22 below the opening 42. The stopping member 44 is provided to stop or "catch" a utensil that is dispensed from the dispenser 10 so that the utensil does not fall out of the dispenser 10 before the user can grab the utensil. The stopping member 44 is angled outward and upward from the bottom of the side wall 22. The amount of this angle is generally sufficient so that a dispensed utensil from the housing 20 will not fall out of the housing 20. In one embodiment, the range of this angle is between about 1 to about 90 degrees from the bottom of the side wall 22. In an exemplary embodiment, the stopping member 44 is angled upward at an angle of about 45 degrees.

While the stopping member 44, as shown, is rectangular or square in shape, it should be appreciated that the stopping member 44 is not limited to these shapes, but may comprise a variety of shapes. The stopping member 44 generally extends across the length of the side wall 22 (i.e., between walls 24 and 26). The length of extension the member the of stopping member 44 ranges from about 1 to about 2 inches. Again, it should be appreciated that the stopping member 44 is not limited to these dimensions, but may comprise a variety of sizes.

The stopping member 44 may be comprised of a variety of materials, such as plastic, wood, or metal. The stopping member 44 may also be attached, either directly or indirectly, with the side wall 22 and/or the bottom wall 32. In one embodiment, the stopping member 44 is integrally formed with the side wall 22 and/or the bottom wall 32.

In an alternative embodiment, instead of the stopping member 44, a tray or catch pan (not shown) is provided so that the dispensed utensil falls out of the opening 42 in the side wall 22 and into the tray or catch pan. The user can then remove the dispensed utensil from the tray or catch pan.

As shown in FIGS. 1–3, in one embodiment, a holding member 34 is provided in the interior compartment 46 of the housing 20. The holding member 34 is provided to hold one or more cassette assemblies 50 in the housing 20. As shown, in one embodiment, the holding member 34 is a rectangular or square frame (i.e., shaped like a picture frame) that fits just inside the housing 20. In another embodiment (not shown), the holding member 34 generally comprises a flat surface that extends across an entire horizontal cross-sectional area of the housing 20 and that defines one or more openings that cooperate with openings 54 (discussed below) of the cassette assemblies 50. In another embodiment (also not shown), flanges that extend inwardly from inner surfaces of one or more of the side walls 22, 24, 26, and 28 may comprise the holding member 34. Here, the ends of the cassettes assemblies 50 would rest on the inwardly extending flanges.

In the embodiment shown, the holding member 34 is attached to one or more of the side walls 22, 24, 26, or 28. In one embodiment (not shown), the holding member 34 may be integrally formed with the housing 20. Because the holding member 34 fits just inside the housing 20, the holding member 34 generally has the same dimensions as the bottom wall 32 of the housing 20. In one embodiment, the size of the holding member 34 ranges from about 10 inches to about 17 inches in length (i.e., between walls 24 and 26) and about 8 inches to about 14 inches in width (i.e., between walls 22 and 28). The holding member 34, however, is not limited to these dimensions, but may comprise a variety of sizes. In addition, the holding member 34 may be comprised of any suitable material, including wood, plastic, or metal.

The holding member 34 is spaced from the bottom wall 32 of the housing 20. This spacing would generally allow a user to stick his hand into the housing 20 and under the holding member 34 to grab a utensil dispensed from a cassette assembly 50. In one embodiment, the holding member 34 is spaced from the bottom wall 32 by about six inches.

As shown in FIGS. 1–3, in one embodiment, a slider member 40 is also provided in the interior compartment 46 of the housing 20. The slider member 40 is positioned under the holding member 34 and the one or more cassette assemblies 50 contained in the housing 20. The slider member 40 may be provided to allow utensils dispensed from a cassette assembly 50 to slide down the slider member 40 to the opening 42 in the front wall 22 of the housing 20. In this manner, a user would not have to reach into the housing 20 through the opening 42 to grab a utensil dispensed from a cassette assembly 50.

The slider member 40 is inclined downward from the rear side wall 28 to the front side wall 22. The slider member 40 may be inclined downward at any angle that would allow a utensil to slide thereon. In one embodiment, the slider member 40 is generally inclined downward at a range of from about 1 to about 90 degrees. In an exemplary embodiment, the slider member 40 is angled at about 30 degrees.

In one embodiment, the slider member 40 is loosely supported in the housing 20 by resting the slider member 40 on pins (not shown) that extend inwardly from the inner surfaces of one or more of the side walls 22, 24, 26, or 28 and/or supported on the inner surface of the bottom wall 32. Because the slider member 40 is loosely supported in the housing 20, the slider member 40 may be easily retrieved for cleaning. In the alternative, the slider member 40 may be integrally formed with the housing 20.

In one embodiment, as shown in FIGS. 1–3, the slider member 40 may be comprised of a screen- or mesh-like material. It should be appreciated that a screen- or mesh-like material may make it easier to maintain sanitary conditions as it would allow small particles to pass therethrough to the bottom of the dispenser 10 or out of the dispenser 10. In an alternative embodiment, the slider member may be comprised of a stainless steel material. It should also be appreciated that the use of a stainless steel material aids in cleaning as such a material may be easily sterilized.

In an exemplary embodiment, the slider member 40 is a grate. The shape and size of the slider member 40 is generally such that it is positioned entirely under the one or more cassette assemblies 50. In one embodiment, the slider member 40 is generally rectangular or square in shape. The slider member 40, however, is not limited to these shapes, and may comprise a variety of shapes. In one embodiment, the size of the slider member 40 ranges from about 10 to about 17 inches in length (i.e., between walls 24 and 26) and about 8 to about 14 inches in width (i.e., between walls 22 and 28).

According to one embodiment, there are at least five types of cassette assemblies 50 or 50', one for each of the at least five types of cutlery utensils: forks, spoons, soup spoons, sporks, and knives. For each type of utensil, there may be different sizes of cassette assemblies for different sizes of that type of utensil. The cassette assemblies may be interchangeable in the housing. More particularly, each cassette assembly may have generally the same geometry with other cassette assemblies. In other words, the internal geometry of each cassette assembly is similar but unique to hold its respective type of utensil. This allows modular interchangeability between cassette assemblies for different cutlery utensil types. For example, a cassette assembly containing knives may be interchanged from a housing with a cassette assembly containing soup spoons if the food establishment sees that the demand will generally be for soup spoons, and not for knives, and vice versa.

One or more cassette assemblies 50 or 50' may be provided within a single housing 20. As shown in FIGS. 1–3, four cassette assemblies 50 or 50' may be provided in a single housing 20. These plurality of cassette assemblies 50 or 50' can be for a single type of utensil or more than one type. For example, if four cassette assemblies 50 or 50' are provided in a single housing 20, each cassette assembly 50 or 50' may contain one of forks, spoons, sporks, soup spoons, and knives, as shown in FIGS. 1–3.

To place a cassette assembly 50 or 50' within the housing 20, the housing 20 is first opened. More particularly, at least one of the walls 22, 24, 26, 28, 30, or 32 of the housing 20 is openable relative to one or more of the other walls. In one embodiment, the front wall 22 of the housing 20 is swung open relative to the wall 24 (or wall 26), top wall 30, and bottom wall 32 by swinging the front wall 22 on hinges (not shown). It should be appreciated that the front wall 22 may be provided with a locking device (not shown) to lock the housing 20 to only allow authorized persons into the interior compartment 46 of the housing 20.

One or more cassette assemblies 50 or 50' may be placed in the housing 20 in the following manners, after the housing 20 is opened. Generally, one or more cassette assemblies 50 or 50' are placed on the holding member 34 provided in the interior compartment 46. In one embodiment, the holding member 34 is a frame that fits just inside the housing 20 and is attached to the side walls of the housing 20, and the cassette assembly 50 or 50' is placed to rest on the frame. In one embodiment, the base 52 simply rests on the holding member 34. In an alternative embodiment, the base 52 defines a pin engaging opening therein (not shown) and the holding member 34 includes an upwardly extending pin (also not shown). To engage the cassette assembly 50 or 50' with the holding member 34 of the housing 20, the base 52 is positioned on the holding member 34 so that the pin of the holding member 34 is inserted into the pin engaging hole of the base 52.

While there are at least five types of cassette assemblies, there are generally only two embodiments of cassette assemblies because the cassette assemblies for spoons, soup spoons, forks, and sporks generally have the same geometry. FIGS. 4–13 illustrate the embodiment of the cassette assembly 50 that contains one or more spoons, forks, or sporks, while FIGS. 14–21 illustrate the embodiment of the cassette assembly 50' that contains one or more knives.

As shown in FIGS. 4–13, the cassette assembly 50 that contains spoons, forks, and sporks includes a base 52 and at least one alignment member 56. In one embodiment, the cassette assembly 50 further includes a dispensing mechanism 60.

Figure 12:
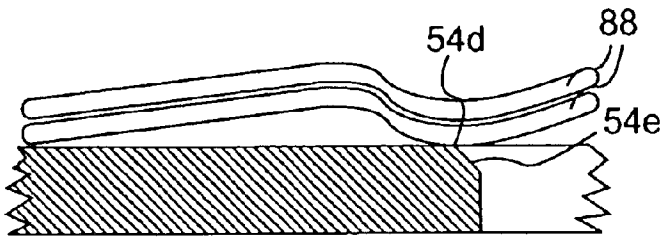
FIG. 12 is a cross-sectional view of a portion of a cassette base and its opening taken along line XII—XII in FIG. 9, which also illustrates a bottommost utensil and the utensil immediately above the bottommost utensil, before the bottommost utensil is dispensed.

According to one embodiment, at least one cutlery utensil is held in a stack of utensils 80 (see FIG. 7) in the cassette assembly 50. With respect to spoons, sporks, and forks, FIG. 12 illustrates two utensils 88 stacked together in the normal position, i.e., before the bottommost utensil is dispensed. It should be appreciated that the handle portion of each spoon, spork, or fork inclines upward from the end of the handle end up to the bowl, bowl/tine, or tine, respectively. This incline stops and then extends slightly downward to the bowl, bowl/tine, or tine portion of the utensil. In this manner, two or more utensils may be nested together to stack the utensils together. The portion of the utensil that extends slightly downward to the bowl, bowl/tine, or tine portion may be referred to herein as the "shoulder" of the utensil.

While, as shown, all of the utensils of the stack of utensils 80 are perpendicular to the base 52, it should be appreciated that the utensils of the stack of utensils 80 may be provided at any angle relative to the base 52 that allows the bottommost utensil to be realigned into a position for dispensing that utensil, e.g., by gravity. The cassette assemblies 50 may hold any number of cutlery utensils in the stack. This number is merely limited by the height of the alignment members 56. In an exemplary embodiment, the cassette assembly 50 holds between about one utensil to about 150 utensils.

Figure 7:
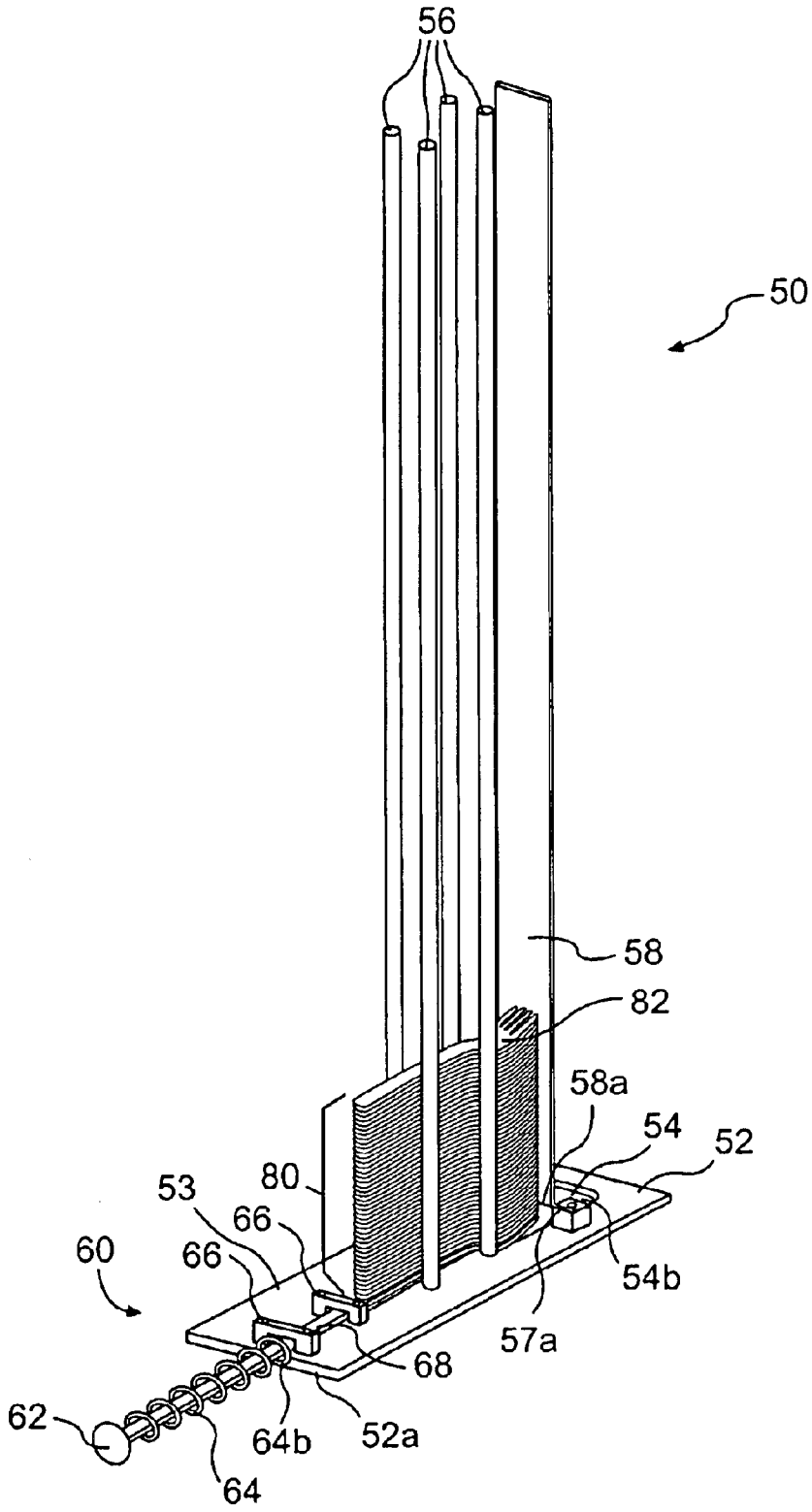
FIG. 7 is a front perspective view of the cassette assembly shown in FIG. 4 filled partway with forks.
Figure 8:
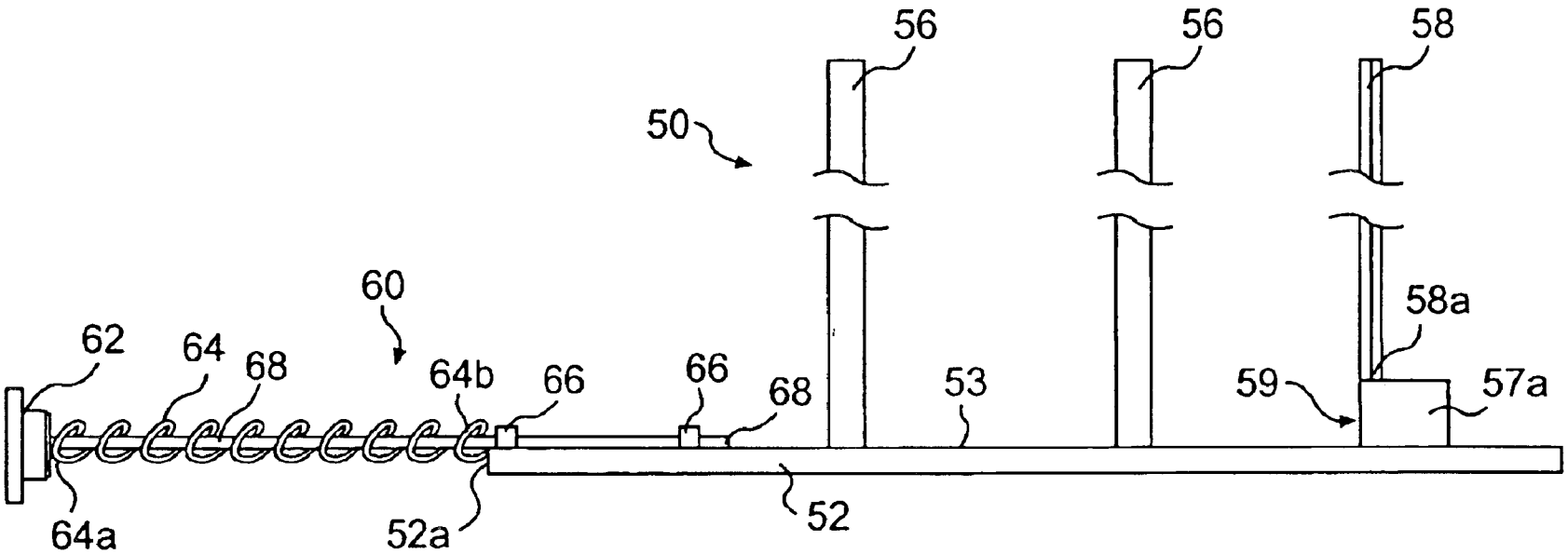
FIG. 8 is a side plan view of the cassette assembly shown in FIG. 4.

The base 52 is provided to support a stack of utensils 80 (see FIG. 7). The base 52 is connected with the at least one alignment member 56, and may be connected with components of the dispensing mechanism 60. The base 52 may be comprised of any known material that is capable of supporting the weight of a stack of utensils 80 (see FIG. 7), including, for example, plastic, metal, or wood. In one embodiment, the base 52 is comprised of a plastic material. As shown, the base 52 is generally square or rectangular in shape. The base 52 is not, however, limited to being square or rectangular, but may comprise a variety of shapes, including, for example, triangular, circular, pentagonal, and the like. The size of the base 52 ranges from about 2 to about 4 inches in width and about 8 to about 12 inches in length. In one embodiment, the base 52 is about 4 inches in width and about 12 inches in length. (When the cassette assembly 50 is positioned in the housing 20, the width of the cassette base 52 is in the direction between walls 24 and 26 of the housing 20 and the length of the cassette base 52 is in the direction between walls 22 and 28 of the housing 20 (see FIGS. 1–3)). Again, the base 52 is not limited to these dimensions, but may comprise a variety of sizes.

As shown in FIGS. 4, 5, and 9–11, the base 52 defines an opening 54 therein. For the embodiment shown in these FIGS., the opening 54 is a dispensing opening that is configured to allow a spoon, fork, or spork to fall therethrough. The size of the opening 54 is generally dependent on the type, size, and weight of the cutlery to be dispensed. The size of the opening 54 is slightly longer and wider than the length and width of the utensil to be dispensed. In one embodiment, the opening 54 is generally about 4 inches to about 10 inches in length. In an exemplary embodiment, the opening 54 is about 6 inches to about 8 inches in length. For this embodiment, the opening 54 generally has two different widths, a narrower portion 54*a* where the handle end of a fork, spoon, or spork would fall through and a wider portion 54*b* where the tine portion of a fork, the bowl portion of a spoon, or the bowl/tine portion of a spork would fall through. The narrower portion 54 ranges from about 0.1875 inches to about 0.500 inches in width. The wider portion 54*b* ranges from about 0.75 inches to about 2.5 inches in width. In one embodiment, the narrow portion 54*a* is about 0.25 inches wide, and the wider portion 54*b* is about 1.5 inches to about 2.0 inches wide. (For the opening 54, when the cassette assembly 50 is placed in the housing 20, the width is in the direction between walls 24 and 26 of the housing 20 and the length is in the direction between walls 22 and 28 of the housing (see FIGS. 1–3)).

Figure 13:
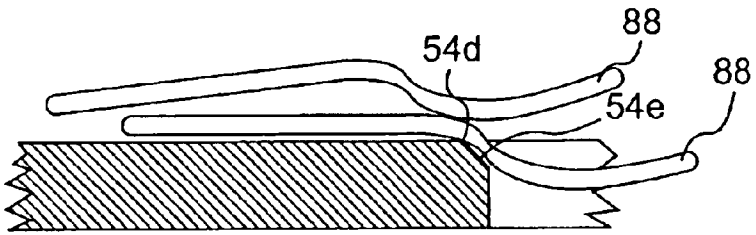
FIG. 13 is a cross-sectional view of a portion of the cassette base and its opening taken along line XII—XII in FIG. 9, which also illustrates the bottommost utensil and the utensil immediately above the bottommost utensil, and movement of the bottommost utensil for dispensing of that utensil.

As shown in FIGS. 4, 5, and 9–11, the dispensing opening 54 extends through the thickness of the cassette base 52. A cross-section of the thickness of the cassette base 52 at an edge 54*d* of the opening 54 is shown in FIGS. 12 and 13. As shown in FIGS. 12 and 13, at least a portion of the thickness of the cassette base 52 defining the opening 54 at the edge 54*d* includes an inclined portion 54*e*. It should be appreciated that at least a portion of the thickness of the cassette base 52 defining the opening 54 at another edge 54*c* may also include an inclined portion 54*e*. In one embodiment, the one or more inclined portions 54*e* may be inclined support surfaces that incline inwardly and downwardly and that are formed in the base 52 adjacent the dispensing opening 54. (When the cassette assembly 50 is placed in the housing 20, "inwardly" is in the direction toward side wall 28 of the housing 20 and "downwardly" is in the direction toward bottom wall 32 of the housing 20.)

In one embodiment, the edges 54*c* and 54*d* are connecting edges that connect that the narrower portion 54*a* and the wider portion 54*b* of the opening 54. Each inclined portion 54*e* may extend downward from along the entire length of the connecting edge 54*c* and/or the connecting edge 54*d*. In other words, along the entire length of the connecting edge 54*c* and/or the connecting edge 54*d* at the top surface 53 of the cassette base 52, the thickness of the cassette base 52 that defines the opening 54 may be inclined to form an inclined portion 54*e*. In an alternative, each inclined portion 54*e* may extend downward only from a portion of less than the entire length of the connecting edge 54*c* and/or the connecting edge 54*d*.

In addition, as shown in FIGS. 12 and 13, each inclined portion 54*e* may be provided only as a portion of the thickness of the cassette base 52. For example, each inclined portion 54*e* may be about 20% to about 25% of the entire thickness of the cassette base 52 at the opening 54. In one embodiment, the cassette base 52 is about ¼ inch in thickness, and each inclined portion 54*e* is about 0.05 inch to about 0.0625 inch of the thickness of the cassette base 52. In an alternative embodiment (not shown), the entire thickness of the cassette base 52 defining the opening 54 may be inclined to form the inclined portion 54*e*. In one embodiment, each inclined portion 54*e* is inclined downward at an angle of about 1 degree to about 89 degrees relative to the top surface 53 of the cassette base 52. In another embodiment, the inclined portion 54*e* is inclined downward at an angle of about 45 degrees relative to the top surface 53 of the cassette base 52. As discussed in more detail below, the inclined portions 54*e* may be provided at edges 54*c* and/or 54*d* to allow the bottommost utensil to move downward by sliding down the inclined portions 54*e* during the dispensing of that utensil.

Figure 9:
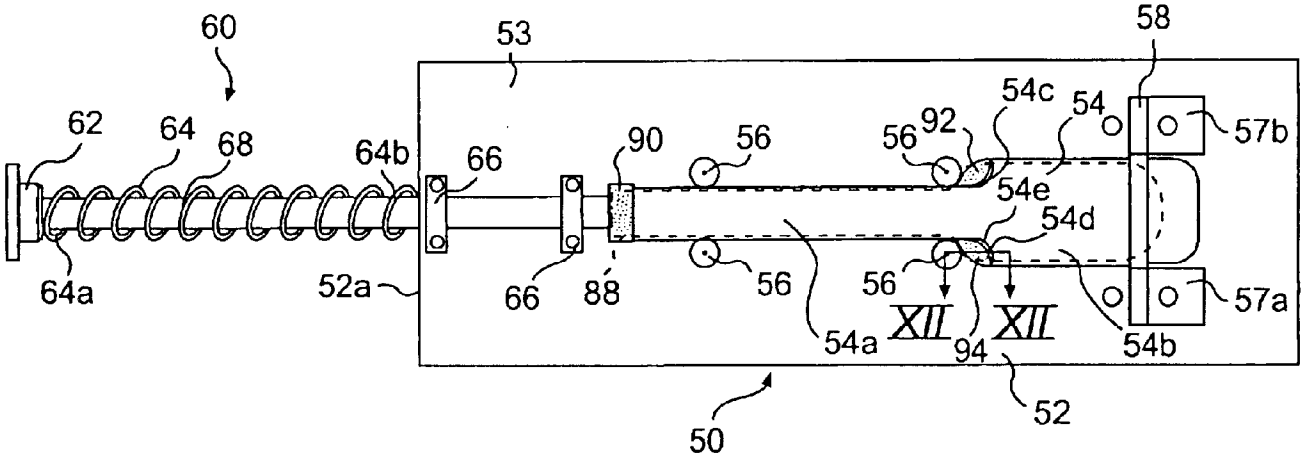
FIG. 9 is a top plan view of the cassette assembly shown in FIG. 4, illustrating the position of a bottommost utensil before any dispensing action occurs.
Figure 10:
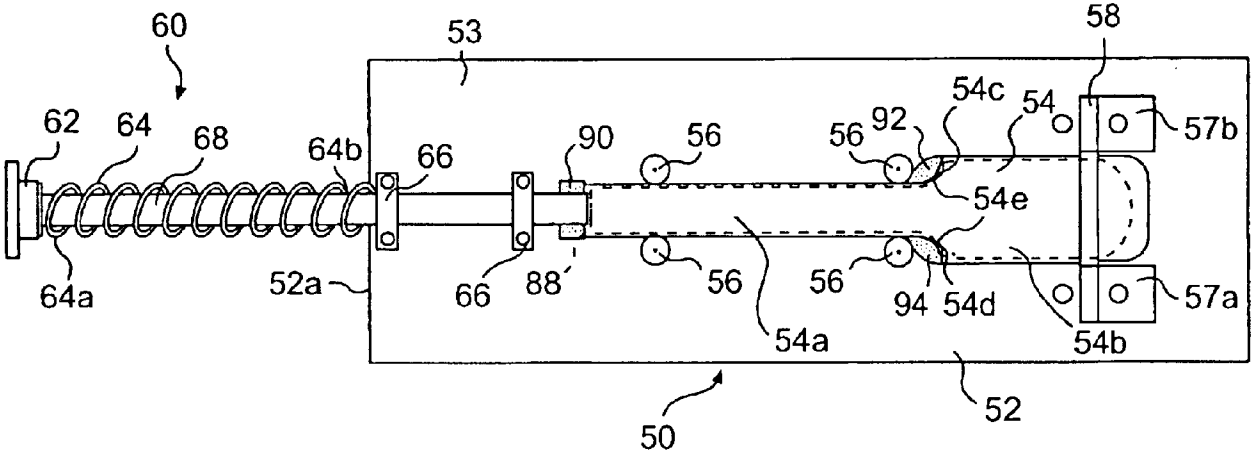
FIG. 10 is a top plan view of the cassette assembly shown in FIG. 4, illustrating initial movement of a dispensing mechanism and the dispensing of the bottommost utensil, relative to FIG. 9.
Figure 11:
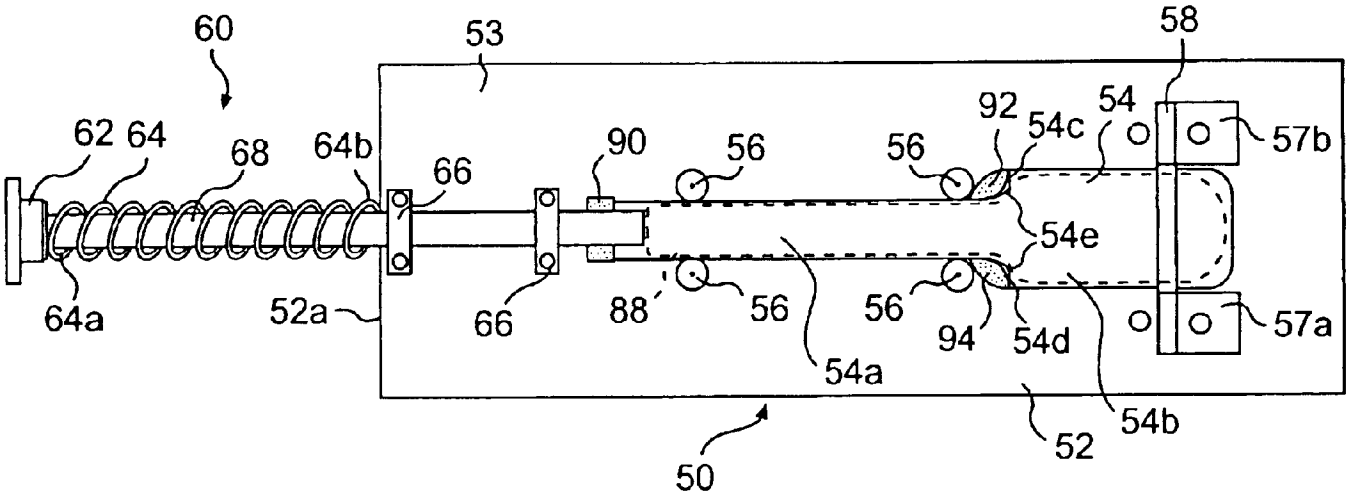
FIG. 11 is a top plan view of the cassette assembly shown in FIG. 4, illustrating additional movement of the dispensing mechanism and the dispensing of the bottommost utensil, further to the movement shown in FIG. 10.

As shown most clearly in FIGS. 9–11, in one embodiment, the edges 54*c*, 54*d* may be curved edges that define the opening 54 on the top surface 53 of the cassette base. In another embodiment (not shown), the edges 54*c*, 54*d* are straight edges that are perpendicular to the longitudinal (or lengthwise) edges of the narrower portion 54*a* and the wider portion 54*b* of the opening 54. (Again, for the opening 54, when the cassette assembly 50 is placed in the housing 20, length is in the direction between walls 22 and 28 of the housing 20 (see FIGS. 1–3)).

In one embodiment, as shown in FIGS. 1–5, 7, and 8, the base 52 may be generally horizontally disposed. In the alternative, the base 52 may be inclined. The use of an inclined base 52 may be advantageous as the force of gravity may then be partially borne by some support other than the bottommost utensil. This would allow a further decrease in the force required to dispense the bottommost utensil.

According to one embodiment, and referring to FIGS. 4, 5, and 7–11, the alignment members 56 are provided to align a stack of spoons, forks, or sporks in the cassette assembly 50, and to limit movement of the stack of spoons, forks, or sporks in the horizontal direction. One of the alignment members comprises an alignment guard member 58 that also aids in dispensing of the bottommost utensil of the stack of utensils 80, as discussed below. In one embodiment, the alignment members 56 and 58 extend generally perpendicular to the base 52. In one embodiment, as shown in FIGS. 1–5, 7, and 8, the alignment members 56 and 58 generally extend generally perpendicularly from the base 52.

Figure 4:
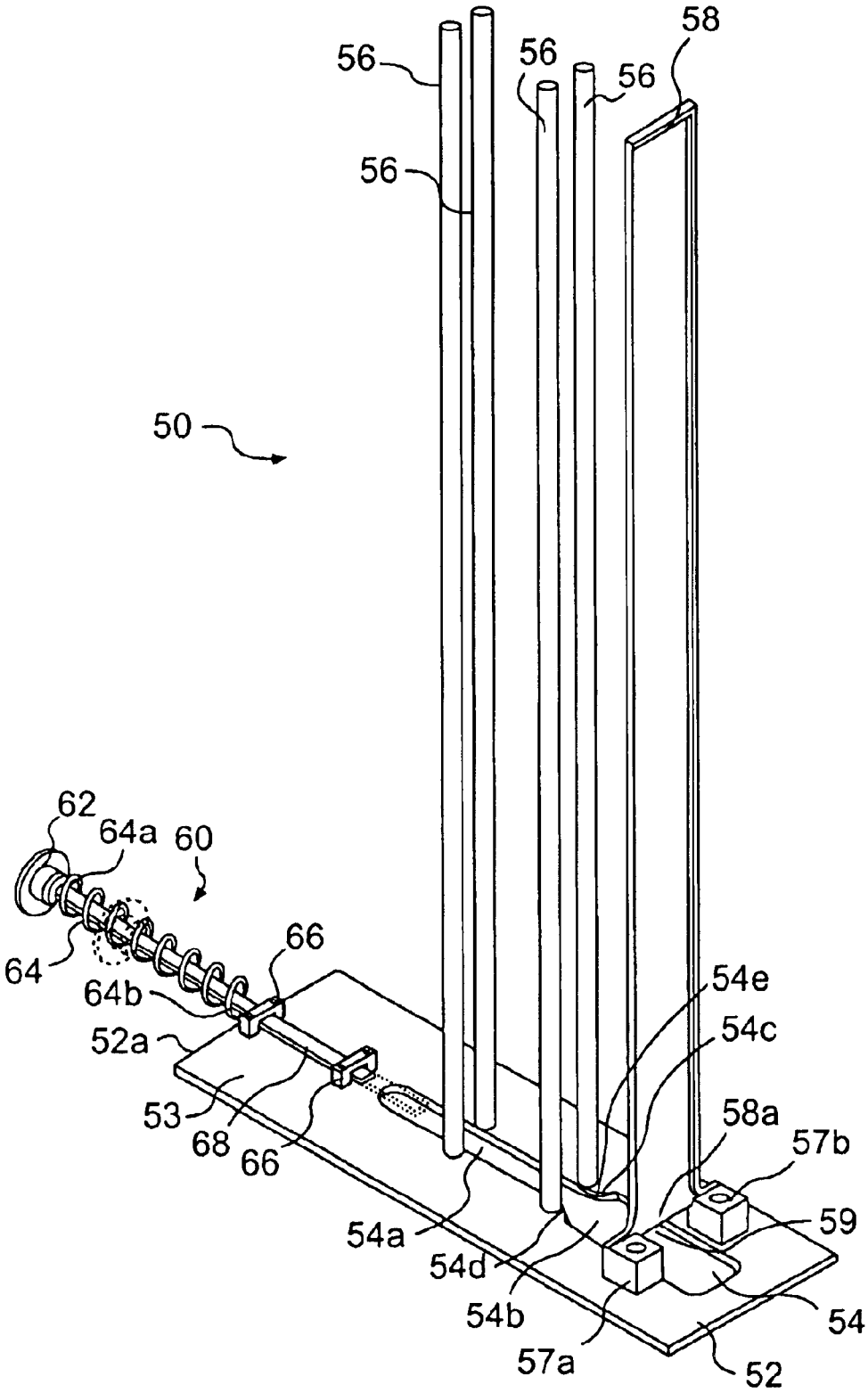
FIG. 4 is a rear perspective view of a cassette assembly of one embodiment of the present invention.
Figure 5:
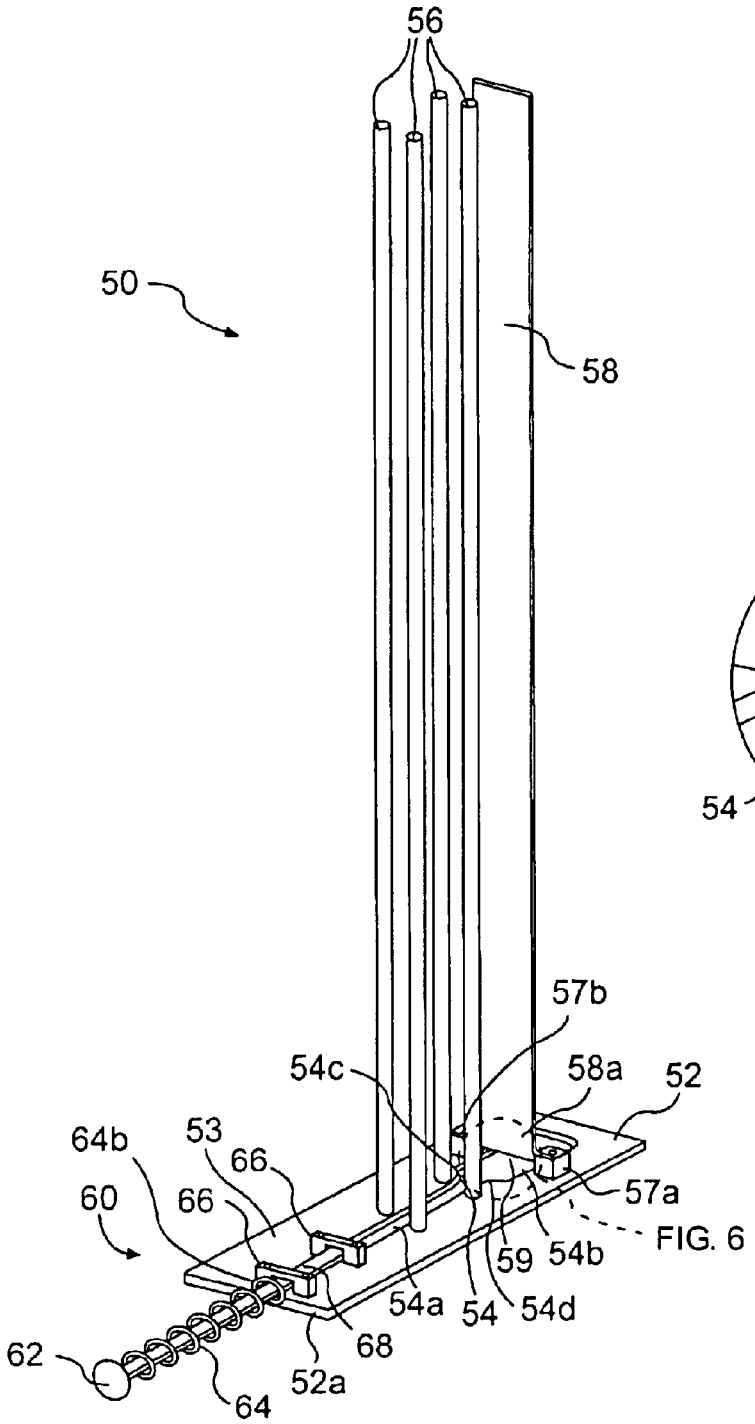
FIG. 5 is a front perspective view of the cassette assembly shown in FIG. 4 when not containing any utensils.
Figure 6:
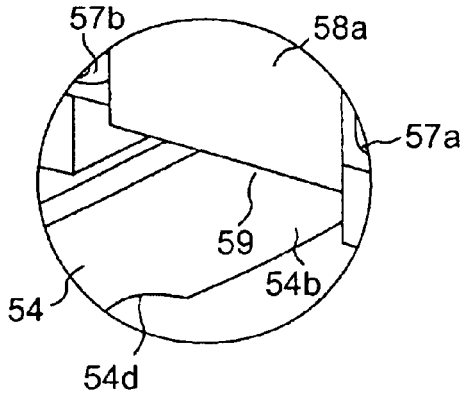
FIG. 6 is an enlarged detailed view of the circled area shown in FIG. 5.

The alignment members 56 or 58 may be connected with, either directly or indirectly, the base 52. The alignment members 56 or 58 may be directly connected with the base 52 by any attachment means, including, for example, screwing or bolting the members 56 or 58 into the base 52 or attaching the members 56 or 58 to the base 52 using adhesive. In one embodiment, as shown in FIGS. 4, 5, and 7, the alignment guard member 58 is integrally formed with blocks 57*a*, 57*b*. The blocks 57*a*, 57*b* may be provided to facilitate the attachment of the alignment guard member 58 to the base 52. The blocks 57*a*, 57*b* are attached to the base 52 outside the opening 54 in the base 52. In another embodiment (not shown), the alignment guard member 58 is attached to two blocks 57*a*, 57*b* provided on either side of the wider portion 54*b* of the opening 54 in the base 52. The blocks 57*a*, 57*b* may be attached to the base 52 by any attachment means, such as bolts, screws, or adhesive.

The alignment members 56 and 58 may be integrally formed of the same material with the base 52. The alignment members 56 and 58 may be comprised of a suitable material, including, for example, plastic, metal, or wood. In one embodiment, at least some of the alignment members 56 are wood dowels. In one embodiment, the alignment guard member 58 is comprised of a plastic material. Each alignment member 56 and 58 may comprise a variety of shapes, including, but not limited to, cylindrical (i.e., rod-like) or a generally flat planar surface that extends generally perpendicular to the top surface 53 of the base 52.

The alignment members 56 and 58 may comprise a variety of heights. In one embodiment, the alignment members 56 and 58 are about 24 inches in height. In one embodiment, a plurality of alignment members 56 and/or 58 are provided. As shown in the embodiment of FIGS. 4, 5, and 7–11, four alignment members 56, plus the alignment guard member 58, are provided.

According to one embodiment, and again referring to FIGS. 4, 5, and 7–11, the alignment members 56 and 58 are provided to align a stack of spoons, forks, or sporks and to limit horizontal movement of the stack. With respect to the alignment members 56, at least certain of the alignment members 56 bear against the shoulders of forks, spoons, or sporks to maintain the utensils in a supported configuration closely adjacent to the dispensing opening 54. With respect to the alignment guard member 58, and referring to FIG. 7, the alignment guard member 58 contacts the tine portions of the forks 82 to maintain the utensils in the supported configuration. It should be appreciated that the bowl portion of spoons and the bowl/tine portion of sporks would contact the alignment guard member 58 in the same manner.

Thus, the utensils (such as the forks 82) are limited in movement in the horizontal direction because, first, the alignment members 56 limit side to side movement of the forks 82 (i.e., between walls 24 and 26 of housing 20) by, in part, bearing against the shoulders of the utensils and, second, the alignment guard member 58 limits front to back movement of the forks 82 (i.e., between walls 22 and 28 of the housing 20). Accordingly, all of the utensils stacked above the bottommost utensil 88 are restrained from movement by the alignment members 56 and 58, which aids in the movement of only the bottommost utensil 88 out of the supported configuration.

As shown in FIGS. 4, 5, and 7–11, to aid in dispensing of utensils, the guard alignment member 58 is connected with the cassette base 52 around the edges of the opening 54, and defines an opening 59 above the opening 54 that allows one utensil to pass therethrough. As shown most clearly in FIGS. 4–6, the alignment guard member 58 defines the opening 59 at a bottom end 58*a* thereof. The height of the opening 59 allows only one utensil to pass therethrough at a time. The size of the opening 59 is generally dependent on the type, size, and weight of the cutlery to be dispensed. Generally, the height of the opening 59 is about 101% to about 199% of the overall height of the utensil to be dispensed. For the dispensing of typical disposable forks, spoons, or sporks, the height of the opening 59 ranges from about 0.093 inches to about 0.500 inches in height. In one embodiment, the height of the opening 59 ranges from about 0.125 inches to about 0.375 inches in height. In one embodiment, the height of the blocks 57*a*, 57*b* is such that the opening 59 allows only one utensil therethrough at a time.

As shown in FIGS. 4, 5, and 7–11, in one embodiment, the dispensing mechanism 60 is also connected with the base 52 of the cassette assembly 50. In an alternative embodiment (not shown), the dispensing mechanism 60 may be connected with the housing 20 of the dispenser 10. In general, the dispensing mechanism 60 is utilized to move the bottommost utensil to move this utensil off of one or more support areas, through the opening 59 in the alignment guard member 58, to fall through the opening 54 in the cassette base 52. In one embodiment, after falling through the opening 54, the bottommost utensil further slides down the slider member 40, out through the opening 42 defined in the side wall 22 of the housing 20, to rest on the stopping member 44 or fall into the tray or catch pan (not shown).

The dispensing mechanism 60 may comprise a variety of mechanisms for moving the bottommost utensil. The mechanism 60 may move the bottommost utensil by pushing, pulling, biasing, and the like, the utensil. In one embodiment, the dispensing mechanism 60 includes an actuating member 62, a spring 64, at least one retainer 66, and an actuator comprised of a shaft portion 68. As shown in FIGS. 1–3, the actuating member 62 is positioned outside of the housing 20. In one embodiment, the actuating member 62 is positioned outside the side wall 22 of the housing 20. When desired, a user pushes or pulls the actuating member 62 for the type of desired utensil. This causes the desired utensil to fall out of the dispenser 10 against the stopping member 44 of the housing 20, as discussed in more detail below.

As shown in FIGS. 4, 5, and 7–11, the spring 64 is positioned around the shaft portion 68. The spring 64 is also positioned between the actuating member 62 and the base 52. More particularly, a first end 64*a* of the spring 64 contacts the actuating member 62 and a second end 64*b* of the spring 64 contacts an outer edge 52*a* of the cassette base 52. Because the spring 64 is positioned between the actuating member 62 and the base 52, the spring 64 normally pushes against the actuating member 62. In this manner, the normal position of the dispensing mechanism 60 is with the actuating member 62 being biased outward away from the utensils 80 so that the shaft portion 68 is not contacting the utensils 80.

The shaft portion 68 is provided to push against the bottommost utensil in the stack of utensils 80 contained in the cassette assembly 50. When the actuating member 62 is pushed inward against the biasing force of the spring 64 (i.e., toward the stack of utensils 80), the shaft 68 is also pushed towards the utensils 80. A portion of the shaft 68 slides relative to the top surface 53 of the cassette base 52. The shaft 68 may comprise any general shape, such as cylindrical. In the embodiment shown, a portion of the shaft 68 is flattened (i.e., has a squared cross-sectional area). The thickness or height of the end of the shaft 68 that contacts the utensils is such that it should only contact one utensil at a time and, more particularly, only the bottommost utensil in the stack of utensils 80. For this embodiment, the thickness of that end of the shaft 68 is about 80% of the thickness of the handle of the fork, spoon, or spork to be dispensed. This is not the overall height of the utensil, as the shaft 68 only contacts the handle end of the fork, spoon, or spork. The shaft 68 may have a different cross section between the actuating member 62 and the end of the shaft 68 that contacts the utensils to provide stiffening between the actuating member 62 and that end.

The at least one retainer 66 is provided so that the shaft 68 remains generally parallel to the base 52, and does not angle upward relative to the base 52 when being pushed in by the actuating member 62. As shown in FIGS. 4, 5, and 7–11, two retainers 66 are provided. The number of retainers is not limited to one retainer or two retainers, but may be any number of retainers. As shown, the retainers 66 are generally U-shaped with squared corners. The retainers 66 are attached, either directly or indirectly, to the base 52. The retainers 66 may be attached to the base 42 using any attachment means. In one embodiment (not shown), the retainers are integrally formed with the base 52 and then a portion of the retainers is cored out to allow the shaft 68 to pass therethrough.

FIG. 4 generally shows, by outline, the movement of the actuating member 62 and the shaft portion 68 of the dispensing mechanism 60. More particularly, FIGS. 9–11 illustrate from the normal position of the dispensing mechanism 60 through movement of the dispensing mechanism 60 to dispense a utensil (shown as dotted line 88) from the cassette assembly 50. Also, FIGS. 12 and 13 illustrate, respectively, the normal position of two utensils stacked together and then initial movement of the bottommost utensil 88 of the two utensils along the inclined portion 54*e* of the opening 54.

First, FIG. 9 illustrates how, in the normal position, while the bottommost utensil 88 is positioned on the cassette base 52, this utensil partly lays over the opening 54 defined in the cassette base 52. As shown, portions of the bottommost utensil are aligned by the base 52 around the opening 54 defined in the base 52. More particularly, the end of the handle end of the fork (or spoon or spork) lays just beyond the opening 54 and a portion of the tine portion of the fork (or the bowl portion of a spoon or the bowl/tine portion of the spork) also lays just beyond the opening 54.

Thus, the bottommost utensil is supported on support areas on the base 52. The bottommost utensil may be supported on any number of support areas. With respect to forks, spoons, and sporks, the bottommost utensil may be supported on three support areas 90, 92, and 94, which are shown as shaded areas in FIGS. 9–11. One support area 90 is positioned for the handle end of the fork (or spoon or spork) and the other support areas 92 and 92 are positioned at two symmetrical locations on the tine portion of the fork (adjacent to the handle) (or the bowl portion of the spoon or the bowl/tine portion of the spork). As shown most clearly in FIG. 9, these support areas 90, 92, and 94 are all positioned just outside the opening 54 in the base 52.

FIGS. 10 and 11 illustrate how the shaft portion 68 pushes against the bottommost utensil 88 to push it slightly in the lateral direction toward the opening 59 in the alignment guard member 58 and down the inclined portion 54*e*, and then through the opening 59 in the alignment guard member 58 to then lay over the opening 54 in the cassette base 52. The bottommost utensil 88 may not slide down the two inclined portions 54*e* at the exact same time or speed. The bottommost utensil 88 may, after sliding down part of one or more of the inclined portions 54*e*, be pushed sideways (i.e., towards wall 24 or wall 26 of the housing 20) to be dispensed through the opening 54 in the base 52.

To begin the dispensing action of a fork, spoon, or spork, the user presses the actuating member 62 that is outside the housing 20 (see FIGS. 1–3). Pushing on the actuating member 62 pushes against the outward biasing force of the spring 64 to push the shaft 68 toward the stack of utensils 80. The shaft 68 then engages the bottommost utensil in the stack of utensils 80.

In particular, as shown in FIGS. 10 and 13, the shaft 68 advances the bottommost utensil 88 off of the support areas 90, 92, and 94 to be pushed slightly in the direction toward the opening 59 defined in the bottom of the alignment guard member 58 and downward along one or both inclined portions 54*e*. More particularly, after the shaft 68 starts pushing on the bottommost utensil 88 in the stack of utensils toward the alignment guard member 58, the bottommost utensil 88 moves downward along the inclined portions 54*e* at the edges 54*c*, 54*d*. Because the bottommost utensil 88 is moving along the inclined portions 54*e*, the bottommost utensil 88 is further moving in the lateral direction toward the alignment guard member 58.

Referring to FIG. 13, because the bottommost utensil 88 moves slightly in the lateral direction toward the alignment guard member 58 and its opening 59, and moves downward along the inclined portion 54*e*, the bottommost utensil 88 may disengage itself from the utensil immediately above it in a stack of utensils. In this manner, the bottommost utensil 88 may be dispensed with only minimal displacement, both vertical and horizontal, of the one or more utensils stacked above the bottommost utensil 88. In other words, the bottommost utensil is dispensed without substantially raising any of the other utensils stacked above the bottommost utensil 88. In one embodiment, "with no raising" of any of the other utensils stacked above the bottommost utensil means that the bottommost utensil is dispensed without any vertical displacement of one or more of the utensils stacked above the bottommost utensil 88. In another embodiment, "with incidental raising" means that the bottommost utensil is dispensed with only incidental vertical displacement of one or more of the utensils stacked above the bottommost utensil 88. Incidental raising may mean that, in a stack of at least 30 utensils, there is no vertical displacement of any utensil positioned above the tenth utensil positioned above the bottommost utensil. In yet another embodiment, "without substantially raising" means an amount less than the height of the shoulder of the utensil to be dispensed.

The ability to dispense the bottommost utensil 88 without substantially raising any of the utensils stacked above the bottommost utensil 88 greatly lowers the force required to dispense a utensil and greatly reduces the tendency of the dispensing mechanism to jam. In addition, the ability to dispense the bottommost utensil 88 without substantially raising any of the utensils stacked above that utensil allows the use of far lighter weight parts for the components of the dispensing mechanism because the tendency of those components to buckle may be greatly reduced. Again, all of the utensils stacked above the bottommost utensil 88 are restrained from movement by the alignment members 56 and 58, which aids in the movement of only the bottommost utensil 88 out of the supported configuration.

Then, as shown in FIG. 11, after being pushed down the one or more inclined portions 54*e* and once a portion of the utensil 88 is pushed through the opening 59 of the alignment guard member 58, the bottommost utensil 88 then lays over the opening 54 defined in the base 52 and, consequently, falls through the opening 54. Again, after moving toward the alignment guard member 58 and down the one or more inclined portions 54*e*, the utensil 88 may move in a sideways direction to be dispensed through the opening 54.

In one embodiment, this utensil falls onto the slider member 40. This utensil then slides on the slider member 40 to the front of the housing 20 to be dispensed through the opening 42 defined in the side wall 22 of the housing 20. Again, in one embodiment, the stopping member 44 catches the dispensed fork, spoon, or spork for easy retrieval by the user. In an alternative embodiment, the bin or tray (not shown) is provided, and the dispensed utensil falls into the bin or tray. The user may then easily grab his desired utensil from the bin or tray.

After the bottommost utensil 88 is dispensed, the stack of utensils 80 realigns so that there is a new bottommost utensil. As shown in FIG. 9, this new bottommost utensil 88 is now supported on its support areas 90, 92, and 94 on the cassette base 52. In addition, after the user releases the actuating member 62, the spring 64 retracts the shaft 68 to space it from the new bottommost utensil.

As stated above, the embodiment shown in FIGS. 14–21 is an example of a cassette assembly 50' that contains knives. This embodiment generally includes the same components of that of the cassette assembly 50 for spoons, forks, and sporks. More particularly, the cassette assembly 50' for knives also includes a base 52 and at least one alignment member 56. Also, a dispensing mechanism 60 is provided. Differences between the cassette assembly 50 for spoons, forks, or sporks and the cassette assembly 50' for knives include (1) a differently sized and shaped opening 54' in the cassette base 52, (2) a differently sized and shaped alignment guard member 58', and (3) that the dispensing mechanism 60 further includes a translating mechanism 70.

The discussion set forth above with respect to the components of the cassette assembly 50, such as the number of utensils held in a stack in a cassette assembly 50, the cassette base 52, the alignment members 56, the alignment guard member 58, and the dispensing mechanism 60 (including the actuating member 62, the spring 64, the retainer(s) 66, and the shaft portion 68), also applies to the components of the cassette assembly 50', except as will now be discussed.

As shown in FIGS. 14, 15, 20, and 21, the base 52 defines an opening 54' therein. For the embodiment shown in these FIGS., the opening 54' is configured to allow a knife to fall therethrough. Again, the size of the opening 54' is generally dependent on the type, size, and weight of the cutlery to be dispensed, and is slightly longer and wider than the length and width, respectively, of the knife to be dispensed. The opening 54' may be generally rectangular in shape. In one embodiment, the size of the opening 54' ranges from about 4 inches to about 8 inches in length and about 0.75 inches to about 2.5 inches in width. (For the opening 54', when the cassette assembly 50' is placed in the housing 20, the width is in the direction between walls 24 and 26 of the housing 20 and the length is in the direction between walls 22 and 28 of the housing 20 (see FIGS. 1–3)).

In addition, similar to the embodiment shown in FIGS. 4–13, the thickness of the cassette base 52 at the edge of the opening 54' opposite the alignment guard member 58' may include at least one inclined portion (not shown) to aid in dispensing of the bottommost knife.

Figure 16:
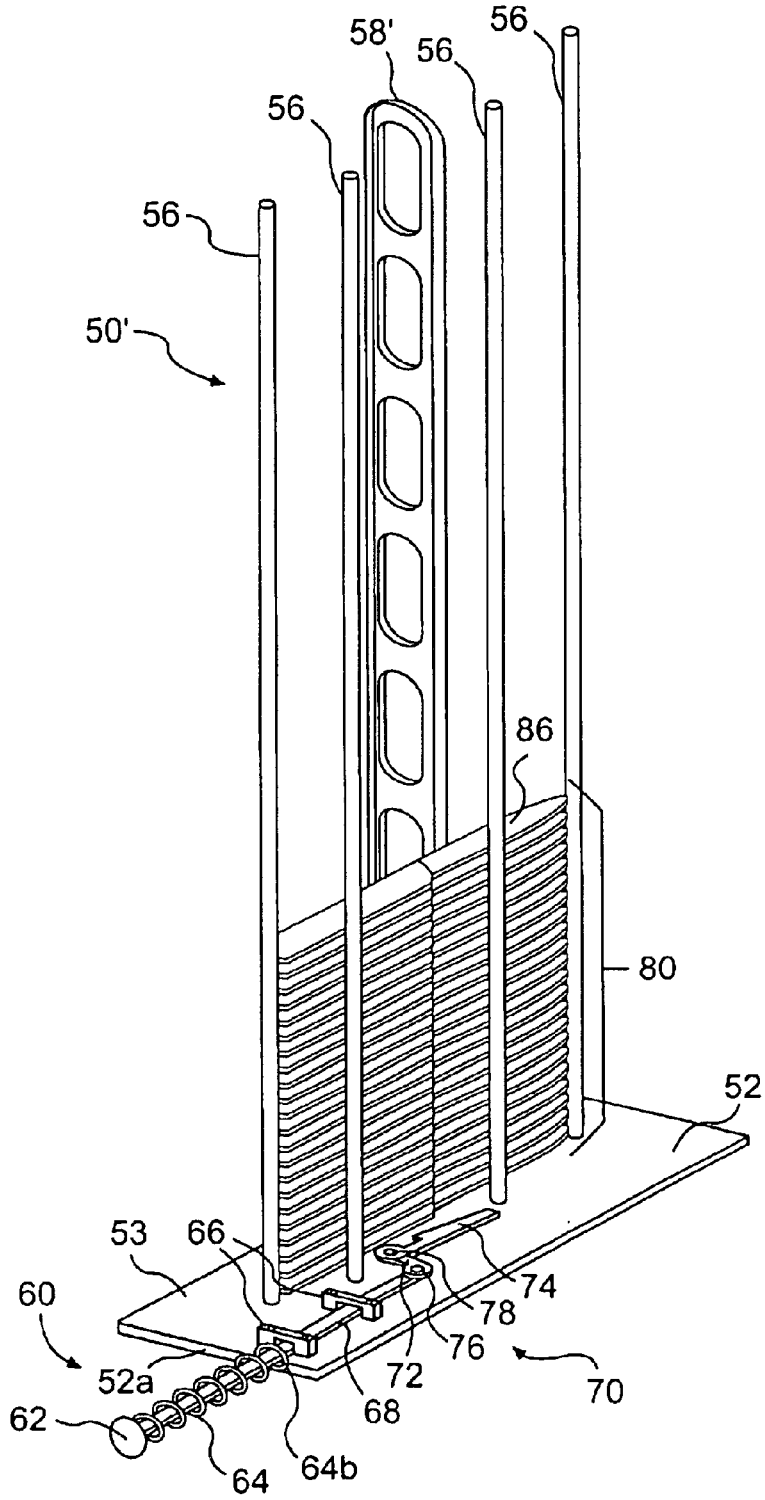
FIG. 16 is a front perspective view of the cassette assembly shown in FIG. 14 filled partway with knives.
Figure 17:
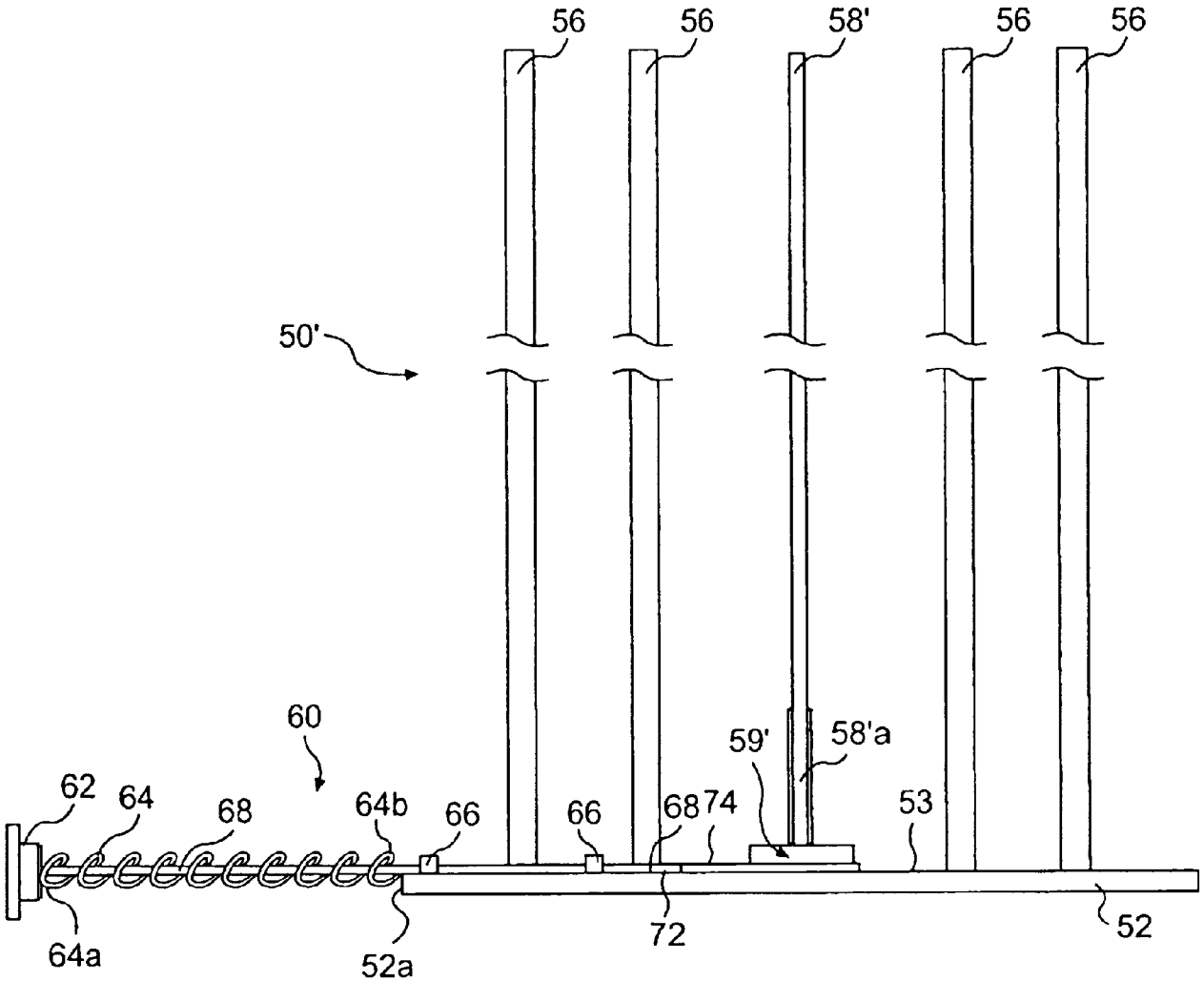
FIG. 17 is a side plan view of the cassette assembly shown in FIG. 14.
Figure 18:
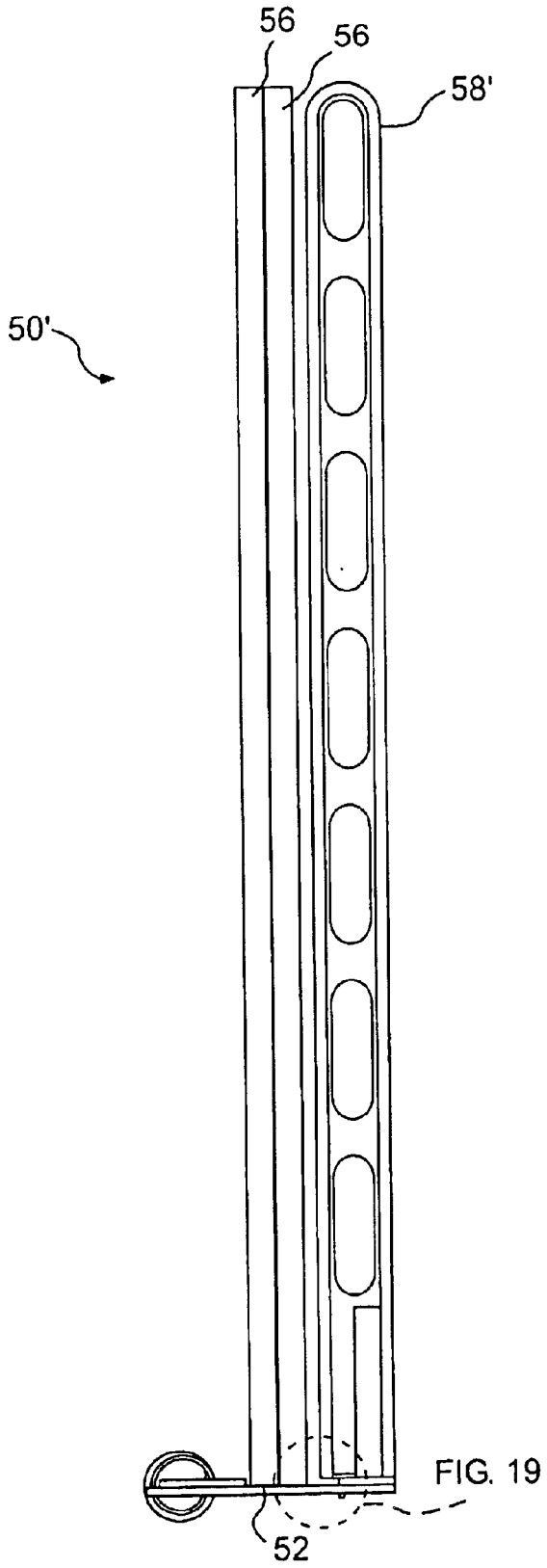
FIG. 18 is another side plan view of the cassette assembly shown in FIG. 14.
Figure 19:
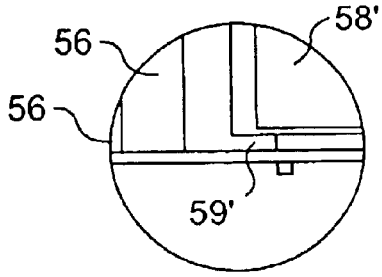
FIG. 19 is an enlarged detailed view of the circled area shown in FIG. 18.
Figure 20:
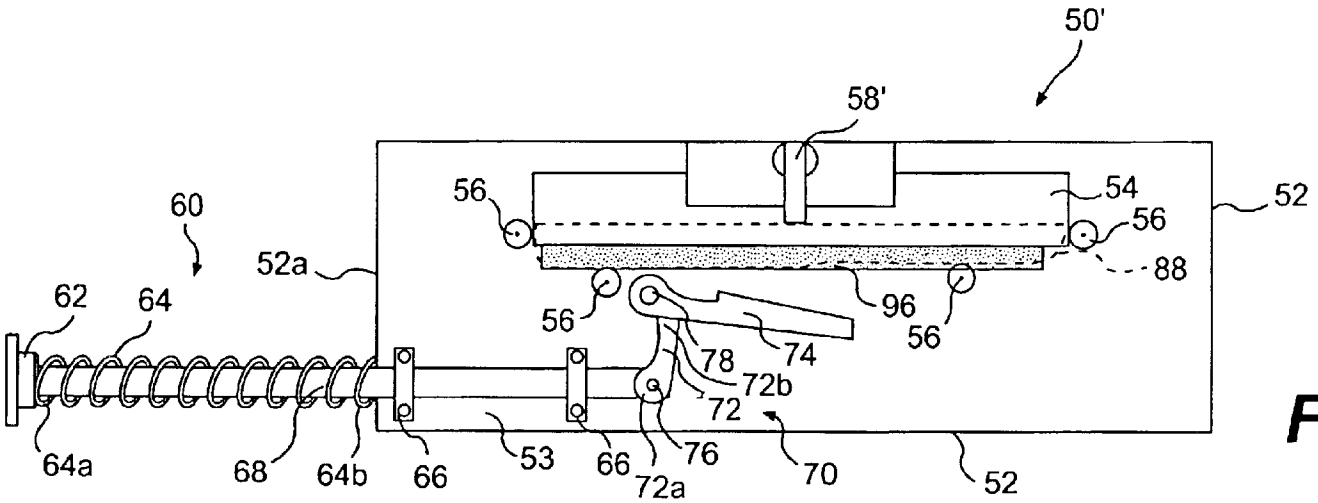
FIG. 20 is a top plan view of the cassette assembly shown in FIG. 14.

As shown in FIGS. 14–18, 20, and 21, this embodiment also includes a plurality of alignment members 56 and 58 to support a stack of knives 80. As shown, four alignment members 56, plus the alignment guard member 58', are provided. In this embodiment, the four alignment members 56 are all positioned on one side of the opening 54', with the alignment guard member 58' positioned on the opposite side of the opening 54'. In this manner, the alignment members 56 and the alignment guard member 58' support the stack of knives 80. More particularly, the alignment guard member 58' limits horizontal movement of all but the bottommost knife because one longitudinal edge of the knives contacts the alignment guard member 58', as shown in FIGS. 16 and 20. It should be appreciated that the handles of the knives may be pointed toward either of the side walls 24 or 26 of the housing 20.

The alignment guard member 58' is also provided to prevent all but the bottommost knife in the stack 80 (see FIG. 16) from being moved to fall through the opening 54' in the base 52 and, thus, to limit the dispensing of more than one knife at a time. As shown most clearly in FIGS. 18 and 19, a portion of the bottom end 58*a'* of the alignment guard member 58' defines an opening 59'. The height of the opening 59' only allows one knife 86 to pass therethrough at a time. Generally, the height of the opening 59' is about 101% to about 199% of the overall height of the knife to be dispensed. For the dispensing of a typical disposable knife, the height of the opening 59' ranges from about 0.062 inches to about 0.250 inches in height. In one embodiment, the height of the opening 59' is about 0.125 inches.

As stated above, for the cassette assembly 50' that contains knives, the dispensing mechanism 60 may also include the translating mechanism 70. The translating mechanism 70 is provided to translate a motion of the shaft 68 in a first direction to a second direction perpendicular to the first direction. More particularly, the translating mechanism 70 translates the motion caused by pushing or pulling the actuating member 62 from motion in the direction from the front to the back of the housing 20 into a motion in the direction of one side of the housing 20 to an opposite side so that the translating mechanism 70 pushes on a middle portion of the bottommost knife in the stack of utensils 80.

It should be appreciated that a dispensing mechanism 60 for knives may move a handle end of a knife, such as the dispensing mechanism 60 shown in the embodiment of FIGS. 4–13 does. In addition, it should be appreciated that a dispensing mechanism 60 that includes a translating mechanism 70 may be utilized to move a middle portion of the utensils of forks, spoons, soup spoons, and sporks.

As shown in FIGS. 14–17, 20, and 21, the translating mechanism 70 includes a translating portion 72, a pushing portion 74, a connecting point 76, and a pivot point 78. One end 72*a* of the translating portion 72 is connected with the shaft 68 at the connecting point 76. The other end 72*b* of the translating portion 72 is connected with the pushing portion 74 at the pivot point 78. The translating portion 72 and the pushing portion 74 may not pivot with respect to each other, but both may pivot together with respect to the cassette base 52 and hence the knives 86. The pushing portion 74 is capable of pushing the bottommost knife from the stack of knives 80 contained in the cassette assembly 50'.

The thickness or height of the pushing portion 74 is such that it should only contact one knife at a time and, more particularly, only the bottommost knife in the stack of utensils 80. For this embodiment, the thickness of the pushing portion 74 is about 80% of the thickness of that portion of the knife that is pushed to be dispensed.

Figure 14:
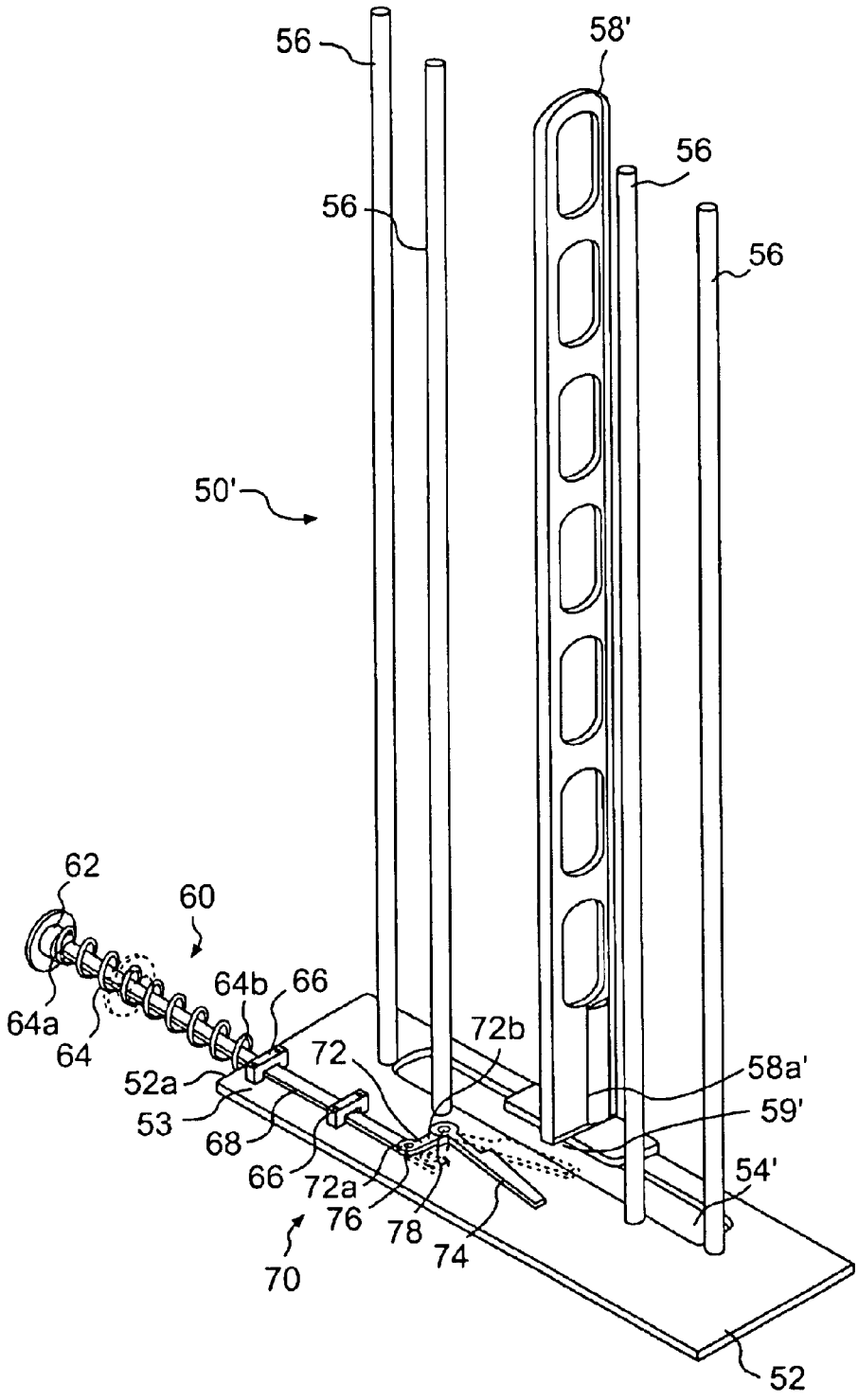
FIG. 14 is a rear perspective view of a cassette assembly of another embodiment of the present invention.
Figure 15:
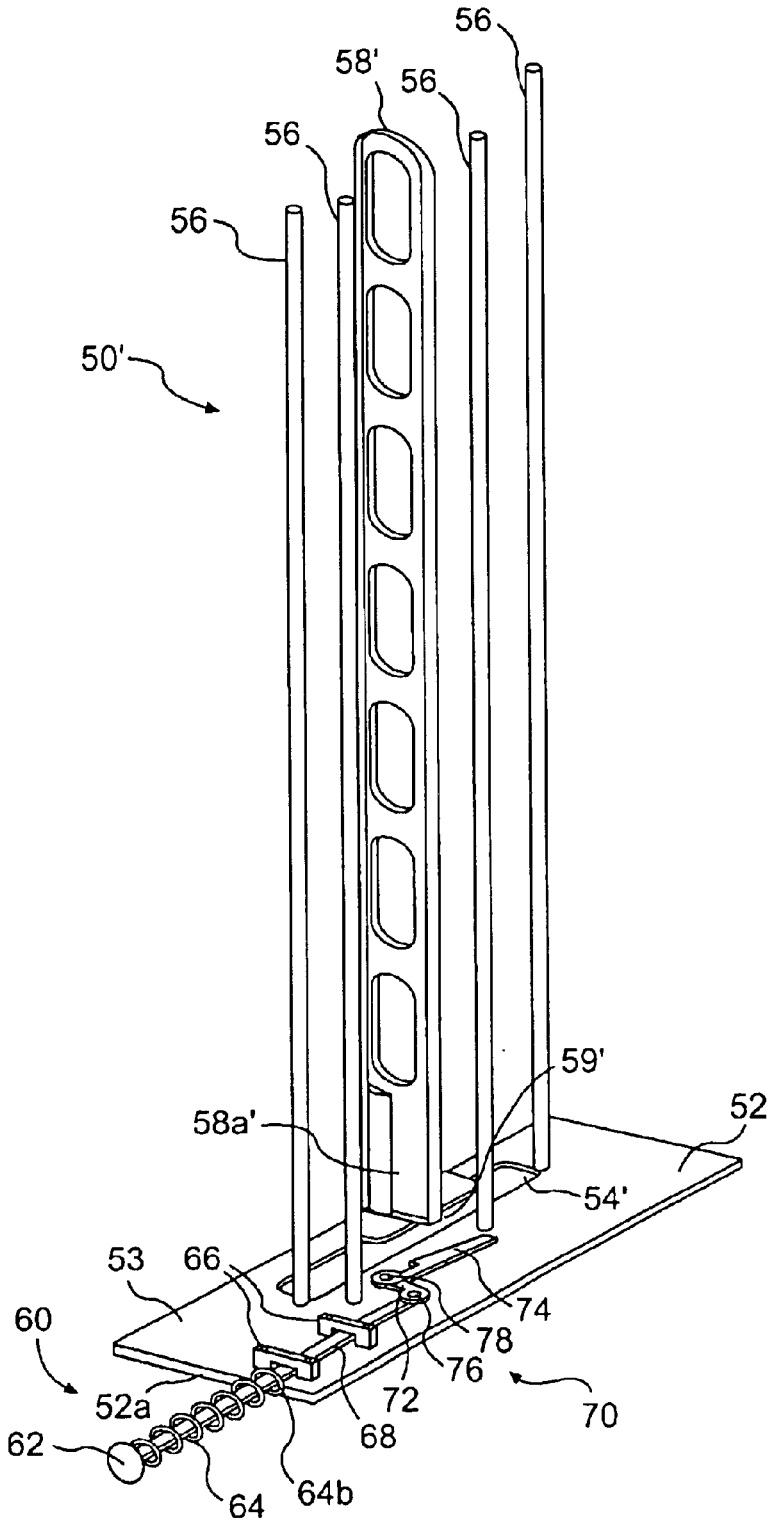
FIG. 15 is a front perspective view of the cassette assembly shown in FIG. 14 when not containing any utensils.
Figure 21:
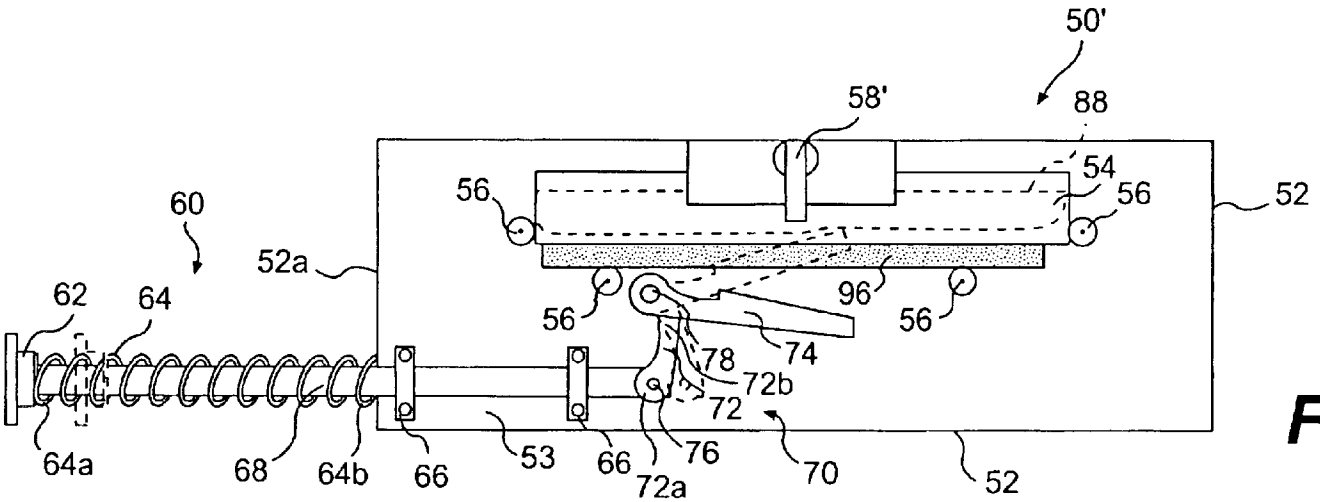
FIG. 21 is a top plan view of the cassette assembly shown in FIG. 14, showing movement of a dispensing mechanism and dispensing of a utensil.

FIG. 14 generally shows, by outline, the movement of the actuating member 62, the translating portion 72, and the pushing portion 74 of the dispensing mechanism 60. More particularly, FIGS. 20 and 21 illustrate the movement of the dispensing mechanism 60 to dispense a utensil (shown as dotted line 88) from the cassette assembly 50'. FIG. 20 illustrates how, in the normal position, while the bottommost knife 88 is positioned on the cassette base 52, this utensil partly lays over the opening 54' defined in the cassette base 52. More particularly, the bottommost knife is supported on a support area 96 (shaded in FIGS. 20 and 21) on the surface 53 of the base 52 adjacent to the opening 54' and is held in place by the weight of the knives in the stack 80 (see FIG. 16) above that bottommost knife and by contact with the alignment guard member 58'.

FIG. 21 illustrates how the pushing portion 74 (in outline) pushes against the bottommost utensil 88 to move it through the opening 59' in the alignment guard member 58' to then lay over the opening 54' in the cassette base 52. More particularly, for dispensing a knife, the user presses the actuating member 62 that is outside the housing 20 (see FIGS. 1–3). Pushing on the actuating member 62 pushes against the outward biasing force of the spring 64 to move the shaft 68. Because the shaft 68 and the translating portion 72 are connected together at the connecting point 76, the translating portion 72 is moved in the same direction as the shaft 68 (i.e., towards the wall 28 of the housing 20 (see FIGS. 1 and 3)). While the first end 72*a* of the translating portion 72 is moved towards the wall 28, the second end 72*b* of the translating portion 72 does not move in any horizontal direction, but instead pivots, because it is connected at the pivot point 78 (with the pushing portion 74) to the cassette base 52. The pivoting or rotating motion of the second end 72*b* of the translating portion 72 causes the pushing portion 74 also to pivot or rotate. This rotation of the pushing portion 74 causes the pushing portion 74 to engage the stack of knives 80 and, more particularly, the bottommost knife. The pushing portion 74 then moves the bottommost knife from the stack of knives 80 in the horizontal direction toward the alignment guard member 58' such that it moves through the opening 59' defined in the alignment guard member 58' (or under the alignment guard member 58'). After being moved through the opening 59', the bottommost knife lays over the dispensing opening 54' in the base 52 (see FIG. 21) and, consequently, falls through the dispensing opening 54'.

In one embodiment, this utensil falls onto the slider member 40. This utensil then slides on the slider member 40 to the front of the housing 20 to be dispensed through the opening 42 defined in the side wall 22 of the housing 20.

Again, in one embodiment, the stopping member 44 catches the dispensed knife for easy retrieval by the user. In an alternative embodiment, the bin or tray (not shown) is provided, and the dispensed knife falls into the bin or tray. The user may then easily grab his desired knife from the bin or tray.

After the bottommost knife is dispensed, the stack of utensils 80 realigns so that there is a new bottommost knife. As shown in FIG. 20, this new bottommost utensil 88 is now supported on the support area 96 on the cassette base 52. In addition, after the user releases the actuating member 62, the spring 64 retracts the shaft 68 to space it from the new bottommost knife.

For all types of utensils, after a user has dispensed a utensil from a cassette assembly 50 or 50' from the housing 20, that user or another user may then dispense another utensil in the same manner as described above. This may be repeated until no utensils are left in the cassette assembly 50 or 50'. Again, as shown in FIGS. 1 and 2, the wall 22 may be transparent to easily determine when a cassette assembly 50 or 50' is empty of utensils, or nearly so. At that time, additional utensils may be provided into one or more of the cassette assemblies 50 or 50' without removing that cassette assembly 50 or 50'. In addition, a cassette assembly 50 or 50' may be removed from the housing 20 and a new cassette assembly 50 or 50' that contains one or more utensils may replace it in the housing 20.

More particularly, in one instance, after the housing 20 is opened and without removing any cassette assembly 50 or 50', an operator stacks (i.e., replenishes) one or more utensils on a cassette base 52 (if all of the utensils have been dispensed from that cassette assembly 50 or 50') or on the uppermost utensil of a stack of utensils provided on that cassette base 52 of that cassette assembly 50 or 50'. It should be appreciated that the operator could replenish one or more of the cassette assemblies 50 or 50' at the same time.

In addition, after the housing 20 is opened, the operator may remove one or more cassette assemblies 50 or 50'. The operator then replaces the removed cassette assemblies 50 or 50' with a new cassette assembly 50 or 50'. The replacement cassette assembly 50 or 50' may contain any number of utensils, including a small number or no utensils (and, thus, the operator would most likely replenish that cassette assembly 50 or 50'). The operator may replace one or more of the cassette assemblies 50 or 50' at the same time. It should also be appreciated that the operator could replace a cassette assembly 50 or 50' containing one type of utensil (or that had contained one type of utensil) with a cassette assembly 50 or 50' for a different type of utensil. The operator may also replace some cassette assemblies 50 or 50', while replenishing other cassette assemblies 50 or 50' at the same time.

In an alternative embodiment (not shown), one or more cassette assemblies 50 or 50' may provide at least a portion of the bottom wall 32 of the housing 20. More particularly, one or more bases 52 of one or more cassette assemblies 50 or 50' may be integrally formed with the housing 20 so as to form at least a portion of the bottom wall 32 of the housing 20. In the alternative, the bases 52 of one or more cassette assemblies 50 or 50' may form a portion of the bottom wall 32 of the housing 20, but the cassette assemblies 50 or 50' may be removable with respect to the housing 20. Being able to remove the cassette assemblies 50 or 50' facilitates their cleaning. In one embodiment, one or more alignment members 56 and/or the alignment guard member 58 for one or more of the cassette assemblies 50 or 50' are also integrally formed with the housing 20 to extend generally perpendicularly from the cassette bases 52 that form the bottom wall 32. Also, one or more of the dispensing mechanisms 60 may also be integrally formed with the housing 20.

For this embodiment, with one or more bases 52 of cassette assemblies 50 or 50' forming at least a portion of the bottom wall 32 of the housing 20, the bottom wall 32 defines one or more dispensing openings 54 to allow utensils to be dispensed therethrough. It should be appreciated that because the utensils are dispensed through the bottom wall 32, the bottom wall 32 of the housing 20 would be spaced from any surface, such as a table or counter, which the housing 20 is placed upon. In an alternative embodiment, the housing 20 is wall mounted.

After a utensil is dispensed through an opening 54 in the bottom wall 32, in one embodiment, the utensil drops into a bin or tray positioned beneath the housing 20 and which is positioned on the table or counter, or wall mounted. In an alternative embodiment, a slider member 40 may be provided underneath the housing 20 to allow the dispensed utensil to slide down the slider member 40. Again, the slider member 40 may be positioned on a table or counter, or be wall mounted. In addition, a stopper member 44 may be provided with the slider member 40 so as to catch the utensil from sliding off the slider member 40 onto the table or counter, or floor.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A utensil dispenser adapted for the dispensing of at least one utensil, comprising:

a housing having at least a bottom wall comprising a base, wherein the base defines at least one dispensing opening therein, wherein a plurality of inclined portions are formed in at least a portion of a thickness of the base defining the dispensing opening, and wherein the inclined portions are inclined downward from a top surface of the base;

wherein at least one utensil is positioned on or adjacent to the top surface of the base; and a dispensing mechanism capable of moving the at least one utensil;

wherein the at least one utensil is dispensed by the dispensing mechanism moving the at least one utensil downward along the inclined portions to fall through the dispensing opening.

2. The utensil dispenser of claim 1, further comprising a plurality of alignment members that extend generally perpendicularly from the base, wherein at least one of the alignment members is an alignment guard member that defines an opening at a bottom end of the alignment guard member;

wherein the at least one utensil is capable of being aligned by the plurality of alignment members; and wherein the at least one utensil is dispensed by the dispensing mechanism moving the at least one utensil toward the alignment guard member and downward along the inclined portions to move through the alignment guard member opening to fall through the dispensing opening.

3. The utensil dispenser of claim 2, wherein the alignment guard member opening is configured to allow only one utensil to pass therethrough at a time.

4. The utensil dispenser of claim 1, wherein each inclined portion extends downward from the top surface of the base along a portion of an entire length of connecting edges of the dispensing opening, and wherein the connecting edges connect a narrower portion of the dispensing opening and a wider portion of the dispensing opening.

5. The utensil dispenser of claim 1, wherein each inclined portion extends downward from the top surface of the base along an entire length of connecting edges of the dispensing opening, and wherein the connecting edges connect a narrower portion of the dispensing opening and a wider portion of the dispensing opening.

6. The utensil dispenser of claim 1, wherein each inclined portion is provided as about 20% to about 25% of the thickness of the base.

7. The utensil dispenser of claim 1, wherein each inclined portion is provided along the entire thickness of the base.

8. The utensil dispenser of claim 1, wherein each inclined portion is inclined downward at an angle of about 1 degree to about 89 degrees relative to the top surface of the base.

9. The utensil dispenser of claim 8, wherein each inclined portion is inclined downward at an angle of about 45 degrees relative to the top surface of the base.

10. The utensil dispenser of claim 1, wherein edges defining the dispensing opening on the top surface of the base from which the inclined portions incline are curved and are connecting edges that connect a narrower portion of the dispensing opening and a wider portion of the dispensing opening.

11. The utensil dispenser of claim 1, wherein the housing comprises at least one side wall;

wherein the dispensing mechanism includes an actuating member and a shaft portion, wherein the actuating member is provided outside of the at least one side wall of the housing, and wherein the shaft portion is connected with the actuating member and extends through an opening defined in the at least one side wall of the housing into an interior compartment of the housing; and wherein the at least one utensil is dispensed by a user moving the actuating member which moves the shaft portion which moves the at least one utensil downward along the inclined portions to fall through the dispensing opening.

12. The utensil dispenser of claim 11, wherein the shaft portion is configured to move only one utensil at a time.

13. The utensil dispenser of claim 1, wherein a size and a shape of the dispensing opening is dependent on the type of utensil to be dispensed.

14. The utensil dispenser of claim 1, wherein a plurality of utensils are provided in a stack, and wherein a bottommost utensil in the stack is dispensed by the dispensing mechanism moving the bottommost utensil downward along the inclined portions to fall through the dispensing opening.

15. The utensil dispenser of claim 14, wherein the bottommost utensil is dispensed with no raising of any of the utensils positioned above the bottommost utensil in the stack.

16. The utensil dispenser of claim 14, wherein the bottommost utensil is dispensed with only incidental raising of any of the utensils positioned above the bottommost utensil in the stack.

17. The utensil dispenser of claim 14, wherein the bottommost utensil is dispensed without substantially raising any of the utensils positioned above the bottommost utensil.

18. The utensil dispenser of claim 14, wherein after the bottommost utensil falls through the dispensing opening, the stack of utensils realigns so that a utensil that had been adjacently above the dispensed bottommost utensil becomes a new bottommost utensil that is capable of being dispensed.

19. The utensil dispenser of claim 1, wherein the housing is mounted on a wall.

20. The utensil dispenser of claim 1, wherein a bin or tray is positioned under the housing so that a utensil dispensed from the housing falls into the bin or tray.

21. The utensil dispenser of claim 20, wherein the bin or tray is mounted on a wall.

22. The utensil dispenser of claim 1, wherein a slider member is provided under the housing so that a utensil is capable of sliding down the slider member after falling through the dispensing opening.

23. The utensil dispenser of claim 22, wherein the sliding member includes a stopping member, and wherein the utensil is stopped from sliding down the slider member by the stopping member.

24. The utensil dispenser of claim 1, wherein the housing comprises at least one side wall, and wherein at least a portion of the at least one side wall of the housing is transparent.

25. The utensil dispenser of claim 24, wherein the at least one side wall of the housing is transparent.

26. A utensil dispenser adapted for the dispensing of at least one utensil, comprising:

a housing having at least one wall, wherein the at least one wall defines an opening therein, and wherein the housing defines an interior compartment;

at least one cassette assembly provided in the interior compartment of the housing, wherein the at least one cassette assembly includes a base, wherein the base defines a dispensing opening therein, wherein a plurality of inclined portions are formed in at least a portion of a thickness of the base defining the dispensing opening, and wherein the inclined portions are inclined downward from a top surface of the base;

wherein at least one utensil is positioned on or adjacent to the top surface of the base; and a dispensing mechanism capable of moving the at least one utensil;

wherein the at least one utensil is dispensed by the dispensing mechanism moving the at least one utensil downward along the inclined portions to fall through the dispensing opening so that the at least one utensil is capable of being dispensed through the opening defined in the at least one wall of the housing.

27. The utensil dispenser of claim 26, wherein the at least one cassette assembly further includes a plurality of alignment members that extend generally perpendicularly from the base, wherein at least one of the alignment members is an alignment guard member that defines an opening at a bottom end of the alignment guard member;

wherein the at least one utensil is capable of being aligned by the plurality of alignment members; and wherein the at least one utensil is dispensed by the dispensing mechanism moving the at least one utensil toward the alignment guard member and downward along the inclined portions to move through the alignment guard member opening to fall through the dispensing opening so that the at least one utensil is capable of being dispensed through the opening defined in the at least one wall of the housing.

28. The utensil dispenser of claim 27, wherein the alignment guard member opening is configured to allow only one utensil to pass therethrough at a time.

29. The utensil dispenser of claim 26, wherein each inclined portion extends downward from the top surface of the cassette base along a portion of an entire length of connecting edges of the dispensing opening, and wherein the connecting edges connect a narrower portion of the dispensing opening and a wider portion of the dispensing opening.

30. The utensil dispenser of claim 26, wherein each inclined portion extends downward from the top surface of the cassette base along an entire length of connecting edges of the dispensing opening, and wherein the connecting edges connect a narrower portion of the dispensing opening and a wider portion of the dispensing opening.

31. The utensil dispenser of claim 26, wherein each inclined portion is provided as about 20% to about 25% of the thickness of the cassette base.

32. The utensil dispenser of claim 26, wherein each inclined portion is provided along the entire thickness of the cassette base.

33. The utensil dispenser of claim 26, wherein each inclined portion is inclined downward at an angle of about 1 degree to about 89 degrees relative to the top surface of the cassette base.

34. The utensil dispenser of claim 33, wherein each inclined portion is inclined downward at an angle of about 45 degrees relative to the top surface of the cassette base.

35. The utensil dispenser of claim 26, wherein edges defining the dispensing opening on the top surface of the base from which the inclined portions incline are curved and are connecting edges that connect a narrower portion of the dispensing opening and a wider portion of the dispensing opening.

36. The utensil dispenser of claim 26, wherein the dispensing mechanism includes an actuating member and a shaft portion, wherein the actuating member is provided outside of the at least one wall of the housing, and wherein the shaft portion is connected with the actuating member and extends through an opening defined in the at least one wall of the housing into the interior compartment of the housing.

37. The utensil dispenser of claim 36, wherein the at least one utensil is dispensed by a user moving the actuating member which moves the shaft portion which moves the at least one utensil downward along the inclined portions to fall through the dispensing opening so that the at least one utensil is capable of being dispensed through the opening defined in the at least one wall of the housing.

38. The utensil dispenser of claim 36, wherein the dispensing mechanism further includes a spring positioned around the shaft portion, wherein a first end of the spring contacts the actuating member and a second end of the spring contacts an outer edge of the base;

wherein, before dispensing, the actuating member is biased away from the at least one wall of the housing so that the shaft portion is biased away from the at least one utensil; and wherein the user pushes the actuating member against the biasing force of the spring to dispense the at least one utensil.

39. The utensil dispenser of claim 36, wherein the shaft portion is configured to push only one utensil at a time.

40. The utensil dispenser of claim 26, wherein a size and a shape of the dispensing opening is dependent on the type of utensil to be dispensed.

41. The utensil dispenser of claim 26, wherein a plurality of utensils are provided in a stack, and wherein a bottommost utensil in the stack is dispensed by the dispensing mechanism moving the bottommost utensil downward along the inclined portions to fall through the dispensing opening so that the utensil is capable of being dispensed through the opening defined in the at least one wall of the housing.

42. The utensil dispenser of claim 41, wherein the bottommost utensil is dispensed with no raising of any of the utensils positioned above the bottommost utensil in the stack.

43. The utensil dispenser of claim 41, wherein the bottommost utensil is dispensed with only incidental raising of any of the utensils positioned above the bottommost utensil in the stack.

44. The utensil dispenser of claim 41, wherein the bottommost utensil is dispensed without substantially raising any of the utensils positioned above the bottommost utensil.

45. The utensil dispenser of claim 41, wherein after the bottommost utensil falls through the dispensing opening, the stack of utensils realigns so that a utensil that had been adjacently above the dispensed bottommost utensil becomes a new bottommost utensil that is capable of being dispensed.

46. The utensil dispenser of claim 26, further comprising a slider member provided in the interior compartment of the housing, wherein the slider member is disposed under the at least one cassette assembly, and wherein the slider member is inclined downward toward the opening defined in the at least one wall of the housing; and wherein, after the at least one utensil falls through the dispensing opening, the utensil is capable of sliding down the slider member to the opening defined in the at least one wall of the housing.

47. The utensil dispenser of claim 26, further comprising a holding member provided in the interior compartment of the housing to support the at least one cassette assembly in the housing, and wherein the holding member is spaced from a bottom of the housing.

48. The utensil dispenser of claim 47, further comprising a slider member provided in the interior compartment of the housing, wherein the slider member is disposed under the at least one cassette assembly, and wherein the slider member is inclined downward toward the opening defined in the at least one wall of the housing; and wherein, after the at least one utensil falls through the dispensing opening, the utensil is capable of sliding down the slider member to the opening defined in the at least one wall of the housing.

49. The utensil dispenser of claim 48, wherein a stopping member is provided that extends outward and upward from a bottom of the at least one wall of the housing; and wherein when the utensil slides down the slider member to the opening defined in the at least one wall of the housing, the utensil is stopped from sliding by the stopping member.

50. The utensil dispenser of claim 26, wherein at least a portion of the at least one wall of the housing is transparent.

51. The utensil dispenser of claim 50, wherein the at least one wall of the housing is transparent.

52. The utensil dispenser of claim 26, wherein the at least one cassette assembly is capable of being replenished by providing at least one new utensil in the at least one cassette assembly.

53. The utensil dispenser of claim 26, wherein the at least one cassette assembly is capable of being removed from the housing and replaced with another cassette assembly.

54. A utensil dispenser adapted for the dispensing of at least one utensil, comprising:

a housing having at least one wall, wherein the at least one wall defines an opening therein, and wherein the housing defines an interior compartment;

a plurality of cassette assemblies provided in the interior compartment of the housing, wherein each cassette assembly includes a base, and wherein each base defines a dispensing opening therein;

wherein, for at least one of the plurality of cassette assemblies, a plurality of inclined portions are formed in at least a portion of a thickness of the base defining the dispensing opening, and wherein the inclined portions are inclined downward from a top surface of the base;

wherein, for the at least one cassette assembly, at least one utensil is capable of being positioned on or adjacent to the top surface of the base;

at least one dispensing mechanism, wherein the at least one dispensing mechanism is associated with the at least one cassette assembly; and wherein, for the at least one cassette assembly, the at least one utensil is capable of being dispensed by the dispensing mechanism moving the at least one utensil downward along the inclined portions to fall through the dispensing opening so that the at least one utensil is capable of being dispensed through the opening defined in the at least one wall of the housing.

55. The utensil dispenser of claim 54, wherein the at least one cassette assembly further includes a plurality of alignment members that extend generally perpendicularly from the base, and wherein at least one of the alignment members is an alignment guard member that defines an opening at a bottom end of the alignment guard member;

wherein the at least one utensil is capable of being aligned by the plurality of alignment members; and wherein the at least one utensil is capable of being dispensed by the dispensing mechanism moving the at least one utensil toward the alignment guard member and downward along the inclined portions to move through the alignment guard member opening to fall through the dispensing opening so that the at least one utensil is capable of being dispensed through the opening defined in the at least one wall of the housing.

56. The utensil dispenser of claim 55, wherein the alignment guard member opening is configured to allow only one utensil to pass therethrough at a time.

57. The utensil dispenser of claim 54, wherein, for the at least one cassette assembly, each inclined portion extends downward from the top surface of the cassette base along a portion of an entire length of connecting edges of the dispensing opening, and wherein the connecting edges connect a narrower portion of the dispensing opening and a wider portion of the dispensing opening.

58. The utensil dispenser of claim 54, wherein, for the at least one cassette assembly, each inclined portion extends downward from the top surface of the cassette base along an entire length of connecting edges of the dispensing opening, and wherein the connecting edges connect a narrower portion of the dispensing opening and a wider portion of the dispensing opening.

59. The utensil dispenser of claim 54, wherein, for the at least one cassette assembly, each inclined portion is provided as about 20% to about 25% of the thickness of the cassette base.

60. The utensil dispenser of claim 54, wherein, for the at least one cassette assembly, each inclined portion is provided along the entire thickness of the cassette base.

61. The utensil dispenser of claim 54, wherein, for the at least one cassette assembly, each inclined portion is inclined downward at an angle of about 1 degree to about 89 degrees relative to the top surface of the cassette base.

62. The utensil dispenser of claim 61, wherein each inclined portion is inclined downward at an angle of about 45 degrees relative to the top surface of the cassette base.

63. The utensil dispenser of claim 54, wherein, for the at least one cassette assembly, edges defining the dispensing opening on the top surface of the base from which the inclined portions incline are curved and are connecting edges that connect a narrower portion of the dispensing opening and a wider portion of the dispensing opening.

64. The utensil dispenser of claim 54, wherein, for the at least one cassette assembly, the at least one dispensing mechanism includes an actuating member and a shaft portion, wherein the actuating member is provided outside of the at least one wall of the housing, and wherein the shaft portion is connected with the actuating member and extends through an opening defined in the at least one wall of the housing into the interior compartment of the housing.

65. The utensil dispenser of claim 64, wherein, for the at least one cassette assembly, its at least one utensil is dispensed by a user moving the actuating member which moves the shaft portion which moves the at least one utensil downward along the inclined portions to fall through the dispensing opening so that the at least one utensil is capable of being dispensed through the opening defined in the at least one wall of the housing.

66. The utensil dispenser of claim 64, wherein, for the at least one cassette assembly, the at least one dispensing mechanism further includes a spring positioned around the shaft portion, wherein a first end of the spring contacts the actuating member and a second end of the spring contacts an outer edge of the base;

wherein, before dispensing, the actuating member is biased away from the at least one wall of the housing so that the shaft portion is biased away from the at least one utensil; and wherein the user pushes the actuating member against the biasing force of the spring to dispense the at least one utensil from the at least one cassette assembly.

67. The utensil dispenser of claim 64, wherein, for the at least one cassette assembly, the shaft portion is configured to move only one utensil at a time.

68. The utensil dispenser of claim 54, wherein, for the at least one cassette assembly, a size and a shape of the dispensing opening is dependent on the type of utensil to be dispensed.

69. The utensil dispenser of claim 54, wherein, for the at least one cassette assembly, a plurality of utensils are provided in a stack, and wherein a bottommost utensil in the stack is dispensed by the dispensing mechanism moving the bottommost utensil downward along the inclined portions to fall through the dispensing opening so that that utensil is capable of being dispensed through the opening defined in the at least one wall of the housing.

70. The utensil dispenser of claim 69, wherein the bottommost utensil is dispensed with no raising of any of the utensils positioned above the bottommost utensil in the stack.

71. The utensil dispenser of claim 69, wherein the bottommost utensil is dispensed with only incidental raising of any of the utensils positioned above the bottommost utensil in the stack.

72. The utensil dispenser of claim 69, wherein the bottommost utensil is dispensed without substantially raising any of the utensils positioned above the bottommost utensil.

73. The utensil dispenser of claim 69, wherein after the bottommost utensil falls through the dispensing opening, the stack of utensils realigns so that a utensil that had been adjacently above the dispensed bottommost utensil becomes a new bottommost utensil that is capable of being dispensed.

74. The utensil dispenser of claim 54, wherein a plurality of utensils is provided in a stack in each cassette assembly;

wherein, for each cassette assembly, a plurality of inclined portions are formed in at least a portion of a thickness of the base defining the dispensing opening, and wherein the inclined portions are inclined downward from a top surface of the base;

a plurality of dispensing mechanisms, each dispensing mechanism being associated with one of the plurality of cassette assemblies;

wherein, for each cassette assembly, a bottommost utensil in its stack is dispensed by the dispensing mechanism for that cassette assembly moving the bottommost utensil downward along the inclined portions of that cassette assembly to fall through the dispensing opening of that cassette assembly so that that utensil is capable of being dispensed through the opening defined in the at least one wall of the housing.

75. The utensil dispenser of claim 74, wherein each cassette assembly further includes a plurality of alignment members that extend generally perpendicularly from the base, and wherein at least one of the alignment members is an alignment guard member that defines an opening at a bottom end of the alignment guard member;

wherein each of the utensils in each stack is capable of being aligned by the plurality of alignment members of its respective cassette assembly; and wherein, for each cassette assembly, a bottommost utensil in its stack is dispensed by the dispensing mechanism for that cassette assembly moving the bottommost utensil toward the alignment guard member of that cassette assembly and downward along the inclined portions of that cassette assembly to move through the alignment guard member opening of that cassette assembly to fall through the dispensing opening of that cassette assembly so that that utensil is capable of being dispensed through the opening defined in the at least one wall of the housing.

76. The utensil dispenser of claim 75, wherein, for each cassette assembly, the bottommost utensil is dispensed with no raising of any of the utensils positioned above the bottommost utensil in the stack.

77. The utensil dispenser of claim 75, wherein, for each cassette assembly, the bottommost utensil is dispensed with only incidental raising of any of the utensils positioned above the bottommost utensil in the stack.

78. The utensil dispenser of claim 75, wherein, for each cassette assembly, the bottommost utensil is dispensed without substantially raising any of the utensils positioned above the bottommost utensil.

79. The utensil dispenser of claim 75, wherein, for each cassette assembly, after the bottommost utensil falls through the dispensing opening, the stack of utensils realigns so that a utensil that had been adjacently above the dispensed bottommost utensil becomes a new bottommost utensil that is capable of being dispensed.

80. The utensil dispenser of claim 54, further comprising a slider member provided in the interior compartment of the housing, wherein the slider member is disposed under the plurality of cassette assemblies, and wherein the slider member is inclined downward toward the opening defined in the at least one wall of the housing; and wherein, for each cassette assembly, after the at least one utensil falls through the dispensing opening, the utensil is capable of sliding down the slider member to the opening defined in the at least one wall of the housing.

81. The utensil dispenser of claim 75, further comprising a slider member provided in the interior compartment of the housing, wherein the slider member is disposed under the plurality of cassette assemblies, and wherein the slider member is inclined downward toward the opening defined in the at least one wall of the housing; and wherein, for each cassette assembly, after the at least one utensil falls through the dispensing opening, the utensil is capable of sliding down the slider member to the opening defined in the at least one wall of the housing.

82. The utensil dispenser of claim 54, further comprising a holding member provided in the interior compartment of the housing to support the plurality of cassette assemblies provided in the housing, and wherein the holding member is spaced from a bottom of the housing.

83. The utensil dispenser of claim 82, further comprising a slider member provided in the interior compartment of the housing, wherein the slider member is disposed under the plurality of cassette assemblies, and wherein the slider member is inclined downward toward the opening defined in the at least one wall of the housing; and wherein, for each cassette assembly, after the at least one utensil falls through the dispensing opening, the utensil is capable of sliding down the slider member to the opening defined in the at least one wall of the housing.

84. The utensil dispenser of claim 83, wherein a stopping member is provided that extends outward and upward from a bottom of the at least one wall of the housing; and wherein when the utensil slides down the slider member to the opening defined in the at least one wall of the housing, the utensil is stopped from sliding by the stopping member.

85. The utensil dispenser of claim 54, wherein at least a portion of the at least one wall of the housing is transparent.

86. The utensil dispenser of claim 85, wherein the at least one wall of the housing is transparent.

87. The utensil dispenser of claim 54, wherein at least one of the plurality of cassette assemblies is capable of being replenished by providing at least one new utensil in the at least one cassette assembly.

88. The utensil dispenser of claim 54, wherein at least one of the plurality of cassette assemblies is capable of being removed from the housing and replaced with another cassette assembly.

89. A method of dispensing a utensil, comprising:

providing a base, wherein at least one utensil is positioned on or adjacent to a top surface of the base, wherein the base defines a dispensing opening, and wherein the dispensing opening includes a plurality of inclined portions formed in at least a portion of a thickness of the base that are inclined downward from the top surface of the base;

providing a dispensing mechanism capable of moving the at least one utensil; and dispensing the at least one utensil by the dispensing mechanism moving the at least one utensil downward along the inclined portions to fall through the dispensing opening.

90. The method of dispensing a utensil of claim 89, further comprising:

providing a housing, wherein the housing includes at least a bottom wall comprising the base; and providing a plurality of alignment members that extend generally perpendicularly from the base, wherein at least one of the alignment members is an alignment guard member that defines an opening at a bottom end of the alignment guard member, and wherein the at least one utensil is capable of being aligned by the alignment members;

wherein dispensing the at least one utensil includes the dispensing mechanism moving the at least one utensil toward the alignment guard member and downward along the inclined portions to move through the alignment guard member opening to fall through the dispensing opening.

91. The method of dispensing a utensil of claim 90, wherein the alignment guard member opening is configured to allow only one utensil to pass therethrough at a time.

92. The method of dispensing a utensil of claim 89, wherein each inclined portion extends downward from the top surface of the base along a portion of an entire length of connecting edges of the dispensing opening, and wherein the connecting edges connect a narrower portion of the dispensing opening and a wider portion of the dispensing opening.

93. The method of dispensing a utensil of claim 89, wherein each inclined portion extends downward from the top surface of the base along an entire length of connecting edges of the dispensing opening, and wherein the connecting edges connect a narrower portion of the dispensing opening and a wider portion of the dispensing opening.

94. The method of dispensing a utensil of claim 89, wherein each inclined portion is provided as about 20% to about 25% of the thickness of the base.

95. The method of dispensing a utensil of claim 89, wherein each inclined portion is provided along the entire thickness of the base.

96. The method of dispensing a utensil of claim 89, wherein each inclined portion is inclined downward at an angle of about 1 degree to about 89 degrees relative to the top surface of the base.

97. The method of dispensing a utensil of claim 96, wherein each inclined portion is inclined downward at an angle of about 45 degrees relative to the top surface of the base.

98. The method of dispensing a utensil of claim 89, wherein edges defining the dispensing opening on the top surface of the base from which the inclined portions incline are curved and are connecting edges that connect a narrower portion of the dispensing opening and a wider portion of the dispensing opening.

99. The method of dispensing a utensil of claim 89, further comprising providing a plurality of utensils in a stack on the base, and wherein dispensing includes dispensing a bottommost utensil in the stack.

100. The method of dispensing a utensil of claim 99, wherein the bottommost utensil is dispensed with no raising of any of the utensils positioned above the bottommost utensil in the stack.

101. The method of dispensing a utensil of claim 99, wherein the bottommost utensil is dispensed with only incidental raising of any of the utensils positioned above the bottommost utensil in the stack.

102. The method of dispensing a utensil of claim 99, wherein the bottommost utensil is dispensed without substantially raising any of the utensils positioned above the bottommost utensil.

103. The method of dispensing a utensil of claim 99, wherein after the bottommost utensil falls through the dispensing opening, the stack of utensils realigns so that a utensil that had been adjacently above the dispensed bottommost utensil becomes a new bottommost utensil that is capable of being dispensed.

104. The method of dispensing a utensil of claim 90, wherein the housing is mounted on a wall.

105. The method of dispensing a utensil of claim 90, further comprising providing a bin or tray positioned under the housing so that a utensil dispensed from the housing falls into the bin or tray.

106. The method of dispensing a utensil of claim 105, wherein the bin or tray is mounted on a wall.

107. The method of dispensing a utensil of claim 90, further comprising providing a slider member under the housing so that a utensil is capable of sliding down the slider member after falling through the dispensing opening.

108. The method of dispensing a utensil of claim 107, wherein the sliding member includes a stopping member, and wherein the utensil is stopped from sliding down the slider member by the stopping member.

109. The method of dispensing a utensil of claim 90, wherein the housing comprises at least one side wall, and wherein at least a portion of the at least one side wall of the housing is transparent.

110. The method of dispensing a utensil of claim 109, wherein the at least one side wall of the housing is transparent.

111. A method of dispensing a utensil, comprising:

providing a housing, wherein the housing defines an interior compartment;

providing at least one base in the interior compartment of the housing, wherein at least one utensil is positioned on or adjacent to a top surface of the base, wherein the base defines a dispensing opening therein, and wherein the dispensing opening includes a plurality of inclined portions formed in at least a portion of a thickness of the base that are inclined downward from the top surface of the base;

providing a dispensing mechanism capable of moving the at least one utensil; and dispensing the at least one utensil by the dispensing mechanism moving the at least one utensil downward along the inclined portions to fall through the dispensing opening.

112. The method of dispensing a utensil of claim 111, further comprising:

providing a plurality of alignment members that extend generally perpendicularly from the base, wherein at least one of the alignment members is an alignment guard member that defines an opening at a bottom end of the alignment guard member, and wherein the at least one utensil is capable of being aligned by the plurality of alignment members;

wherein dispensing the at least one utensil includes the dispensing mechanism moving the at least one utensil toward the alignment guard member and downward along the inclined portions to move through the alignment guard member opening to fall through the dispensing opening.

113. The method of dispensing a utensil of claim 112, wherein the alignment guard member opening is configured to allow only one utensil to pass therethrough at a time.

114. The method of dispensing a utensil of claim 111, wherein each inclined portion extends downward from the top surface of the base along a portion of an entire length of connecting edges of the dispensing opening, and wherein the connecting edges connect a narrower portion of the dispensing opening and a wider portion of the dispensing opening.

115. The method of dispensing a utensil of claim 111, wherein each inclined portion extends downward from the top surface of the base along an entire length of connecting edges of the dispensing opening, and wherein the connecting edges connect a narrower portion of the dispensing opening and a wider portion of the dispensing opening.

116. The method of dispensing a utensil of claim 111, wherein each inclined portion is provided as about 20% to about 25% of the thickness of the base.

117. The method of dispensing a utensil of claim 111, wherein each inclined portion is provided along the entire thickness of base.

118. The method of dispensing a utensil of claim 111, wherein each inclined portion is inclined downward at an angle of about 1 degree to about 89 degrees relative to the top surface of the base.

119. The method of dispensing a utensil of claim 118, wherein each inclined portion is inclined downward at an angle of about 45 degrees relative to the top surface of the base.

120. The method of dispensing a utensil of claim 111, wherein edges defining the dispensing opening on the top surface of the base from which the inclined portions incline are curved and are connecting edges that connect a narrower portion of the dispensing opening and a wider portion of the dispensing opening.

121. The method of dispensing a utensil of claim 111, further comprising providing a plurality of utensils in a stack on the at least one base, and wherein dispensing includes dispensing a bottommost utensil in the stack.

122. The method of dispensing a utensil of claim 121, wherein the bottommost utensil is dispensed with no raising of any of the utensils positioned above the bottommost utensil in the stack.

123. The method of dispensing a utensil of claim 121, wherein the bottommost utensil is dispensed with only incidental raising of any of the utensils positioned above the bottommost utensil in the stack.

124. The method of dispensing a utensil of claim 121, wherein the bottommost utensil is dispensed without substantially raising any of the utensils positioned above the bottommost utensil.

125. The method of dispensing a utensil of claim 121, wherein after the bottommost utensil falls through the dispensing opening, the stack of utensils realigns so that a utensil that had been adjacently above the dispensed bottommost utensil becomes a new bottommost utensil that is capable of being dispensed.

126. The method of dispensing a utensil of claim 111, wherein the housing includes at least one side wall defining an opening, further comprising:

providing a slider member in the interior compartment of the housing, wherein the slider member is disposed under the at least one base, and wherein the slider member is inclined downward toward the opening defined in the least one side wall of the housing; and wherein dispensing further includes, after the at least one utensil falls through the dispensing opening, that utensil sliding down the slider member to the opening defined in the at least one side wall of the housing.

127. The method of dispensing a utensil of claim 111, further comprising providing a holding member in the interior compartment of the housing to support the at least one base in the housing, and wherein the holding member is spaced from a bottom of the housing.

128. The method of dispensing a utensil of claim 127, wherein the housing includes at least one side wall defining an opening, further comprising:

providing a slider member in the interior compartment of the housing, wherein the slider member is disposed under the at least one base, and wherein the slider member is inclined downward toward the opening defined in the least one side wall of the housing; and wherein dispensing further includes, after the at least one utensil falls through the dispensing opening, that utensil sliding down the slider member to the opening defined in the at least one side wall of the housing.

129. The method of dispensing a utensil of claim 128, further comprising providing a stopping member that extends outward and upward from a bottom of the at least one side wall of the housing; and wherein dispensing further includes stopping the utensil from sliding on the slider member by the stopping member.

130. The method of dispensing a utensil of claim 111, wherein at least a portion of the at least one wall of the housing is transparent.

131. The method of dispensing a utensil of claim 130, wherein the at least one wall of the housing is transparent.

132. A method of dispensing a utensil, comprising:

providing a housing, wherein the housing defines an interior compartment;

providing a plurality of bases in the interior compartment of the housing, wherein at least one utensil is positioned on or adjacent to a top surface of at least one base;

wherein, for the at least one base, the base defines a dispensing opening therein, wherein a plurality of inclined portions are formed in at least a portion of a thickness of the base defining the dispensing opening, and wherein the inclined portions are inclined downward from the top surface of the base;

providing at least one dispensing mechanism, wherein the at least one dispensing mechanism is associated with the at least one base; and for the at least one base, dispensing the at least one utensil by the at least one dispensing mechanism moving the at least one utensil downward along the inclined portions to fall through the dispensing opening.

133. The method of dispensing a utensil of claim 132, wherein the housing has at least one wall defining an opening therein, further comprising:

providing a plurality of cassette assemblies in the interior compartment of the housing, wherein each cassette assembly includes at least one base and a plurality of alignment members that extend generally perpendicularly from each base, wherein, for each cassette assembly, at least one of the alignment members is an alignment guard member that defines an opening at a bottom end of the alignment guard member, and wherein, for at least one cassette assembly, at least one utensil is capable of being aligned by the plurality of alignment members; and wherein dispensing the at least one utensil includes the at least one dispensing mechanism moving the at least one utensil toward the alignment guard member and downward along the inclined portions to move through the alignment guard member opening to fall through the dispensing opening.

134. The method of dispensing a utensil of claim 133, wherein the alignment guard member opening is configured to allow only one utensil to pass therethrough at a time.

135. The method of dispensing a utensil of claim 132, wherein, for the at least one base, each inclined portion extends downward from the top surface of the base along a portion of an entire length of connecting edges of the dispensing opening, and wherein the connecting edges connect a narrower portion of the dispensing opening and a wider portion of the dispensing opening.

136. The method of dispensing a utensil of claim 132, wherein, for the at least one base, each inclined portion extends downward from the top surface of the base along an entire length of connecting edges of the dispensing opening, and wherein the connecting edges connect a narrower portion of the dispensing opening and a wider portion of the dispensing opening.

137. The method of dispensing a utensil of claim 132, wherein, for the at least one base, each inclined portion is provided as about 20% to about 25% of the thickness of the base.

138. The method of dispensing a utensil of claim 132, wherein, for the at least one base, each inclined portion is provided along the entire thickness of the base.

139. The method of dispensing a utensil of claim 132, wherein, for the at least one base, each inclined portion is inclined downward at an angle of about 1 degree to about 89 degrees relative to the top surface of the base.

140. The method of dispensing a utensil of claim 139, wherein each inclined portion is inclined downward at an angle of about 45 degrees relative to the top surface of the base.

141. The method of dispensing a utensil of claim 132, wherein, for the at least one base, edges defining the dispensing opening on the top surface of the base from which the inclined portions incline are curved and are connecting edges that connect a narrower portion of the dispensing opening and a wider portion of the dispensing opening.

142. The method of dispensing a utensil of claim 132, further comprising, for the at least one base, providing a plurality of utensils in a stack, and wherein dispensing includes dispensing a bottommost utensil in the stack.

143. The method of dispensing a utensil of claim 142, wherein the bottommost utensil is dispensed with no raising of any of the utensils positioned above the bottommost utensil in the stack.

144. The method of dispensing a utensil of claim 142, wherein the bottommost utensil is dispensed with only incidental raising of any of the utensils positioned above the bottommost utensil in the stack.

145. The method of dispensing a utensil of claim 142, wherein the bottommost utensil is dispensed without substantially raising any of the utensils positioned above the bottommost utensil.

146. The method of dispensing a utensil of claim 142, wherein after the bottommost utensil falls through the dispensing opening, the stack of utensils realigns so that a utensil that had been adjacently above the dispensed bottommost utensil becomes a new bottommost utensil that is capable of being dispensed.

147. The method of dispensing a utensil of claim 133, further comprising, for each cassette assembly, providing a plurality of utensils in a stack, wherein each of the utensils in each stack is capable of being aligned by the plurality of alignment members of its respective cassette assembly;

wherein, for each cassette assembly, a plurality of inclined portions are formed in at least a portion of a thickness of the base defining the dispensing opening, and wherein the inclined portions are inclined downward from the top surface of the base; and wherein, for each cassette assembly, dispensing includes dispensing a bottommost utensil in each stack by the dispensing mechanism moving the bottommost utensil toward the alignment guard member of that cassette assembly and downward along the inclined portions of that cassette assembly to move through the alignment guard member opening of that cassette assembly to fall through the dispensing opening of that cassette assembly.

148. The method of dispensing a utensil of claim 147, wherein, for at least one cassette assembly, the bottommost utensil is dispensed with no raising of any of the utensils positioned above the bottommost utensil in the stack.

149. The method of dispensing a utensil of claim 147, wherein, for at least one cassette assembly, the bottommost utensil is dispensed with only incidental raising of any of the utensils positioned above the bottommost utensil in the stack.

150. The method of dispensing a utensil of claim 147, wherein, for at least one cassette assembly, the bottommost utensil is dispensed without substantially raising any of the utensils positioned above the bottommost utensil.

151. The method of dispensing a utensil of claim 147, wherein, for at least one cassette assembly, after the bottommost utensil falls through the dispensing opening, the stack of utensils realigns so that a utensil that had been adjacently above the dispensed bottommost utensil becomes a new bottommost utensil that is capable of being dispensed.

152. The method of dispensing a utensil of claim 132, wherein the housing includes at least one side wall defining an opening, further comprising:

providing a slider member in the interior compartment of the housing, wherein the slider member is disposed under the plurality of bases, and wherein the slider member is inclined downward toward the opening defined in the at least one side wall of the housing; and wherein dispensing further includes, after the at least one utensil falls through the dispensing opening, the utensil sliding down the slider member to the opening defined in the at least one wall of the housing.

153. The method of dispensing a utensil of claim 132, further comprising providing a holding member in the interior compartment of the housing to support the plurality of bases provided in the housing, and wherein the holding member is spaced from a bottom of the housing.

154. The method of dispensing a utensil of claim 153, wherein the housing includes at least one side wall defining an opening, further comprising:

providing a slider member in the interior compartment of the housing, wherein the slider member is disposed under the plurality of bases, and wherein the slider member is inclined downward toward the opening defined in the at least one side wall of the housing; and wherein dispensing further includes, after the at least one utensil falls through the dispensing opening, the utensil sliding down the slider member to the opening defined in the at least one wall of the housing.

155. The method of dispensing a utensil of claim 154, further comprising providing a stopping member that extends outward and upward from a bottom of the at least one side wall of the housing; and wherein dispensing further includes stopping the utensil from sliding on the slider member by the stopping member.

156. The method of dispensing a utensil of claim 132, wherein the housing includes at least one wall, and wherein at least a portion of the at least one wall of the housing is transparent.

157. The method of dispensing a utensil of claim 156, wherein the at least one wall of the housing is transparent.

158. The method of dispensing a utensil of claim 133, further comprising replenishing at least one of the plurality of cassette assemblies by providing at least one new utensil in the at least one cassette assembly.

159. The method of dispensing a utensil of claim 133, further comprising removing at least one of the plurality of cassette assemblies from the housing and replacing it with another cassette assembly.

160. A utensil dispenser adapted for dispensing of at least one utensil, comprising:

a housing having at least a bottom wall comprising a base having at least one dispensing opening defined therethrough, and wherein a plurality of downwardly inclined support surfaces are formed in the base adjacent the dispensing opening;

a plurality of alignment members that extend generally perpendicularly from the base, wherein at least one of the alignment members is an alignment guard member that defines a lateral opening extending generally perpendicularly away from the base at an end of the alignment guard member adjacent the base, and wherein the alignment members are configured and disposed to restrain a stack of a plurality of utensils resting on the base closely adjacent to the dispensing opening in a supported configuration and restraining all but a bottommost utensil of the stack of utensils from being moved out of the supported configuration;

wherein the bottommost utensil is positioned on or adjacent to a top surface of the base and is capable of being moved through the lateral opening out of the supported configuration; and a dispensing mechanism capable of moving the bottommost utensil through the lateral opening out of the supported configuration;

wherein the bottommost utensil of the stack of utensils is dispensed by the dispensing mechanism moving the bottommost utensil toward the alignment guard member and downward along the inclined support surfaces to move through the lateral opening to fall through the dispensing opening without imparting substantial upward movement to any of the utensils stacked above the bottommost utensil.

161. The utensil dispenser of claim 160, wherein the housing comprises at least one side wall;

wherein the dispensing mechanism includes an actuating member and a shaft portion, wherein the actuating member is provided outside of the at least one side wall of the housing and wherein the shaft portion is connected with the actuating member and extends through an opening defined in the at least one side wall of the housing into an interior compartment of the housing; and wherein the at least one utensil is dispensed by a user moving the actuating member which moves the shaft portion which moves the at least one utensil toward the alignment guard member and downward along the inclined portions to move through the alignment guard member opening to fall through the dispensing opening.

162. The utensil dispenser of claim 161, wherein the shaft portion is configured to move only one utensil at a time.

163. The utensil dispenser of claim 160, wherein the lateral opening is configured to allow only one utensil to pass therethrough at a time.

164. The utensil dispenser of claim 160, wherein a size and a shape of the dispensing opening is dependent on the type of utensil to be dispensed.

165. The utensil dispenser of claim 160, wherein the bottommost utensil is dispensed with no raising of any of the utensils positioned above the bottommost utensil in the stack.

166. The utensil dispenser of claim 160, wherein the bottommost utensil is dispensed with only incidental raising of any of the utensils positioned above the bottommost utensil in the stack.

167. The utensil dispenser of claim 160, wherein the bottommost utensil is dispensed without substantially raising any of the utensils positioned above the bottommost utensil.

168. The utensil dispenser of claim 160, wherein after the bottommost utensil falls through the dispensing opening, the stack of utensils realigns so that a utensil that had been adjacently above the dispensed bottommost utensil becomes a new bottommost utensil that is capable of being dispensed.

169. The utensil dispenser of claim 160, wherein the housing is mounted on a wall.

170. The utensil dispenser of claim 160, wherein a bin or tray is positioned under the housing so that a utensil dispensed from the housing falls into the bin or tray.

171. The utensil dispenser of claim 170, wherein the bin or tray is mounted on a wall.

172. The utensil dispenser of claim 160, wherein a slider member is provided under the housing so that a utensil is capable of sliding down the slider member after falling through the dispensing opening.

173. The utensil dispenser of claim 172, wherein the sliding member includes a stopping member, and wherein the utensil is stopped from sliding down the slider member by the stopping member.

174. The utensil dispenser of claim 160, wherein the housing comprises at least one side wall, and wherein at least a portion of the at least one side wall of the housing is transparent.

175. The utensil dispenser of claim 174, wherein the at least one side wall of the housing is transparent.

176. A method of dispensing a utensil, comprising:

providing a housing having an interior compartment;

providing a base within the interior compartment of the housing, wherein the base has at least one dispensing opening defined therein, wherein a plurality of downwardly inclined support surfaces are formed in the base adjacent the dispensing opening, and wherein a bottommost utensil of a stack of utensils is positioned on or adjacent to a top surface of the base;

providing a dispensing mechanism capable of moving the bottommost utensil; and dispensing the bottommost utensil of the stack of utensils by the dispensing mechanism moving the bottommost utensil downward along the inclined support surfaces to fall through the dispensing opening without imparting substantial upward movement to any of the utensils stacked above the bottommost utensil.

177. The method of dispensing a utensil of claim 176, further comprising:

providing a plurality of alignment members that extend generally perpendicularly from the base, wherein at least one of the alignment members is an alignment guard member that defines a lateral opening extending generally perpendicularly away from the base at an end of the alignment guard member adjacent the base, and wherein the alignment members are configured and disposed to restrain a stack of a plurality of utensils resting on the base closely adjacent to the dispensing opening in a supported configuration and restraining all but a bottommost utensil of the stack of utensils from being moved out of the supported configuration; and wherein dispensing includes the dispensing mechanism moving the bottommost utensil toward the alignment guard member and downward along the inclined support surfaces to move through the lateral opening to fall through the dispensing opening without imparting substantial upward movement to any of the utensils stacked above the bottommost utensil.

178. The method of dispensing a utensil of claim 176, wherein the housing comprises at least one side wall;

wherein the dispensing mechanism includes an actuating member and a shaft portion, wherein the actuating member is provided outside of the at least one side wall of the housing, and wherein the shaft portion is connected with the actuating member and extends through an opening defined in the at least one side wall of the housing into an interior compartment of the housing; and wherein the at least one utensil is dispensed by a user moving the actuating member which moves the shaft portion which moves the at least one utensil toward the alignment guard member and downward along the inclined support surfaces to move through the lateral opening to fall through the dispensing opening.

179. The method of dispensing a utensil of claim 178, wherein the shaft portion is configured to move only one utensil at a time.

180. The method of dispensing a utensil of claim 177, wherein the lateral opening is configured to allow only one utensil to pass therethrough at a time.

181. The method of dispensing a utensil of claim 176, wherein a size and a shape of the dispensing opening is dependent on the type of utensil to be dispensed.

182. The method of dispensing a utensil of claim 176, wherein the bottommost utensil is dispensed with no raising of any of the utensils positioned above the bottommost utensil in the stack.

183. The method of dispensing a utensil of claim 176, wherein the bottommost utensil is dispensed with only incidental raising of any of the utensils positioned above the bottommost utensil in the stack.

184. The method of dispensing a utensil of claim 176, wherein the bottommost utensil is dispensed without substantially raising any of the utensils positioned above the bottommost utensil.

185. The method of dispensing a utensil of claim 176, wherein after the bottommost utensil falls through the dispensing opening, the stack of utensils realigns so that a utensil that had been adjacently above the dispensed bottommost utensil becomes a new bottommost utensil that is capable of being dispensed.

186. The method of dispensing a utensil of claim 176, wherein the housing is mounted on a wall.

187. The method of dispensing a utensil of claim 176, wherein a bin or tray is positioned under the housing so that a utensil dispensed from the housing falls into the bin or tray.

188. The method of dispensing a utensil of claim 187, wherein the bin or tray is mounted on a wall.

189. The method of dispensing a utensil of claim 176, wherein a slider member is provided under the housing so that a utensil is capable of sliding down the slider member after failing through the dispensing opening.

190. The method of dispensing a utensil of claim 189, wherein the sliding member includes a stopping member, and wherein the utensil is stopped from sliding down the slider member by the stopping member.

191. The method of dispensing a utensil of claim 176, wherein the housing comprises at least one side wall, and wherein at least a portion of the at least one side wall of the housing is transparent.

192. The method of dispensing a utensil of claim 191, wherein the at least one side wall of the housing is transparent.

193. A utensil dispenser adapted for the dispensing of at lease one utensil, comprising:

a housing having at least a bottom wall comprising a base, wherein the base defines at least one dispensing opening therein, and wherein a length of the dispensing opening is greater than a length of a utensil to be dispensed from the utensil dispenser;

wherein at least one utensil is positioned on or adjacent to a top surface of the base and, before being dispensed, the at least one utensil partly lays over the dispensing opening; and a dispensing mechanism capable of moving the at least one utensil;

wherein the at least one utensil is dispensed by the dispensing mechanism moving the at least one utensil to fall through the dispensing opening.

194. The utensil dispenser of claim 193, further comprising a plurality of alignment members that extend generally perpendicularly from the base, wherein at least one of the alignment members is an alignment guard member that defines an opening at a bottom end of the alignment guard member;

wherein the at least one utensil is capable of being aligned by the plurality of alignment members; and wherein the at least one utensil is dispensed by the dispensing mechanism moving the at least one utensil toward the alignment guard member to move through the alignment guard member opening to fall through the dispensing opening.

195. The utensil dispenser of claim 194, wherein the alignment guard member opening is configured to allow only one utensil to pass therethrough at a time.

196. The utensil dispenser of claim 193, wherein the housing comprises at least one side wall;

wherein the dispensing mechanism includes an actuating member and a shaft portion, wherein the actuating member is provided outside of the at least one side wall of the housing and wherein the shaft portion is connected with the actuating member and extends through an opening defined in the at least one side wall of the housing into an interior compartment of the housing.

197. The utensil dispenser of claim 196, wherein a plurality of inclined portions are formed in at least a portion of a thickness of the base defining the dispensing opening, wherein the inclined portions are inclined downward from the top surface of the base; and wherein the at least one utensil is dispensed by a user moving the actuating member which moves the shaft portion which moves the at least one utensil downward along the inclined portions to fall through the dispensing opening.

198. The utensil dispenser of claim 196, wherein the shaft portion is configured to move only one utensil at a time.

199. The utensil dispenser of claim 196, wherein the dispensing mechanism includes a translating mechanism for translating a motion from a first direction to a second direction perpendicular to the first direction;

wherein the translating mechanism includes a translating portion having a first end and a second end, and a pushing portion;

wherein the first end of the translating portion is connected with the shaft portion;

wherein the second end of the translating portion is connected with the pushing portion, wherein the second end of the translating portion and the pushing portion are connected together with the base at a pivot point; and wherein the pushing portion is capable of moving the at least one utensil.

200. The utensil dispenser of claim 199, wherein the at least one utensil is dispensed by a user moving the actuating member which moves the shaft portion which moves the translating portion, which causes the first end of the translating portion to move in the first direction and causes the second end of the translating portion to rotate at the pivot point, which causes the pushing portion to rotate toward the at least one utensil and then to move the at least one utensil to fall through the dispensing opening.

201. The utensil dispenser of claim 199, wherein the pushing portion is configured to move only one utensil at a time.

202. The utensil dispenser of claim 196, wherein the dispensing mechanism further includes a spring positioned around the shaft portion, wherein a first end of the spring contacts the actuating member and a second end of the spring contacts an outer edge of the base;

wherein, before dispensing, the actuating member is biased away from the at least one side wall of the housing so that the shaft portion is biased away from the at least one utensil; and wherein the user pushes the actuating member against the biasing force of the spring to dispense the at least one utensil.

203. The utensil dispenser of claim 193, wherein a plurality of utensils are provided in a stack, and wherein a bottommost utensil in the stack is dispensed by the dispensing mechanism moving the bottommost utensil to fall through the dispensing opening.

204. The utensil dispenser of claim 203, wherein the bottommost utensil is dispensed with no raising of any of the utensils positioned above the bottommost utensil in the stack.

205. The utensil dispenser of claim 203, wherein the bottommost utensil is dispensed with only incidental raising of any of the utensils positioned above the bottommost utensil in the stack.

206. The utensil dispenser of claim 203, wherein the bottommost utensil is dispensed without substantially raising any of the utensils positioned above the bottommost utensil.

207. The utensil dispenser of claim 203, wherein after the bottommost utensil falls through the dispensing opening, the stack of utensils realigns so that a utensil that had been adjacently above the dispensed bottommost utensil becomes a new bottommost utensil that is capable of being dispensed.

208. The utensil dispenser of claim 193, wherein the housing is mounted on a wall.

209. The utensil dispenser of claim 193, wherein a bin or tray is positioned under the housing so that a utensil dispensed from the housing falls into the bin or tray.

210. The utensil dispenser of claim 209, wherein the bin or tray is mounted on a wall.

211. The utensil dispenser of claim 193, wherein a slider member is provided under the housing so that a utensil is capable of sliding down the slider member after falling through the dispensing opening.

212. The utensil dispenser of claim 211, wherein the sliding member includes a stopping member, and wherein the utensil is stopped from sliding down the slider member by the stopping member.

213. The utensil dispenser of claim 193, wherein the housing comprises at least one side wall, and wherein at least a portion of the at least one side wall of the housing is transparent.

214. The utensil dispenser of claim 213, wherein the at least one side wall of the housing is transparent.

215. A utensil dispenser adapted for the dispensing of at least one utensil, comprising:

a housing having at least one wall, wherein the at least one wall defines an opening therein, and wherein the housing defines an interior compartment;

at least one cassette assembly provided in the interior compartment of the housing, wherein the at least one cassette assembly includes a base, wherein the base defines a dispensing opening therein, and wherein a length of the dispensing opening is greater than a length of a utensil to be dispensed from the utensil dispenser;

wherein at least one utensil is positioned on or adjacent to a top surface of the base and, before being dispensed, the at least one utensil partly lays over the dispensing opening; and a dispensing mechanism capable of moving the at least one utensil;

wherein the at least one utensil is dispensed by the dispensing mechanism moving the at least one utensil to fall through the dispensing opening so that the at least one utensil is capable of being dispensed through the opening defined in the at least one wall of the housing.

216. The utensil dispenser of claim 215, wherein the at least one cassette assembly further includes a plurality of alignment members that extend generally perpendicularly from the base, wherein at least one of the alignment members is an alignment guard member that defines an opening at a bottom end of the alignment guard member;

wherein the at least one utensil is capable of being aligned by the plurality of alignment members; and wherein the at least one utensil is dispensed by the dispensing mechanism moving the at least one utensil toward the alignment guard member to move through the alignment guard member opening to fall through the dispensing opening so that the at least one utensil is capable of being dispensed through the opening defined in the at least one wall of the housing.

217. The utensil dispenser of claim 216, wherein the alignment guard member opening is configured to allow only one utensil to pass therethrough at a time.

218. The utensil dispenser of claim 215, wherein the dispensing mechanism includes an actuating member and a shaft portion, wherein the actuating member is provided outside of the at least one wall of the housing and wherein the shaft portion is connected with the actuating member and extends through an opening defined in the at least one wall of the housing into the interior compartment of the housing.

219. The utensil dispenser of claim 218, wherein a plurality of inclined portions are formed in at least a portion of a thickness of the base defining the dispensing opening, and wherein the inclined portions are inclined downward from the top surface of the base; and wherein the at least one utensil is dispensed by a user moving the actuating member which moves the shaft portion which moves the at least one utensil downward along the inclined portions to fall through the dispensing opening.

220. The utensil dispenser of claim 218, wherein the shaft portion is configured to move only one utensil at a time.

221. The utensil dispenser of claim 218, wherein the dispensing mechanism includes a translating mechanism for translating a motion from a first direction to a second direction perpendicular to the first direction;

wherein the translating mechanism includes a translating portion having a first end and a second end, and a pushing portion;

wherein the first end of the translating portion is connected with the shaft portion;

wherein the second end of the translating portion is connected with the pushing portion, wherein the second end of the translating portion and the pushing portion are connected together with the base at a pivot point; and wherein the pushing portion is capable of moving the at least one utensil.

222. The utensil dispenser of claim 221, wherein the at least one utensil is dispensed by a user moving the actuating member which moves the shaft portion which moves the translating portion, which causes the first end of the translating portion to move in the first direction and causes the second end of the translating portion to rotate at the pivot point, which causes the pushing portion to rotate toward the at least one utensil and then to move the at least one utensil to fall through the dispensing opening so that the at least one utensil is capable of being dispensed through the opening defined in the at least one wall of the housing.

223. The utensil dispenser of claim 221, wherein the pushing portion is configured to move only one utensil at a time.

224. The utensil dispenser of claim 218, wherein the dispensing mechanism further includes a spring positioned around the shaft portion, wherein a first end of the spring contacts the actuating member and a second end of the spring contacts an outer edge of the base;

wherein, before dispensing, the actuating member is biased away from the at least one wall of the housing so that the shaft portion is biased away from the at least one utensil; and wherein the user pushes the actuating member against the biasing force of the spring to dispense the at least one utensil.

225. The utensil dispenser of claim 215, wherein a plurality of utensils are provided in a stack, and wherein a bottommost utensil in the stack is dispensed by the dispensing mechanism moving the bottommost utensil to fall through the dispensing opening so that that utensil is capable of being dispensed through the opening defined in the at least one wall of the housing.

226. The utensil dispenser of claim 225, wherein the bottommost utensil is dispensed with no raising of any of the utensils positioned above the bottommost utensil in the stack.

227. The utensil dispenser of claim 225, wherein the bottommost utensil is dispensed with only incidental raising of any of the utensils positioned above the bottommost utensil in the stack.

228. The utensil dispenser of claim 225, wherein the bottommost utensil is dispensed without substantially raising any of the utensils positioned above the bottommost utensil.

229. The utensil dispenser of claim 225, wherein after the bottommost utensil falls through the dispensing opening, the stack of utensils realigns so that a utensil that had been adjacently above the dispensed bottommost utensil becomes a new bottommost utensil that is capable of being dispensed.

230. The utensil dispenser of claim 215, further comprising a slider member provided in the interior compartment of the housing, wherein the slider member is disposed under the at least one cassette assembly, and wherein the slider member is inclined downward toward the opening defined in the at least one wall of the housing; and wherein, after the at least one utensil falls through the dispensing opening, the utensil is capable of sliding down the slider member to the opening defined in the at least one wall of the housing.

231. The utensil dispenser of claim 215, further comprising a holding member provided in the interior compartment of the housing to support the at least one cassette assembly in the housing, and wherein the holding member is spaced from a bottom of the housing.

232. The utensil dispenser of claim 231, further comprising a slider member provided in the interior compartment of the housing, wherein the slider member is disposed under the at least one cassette assembly, and wherein the slider member is inclined downward toward the opening defined in the at least one wall of the housing; and wherein, after the at least one utensil falls through the dispensing opening, the utensil is capable of sliding down the slider member to the opening defined in the at least one wall of the housing.

233. The utensil dispenser of claim 232, wherein a stopping member is provided that extends outward and upward from a bottom of the at least one wall of the housing; and wherein when the utensil slides down the slider member to the opening defined in the at least one wall of the housing, the utensil is stopped from sliding by the stopping member.

234. The utensil dispenser of claim 215, wherein at least a portion of the at least one wall of the housing is transparent.

235. The utensil dispenser of claim 234, wherein the at least one wall of the housing is transparent.

236. The utensil dispenser of claim 215, wherein the at least one cassette assembly is capable of being replenished by providing at least one new utensil in the at least one cassette assembly.

237. The utensil dispenser of claim 215, wherein the at least one cassette assembly is capable of being removed from the housing and replaced with another cassette assembly.

238. A method of dispensing at least one utensil, comprising:

providing a housing having at least a bottom wall comprising a base, wherein the base defines at least one dispensing opening therein, and wherein a length of the dispensing opening is greater than a length of a utensil to be dispensed from the utensil dispenser;

wherein at least one utensil is positioned on or adjacent to a top surface of the base and, before being dispensed, the at least one utensil partly lays over the dispensing opening;

providing a dispensing mechanism capable of moving the at least one utensil; and dispensing the at least one utensil by the dispensing mechanism moving the at least one utensil to fall through the dispensing opening.

239. The method of dispensing a utensil of claim 238, further comprising:

providing a plurality of alignment members that extend generally perpendicularly from the base, wherein at least one of the alignment members is an alignment guard member that defines an opening at a bottom end of the alignment guard member;

wherein the at least one utensil is capable of being aligned by the plurality of alignment members; and wherein dispensing includes the dispensing mechanism moving the at least one utensil toward the alignment guard member to move through the alignment guard member opening to fall through the dispensing opening.

240. The method of dispensing a utensil of claim 239, wherein the alignment guard member opening is configured to allow only one utensil to pass therethrough at a time.

241. The method of dispensing a utensil of claim 238, wherein the housing comprises at least one side wall;

wherein the dispensing mechanism includes an actuating member and a shaft portion, wherein the actuating member is provided outside of the at least one side wall of the housing and wherein the shaft portion is connected with the actuating member and extends through an opening defined in the at least one side wall of the housing into an interior compartment of the housing.

242. The method of dispensing a utensil of claim 241, wherein a plurality of inclined portions are formed in at least a portion of a thickness of the base defining the dispensing opening, and wherein the inclined portions are inclined downward from the top surface of the base; and wherein dispensing includes a user moving the actuating member which moves the shaft portion which moves the at least one utensil downward along the inclined portions to fall through the dispensing opening.

243. The method of dispensing a utensil of claim 241, wherein the shaft portion is configured to move only one utensil at a time.

244. The method of dispensing a utensil of claim 241, wherein the dispensing mechanism includes a translating mechanism for translating a motion from a first direction to a second direction perpendicular to the first direction;

wherein the translating mechanism includes a translating portion having a first end and a second end, and a pushing portion;

wherein the first end of the translating portion is connected with the shaft portion;

wherein the second end of the translating portion is connected with the pushing portion, wherein the second end of the translating portion and the pushing portion are connected together with the base at a pivot point; and wherein the pushing portion is capable of moving the at least one utensil.

245. The method of dispensing a utensil of claim 244, wherein the dispensing step comprises the at least one utensil being dispensed by a user moving the actuating member which moves the shaft portion which moves the translating portion, which causes the first end of the translating portion to move in the first direction and causes the second end of the translating portion to rotate at the pivot point, which causes the pushing portion to rotate toward the at least one utensil and then to move the at least one utensil to fall through the dispensing opening.

246. The method of dispensing a utensil of claim 244, wherein the pushing portion is configured to move only one utensil at a time.

247. The method of dispensing a utensil of claim 241, wherein the dispensing mechanism further includes a spring positioned around the shaft portion, wherein a first end of the spring contacts the actuating member and a second end of the spring contacts an outer edge of the base;

wherein, before dispensing, the actuating member is biased away from the at least one side wall of the housing so that the shaft portion is biased away from the at least one utensil; and wherein the user pushes the actuating member against the biasing force of the spring to dispense the at least one utensil.

248. The method of dispensing a utensil of claim 238, further comprising providing a plurality of utensils in a stack, and wherein dispensing includes dispensing a bottommost utensil in the stack by the dispensing mechanism moving the bottommost utensil to fall through the dispensing opening.

249. The method of dispensing a utensil of claim 248, wherein the bottommost utensil is dispensed with no raising of any of the utensils positioned above the bottommost utensil in the stack.

250. The method of dispensing a utensil of claim 248, wherein the bottommost utensil is dispensed with only incidental raising of any of the utensils positioned above the bottommost utensil in the stack.

251. The method of dispensing a utensil of claim 248, wherein the bottommost utensil is dispensed without substantially raising any of the utensils positioned above the bottommost utensil.

252. The method of dispensing a utensil of claim 248, wherein after the bottommost utensil falls through the dispensing opening, the stack of utensils realigns so that a utensil that had been adjacently above the dispensed bottommost utensil becomes a new bottommost utensil that is capable of being dispensed.

253. The method of dispensing a utensil of claim 238, wherein the housing is mounted on a wall.

254. The method of dispensing a utensil of claim 238, wherein a bin or tray is positioned under the housing so that a utensil dispensed from the housing falls into the bin or tray.

255. The method of dispensing a utensil of claim 254, wherein the bin or tray is mounted on a wall.

256. The method of dispensing a utensil of claim 238, further comprising providing a slider member under the housing; and wherein dispensing further includes, after the at least one utensil falls through the dispensing opening, that utensil sliding down the slider member.

257. The method of dispensing a utensil of claim 256, further comprising providing the sliding member with a stopping member; and wherein dispensing further includes stopping the utensil from sliding on the slider member by the stopping member.

258. The method of dispensing a utensil of claim 238, wherein the housing comprises at least one side wall, and wherein at least a portion of the at least one side wall of the housing is transparent.

259. The method of dispensing a utensil of claim 258, wherein the at least one side wall of the housing is transparent.

260. A method of dispensing at least one utensil, comprising:

providing a housing having at least one wall, wherein the at least one wall defines an opening therein, and wherein the housing defines an interior compartment;

providing at least one base in the interior compartment of the housing, wherein the base defines a dispensing opening therein, and wherein a length of the dispensing opening is greater than a length of a utensil to be dispensed from the utensil dispenser;

wherein at least one utensil is positioned on or adjacent to a top surface of the base and, before being dispensed, the at least one utensil partly lays over the dispensing opening;

providing a dispensing mechanism capable of moving the at least one utensil; and dispensing the at least one utensil by the dispensing mechanism moving the at least one utensil to fall through the dispensing opening so that the at least one utensil is capable of being dispensed through the opening defined in the at least one wall of the housing.

261. The method of dispensing of claim 260, further providing a plurality of alignment members that extend generally perpendicularly from the base, wherein at least one of the alignment members is an alignment guard member that defines an opening at a bottom end of the alignment guard member;

wherein the at least one utensil is capable of being aligned by the plurality of alignment members; and wherein dispensing includes the dispensing mechanism moving the at least one utensil toward the alignment guard member to move through the alignment guard member opening to fall through the dispensing opening so that the at least one utensil is capable of being dispensed through the opening defined in the at least one wall of the housing.

262. The method of dispensing a utensil of claim 261, wherein the alignment guard member opening is configured to allow only one utensil to pass therethrough at a time.

263. The method of dispensing a utensil of claim 260, wherein the dispensing mechanism includes an actuating member and a shaft portion, wherein the actuating member is provided outside of the at least one wall of the housing and wherein the shaft portion is connected with the actuating member and extends through an opening defined in the at least one wall of the housing into the interior compartment of the housing.

264. The method of dispensing a utensil of claim 263, wherein a plurality of inclined portions are formed in at least a portion of a thickness of the base defining the dispensing opening, and wherein the inclined portions are inclined downward from the top surface of the base; and wherein dispensing includes a user moving the actuating member which moves the shaft portion which moves the at least one utensil downward along the inclined portions to fall through the dispensing opening.

265. The method of dispensing a utensil of claim 263, wherein the shaft portion is configured to move only one utensil at a time.

266. The method of dispensing a utensil of claim 263, wherein the dispensing mechanism includes a translating mechanism for translating a motion from a first direction to a second direction perpendicular to the first direction;

wherein the translating mechanism includes a translating portion having a first end and a second end, and a pushing portion;

wherein the first end of the translating portion is connected with the shaft portion;

wherein the second end of the translating portion is connected with the pushing portion, wherein the second end of the translating portion and the pushing portion are connected together with the base at a pivot point; and wherein the pushing portion is capable of moving the at least one utensil.

267. The method of dispensing a utensil of claim 266, wherein the at least one utensil is dispensed by a user moving the actuating member which moves the shaft portion which moves the translating portion, which causes the first end of the translating portion to move in the first direction and causes the second end of the translating portion to rotate at the pivot point, which causes the pushing portion to rotate toward the at least one utensil and then to move the at least one utensil to fall through the dispensing opening so that the at least one utensil is capable of being dispensed through the opening defined in the at least one wall of the housing.

268. The method of dispensing a utensil of claim 266, wherein the pushing portion is configured to move only one utensil at a time.

269. The method of dispensing a utensil of claim 263, wherein the dispensing mechanism further includes a spring positioned around the shaft portion, wherein a first end of the spring contacts the actuating member and a second end of the spring contacts an outer edge of the base;

wherein, before dispensing, the actuating member is biased away from the at least one wall of the housing so that the shaft portion is biased away from the at least one utensil; and wherein the user pushes the actuating member against the biasing force of the spring to dispense the at least one utensil.

270. The method of dispensing a utensil of claim 260, further comprising providing a plurality of utensils in a stack; and wherein dispensing includes dispensing a bottommost utensil in the stack by the dispensing mechanism moving the bottommost utensil to fall through the dispensing opening so that that utensil is capable of being dispensed through the opening defined in the at least one wall of the housing.

271. The method of dispensing a utensil of claim 270, wherein the bottommost utensil is dispensed with no raising of any of the utensils positioned above the bottommost utensil in the stack.

272. The method of dispensing a utensil of claim 270, wherein the bottommost utensil is dispensed with only incidental raising of any of the utensils positioned above the bottommost utensil in the stack.

273. The method of dispensing a utensil of claim 270, wherein the bottommost utensil is dispensed without substantially raising any of the utensils positioned above the bottommost utensil.

274. The method of dispensing a utensil of claim 270, wherein after the bottommost utensil falls through the dispensing opening, the stack of utensils realigns so that a utensil that had been adjacently above the dispensed bottommost utensil becomes a new bottommost utensil that is capable of being dispensed.

275. The method of dispensing a utensil of claim 260, further comprising providing a slider member in the interior compartment of the housing, wherein the slider member is disposed under the at least one base, and wherein the slider member is inclined downward toward the opening defined in the at least one wall of the housing; and wherein dispensing further includes, after the at least one utensil falls through the dispensing opening, the utensil sliding down the slider member to the opening defined in the at least one wall of the housing.

276. The method of dispensing a utensil of claim 260, further comprising providing a holding member in the interior compartment of the housing to support the at least one base in the housing, and wherein the holding member is spaced from a bottom of the housing.

277. The method of dispensing a utensil of claim 276, further comprising providing a slider member in the interior compartment of the housing, wherein the slider member is disposed under the at least one base, and wherein the slider member is inclined downward toward the opening defined in the at least one wall of the housing; and wherein dispensing further includes, after the at least one utensil falls through the dispensing opening, the utensil sliding down the slider member to the opening defined in the at least one wall of the housing.

278. The method of dispensing a utensil of claim 277, further comprising providing a stopping member that extends outward and upward from a bottom of the at least one wall of the housing; and wherein dispensing further includes stopping the utensil from sliding on the slider member by the stopping member.

279. The method of dispensing a utensil of claim 260, wherein at least a portion of the at least one wall of the housing is transparent.

280. The method of dispensing a utensil of claim 279, wherein the at least one wall of the housing is transparent.

281. A utensil dispenser adapted for the dispensing of at least one utensil, comprising:

a housing having at least a bottom wall comprising a base, wherein the base defines at least one dispensing opening therein;

wherein at least one utensil is positioned on or adjacent to a top surface of the base; and a dispensing mechanism capable of moving the at least one utensil, wherein the dispensing mechanism includes a translating mechanism for translating a motion from a first direction to a second direction perpendicular to the first direction;

wherein the at least one utensil is dispensed by the dispensing mechanism moving the at least one utensil to fall through the dispensing opening.

282. The utensil dispenser of claim 281, further comprising a plurality of alignment members that extend generally perpendicularly from the base, wherein at least one of the alignment members is an alignment guard member that defines an opening at a bottom end of the alignment guard member;

wherein the at least one utensil is capable of being aligned by the plurality of alignment members; and wherein the at least one utensil is dispensed by the dispensing mechanism moving the at least one utensil toward the alignment guard member to move through the alignment guard member opening to fall through the dispensing opening.

283. The utensil dispenser of claim 282, wherein the alignment guard member opening is configured to allow only one utensil to pass therethrough at a time.

284. The utensil dispenser of claim 281, wherein the housing comprises at least one side wall;

wherein the dispensing mechanism includes an actuating member and a shaft portion, wherein the actuating member is provided outside of the at least one side wall of the housing and wherein the shaft portion is connected with the actuating member and extends through an opening defined in the at least one side wall of the housing into an interior compartment of the housing;

wherein the translating mechanism includes a translating portion having a first end and a second end, and a pushing portion;

wherein the first end of the translating portion is connected with the shaft portion;

wherein the second end of the translating portion is connected with the pushing portion, wherein the second end of the translating portion and the pushing portion are connected together with the base at a pivot point; and wherein the pushing portion is capable of moving the at least one utensil.

285. The utensil dispenser of claim 284, wherein the at least one utensil is dispensed by a user moving the actuating member which moves the shaft portion which moves the translating portion, which causes the first end of the translating portion to move in the first direction and causes the second end of the translating portion to rotate at the pivot point, which causes the pushing portion to rotate toward the at least one utensil and then to move the at least one utensil to fall through the dispensing opening.

286. The utensil dispenser of claim 284, wherein the pushing portion is configured to move only one utensil at a time.

287. The utensil dispenser of claim 284, wherein the dispensing mechanism further includes a spring positioned around the shaft portion, wherein a first end of the spring contacts the actuating member and a second end of the spring contacts an outer edge of the base;

wherein, before dispensing, the actuating member is biased away from the at least one side wall of the housing so that the shaft portion is biased away from the at least one utensil; and wherein the user pushes the actuating member against the biasing force of the spring to dispense the at least one utensil.

288. The utensil dispenser of claim 281, wherein a size and a shape of the dispensing opening is dependent on the type of utensil to be dispensed.

289. The utensil dispenser of claim 281, wherein a plurality of utensils are provided in a stack, and wherein a bottommost utensil in the stack is dispensed by the dispensing mechanism moving the bottommost utensil to fall through the dispensing opening.

290. The utensil dispenser of claim 289, wherein the bottommost utensil is dispensed with no raising of any of the utensils positioned above the bottommost utensil in the stack.

291. The utensil dispenser of claim 289, wherein the bottommost utensil is dispensed with only incidental raising of any of the utensils positioned above the bottommost utensil in the stack.

292. The utensil dispenser of claim 289, wherein the bottommost utensil is dispensed without substantially raising any of the utensils positioned above the bottommost utensil.

293. The utensil dispenser of claim 289, wherein after the bottommost utensil falls through the dispensing opening, the stack of utensils realigns so that a utensil that had been adjacently above the dispensed bottommost utensil becomes a new bottommost utensil that is capable of being dispensed.

294. The utensil dispenser of claim 281, wherein the housing is mounted on a wall.

295. The utensil dispenser of claim 281, wherein a bin or tray is positioned under the housing so that a utensil dispensed from the housing falls into the bin or tray.

296. The utensil dispenser of claim 295, wherein the bin or tray is mounted on a wall.

297. The utensil dispenser of claim 281, wherein a slider member is provided under the housing so that a utensil is capable of sliding down the slider member after falling through the dispensing opening.

298. The utensil dispenser of claim 297, wherein the sliding member includes a stopping member, and wherein the utensil is stopped from sliding down the slider member by the stopping member.

299. The utensil dispenser of claim 281, wherein the housing comprises at least one side wall, and wherein at least a portion of the at least one side wall of the housing is transparent.

300. The utensil dispenser of claim 299, wherein the at least one side wall of the housing is transparent.

301. The utensil dispenser of claim 281, wherein at least one inclined portion is formed in at least a portion of a thickness of the base defining the dispensing opening, and wherein the inclined portion is inclined downward from the top surface of the base; and wherein the at least one utensil is dispensed by the dispensing mechanism moving the at least one utensil downward along the inclined portion to fall through the dispensing opening.

302. A utensil dispenser adapted for the dispensing of at least one utensil, comprising:

a housing having at least one wall, wherein the at least one wall defines an opening therein, and wherein the housing defines an interior compartment;

at least one cassette assembly provided in the interior compartment of the housing, wherein the at least one cassette assembly includes a base, wherein at least one utensil is positioned on or adjacent to a top surface of the base, and wherein the base defines a dispensing opening therein; and a dispensing mechanism capable of moving the at least one utensil, wherein the dispensing mechanism includes a translating mechanism for translating a motion from a first direction to a second direction perpendicular to the first direction;

wherein the at least one utensil is dispensed by the dispensing mechanism moving the at least one utensil to fall through the dispensing opening so that the at least one utensil is capable of being dispensed through the opening defined in the at least one wall of the housing.

303. The utensil dispenser of claim 302, wherein the at least one cassette assembly further includes a plurality of alignment members that extend generally perpendicularly from the base, wherein at least one of the alignment members is an alignment guard member that defines an opening at a bottom end of the alignment guard member;

wherein the at least one utensil is capable of being aligned by the plurality of alignment members; and wherein the at least one utensil is dispensed by the dispensing mechanism moving the at least one utensil toward the alignment guard member to move through the alignment guard member opening to fall through the dispensing opening so that the at least one utensil is capable of being dispensed through the opening defined in the at least one wall of the housing.

304. The utensil dispenser of claim 303, wherein the alignment guard member opening is configured to allow only one utensil to pass therethrough at a time.

305. The utensil dispenser of claim 302, wherein the dispensing mechanism includes an actuating member and a shaft portion, wherein the actuating member is provided outside of the at least one wall of the housing and wherein the shaft portion is connected with the actuating member and extends through an opening defined in the at least one wall of the housing into the interior compartment of the housing;

wherein the translating mechanism includes a translating portion having a first end and a second end, and a pushing portion;

wherein the first end of the translating portion is connected with the shaft portion;

wherein the second end of the translating portion is connected with the pushing portion, wherein the second end of the translating portion and the pushing portion are connected together with the base at a pivot point; and wherein the pushing portion is capable of moving the at least one utensil.

306. The utensil dispenser of claim 305, wherein the at least one utensil is dispensed by a user moving the actuating member which moves the shaft portion which moves the translating portion, which causes the first end of the translating portion to move in the first direction and causes the second end of the translating portion to rotate at the pivot point, which causes the pushing portion to rotate toward the at least one utensil and then to move the at least one utensil to fall through the dispensing opening so that the at least one utensil is capable of being dispensed through the opening defined in the at least one wall of the housing.

307. The utensil dispenser of claim 305, wherein the pushing portion is configured to move only one utensil at a time.

308. The utensil dispenser of claim 305, wherein the dispensing mechanism further includes a spring positioned around the shaft portion, wherein a first end of the spring contacts the actuating member and a second end of the spring contacts an outer edge of the base;

wherein, before dispensing, the actuating member is biased away from the at least one wall of the housing so that the shaft portion is biased away from the at least one utensil; and wherein the user pushes the actuating member against the biasing force of the spring to dispense the at least one utensil.

309. The utensil dispenser of claim 302, wherein a size and a shape of the dispensing opening is dependent on the type of utensil to be dispensed.

310. The utensil dispenser of claim 302, wherein a plurality of utensils is provided in a stack, and wherein a bottommost utensil in the stack is dispensed by the dispensing mechanism moving the bottommost utensil to fall through the dispensing opening so that that utensil is capable of being dispensed through the opening defined in the at least one wall of the housing.

311. The utensil dispenser of claim 310, wherein the bottommost utensil is dispensed with no raising of any of the utensils positioned above the bottommost utensil in the stack.

312. The utensil dispenser of claim 310, wherein the bottommost utensil is dispensed with only incidental raising of any of the utensils positioned above the bottommost utensil in the stack.

313. The utensil dispenser of claim 310, wherein the bottommost utensil is dispensed without substantially raising any of the utensils positioned above the bottommost utensil.

314. The utensil dispenser of claim 31 wherein after the bottommost utensil falls through the dispensing opening, the stack of utensils realigns so that a utensil that had been adjacently above the dispensed bottommost utensil becomes a new bottommost utensil that is capable of being dispensed.

315. The utensil dispenser of claim 302, further comprising a slider member provided in the interior compartment of the housing, wherein the slider member is disposed under the at least one cassette assembly, and wherein the slider member is inclined downward toward the opening defined in the at least one wall of the housing; and wherein, after the at least one utensil falls through the dispensing opening, the utensil is capable of sliding down the slider member to the opening defined in the at least one wall of the housing.

316. The utensil dispenser of claim 302, further comprising a holding member provided in the interior compartment of the housing to support the at least one cassette assembly in the housing, and wherein the holding member is spaced from a bottom of the housing.

317. The utensil dispenser of claim 316, further comprising a slider member provided in the interior compartment of the housing, wherein the slider member is disposed under the at least one cassette assembly, and wherein the slider member is inclined downward toward the opening defined in the at least one wall of the housing; and wherein, after the at least one utensil falls through the dispensing opening, the utensil is capable of sliding down the slider member to the opening defined in the at least one wall of the housing.

318. The utensil dispenser of claim 317, wherein a stopping member is provided that extends outward and upward from a bottom of the at least one wall of the housing; and wherein when the utensil slides down the slider member to the opening defined in the at least one wall of the housing, the utensil is stopped from sliding by the stopping member.

319. The utensil dispenser of claim 302, wherein at least a portion of the at least one wall of the housing is transparent.

320. The utensil dispenser of claim 319, wherein the at least one wall of the housing is transparent.

321. The utensil dispenser of claim 302, wherein the at least one cassette assembly is capable of being replenished by providing one or more new utensils in the at least one cassette assembly.

322. The utensil dispenser of claim 302, wherein the at least one cassette assembly is capable of being removed from the housing and replaced with another cassette assembly.

323. The utensil dispenser of claim 302, wherein at least one inclined portion is formed in at least a portion of a thickness of the base defining the dispensing opening, and wherein the inclined portion is inclined downward from the top surface of the base; and wherein the at least one utensil is dispensed by the dispensing mechanism moving the at least one utensil downward along the inclined portion to fall through the dispensing opening.

324. A method of dispensing at least one utensil, comprising:

providing a housing having at least a bottom wall comprising a base, wherein the base defines at least one dispensing opening therein;

wherein at least one utensil is positioned on or adjacent to a top surface of the base;

providing a dispensing mechanism capable of moving the at least one utensil, wherein the dispensing mechanism includes a translating mechanism for translating a motion from a first direction to a second direction perpendicular to the first direction; and dispensing the at least one utensil by the dispensing mechanism moving the at least one utensil to fall through the dispensing opening.

325. The method of dispensing a utensil of claim 324, further comprising:

providing a plurality of alignment members that extend generally perpendicularly from the base, wherein at least one of the alignment members is an alignment guard member that defines an opening at a bottom end of the alignment guard member; and wherein dispensing includes the dispensing mechanism moving the at least one utensil toward the alignment guard member to move through the alignment guard member opening to fall through the dispensing opening.

326. The method of dispensing a utensil of claim 325, wherein the alignment guard member opening is configured to allow only one utensil to pass therethrough at a time.

327. The method of dispensing a utensil of claim 324, wherein the housing comprises at least one side wall;

wherein the dispensing mechanism includes an actuating member and a shaft portion, wherein the actuating member is provided outside of the at least one side wall of the housing and wherein the shaft portion is connected with the actuating member and extends through an opening defined in the at least one side wall of the housing into an interior compartment of the housing;

wherein the translating mechanism includes a translating portion having a first end and a second end, and a pushing portion;

wherein the first end of the translating portion is connected with the shaft portion;

wherein the second end of the translating portion is connected with the pushing portion, wherein the second end of the translating portion and the pushing portion are connected together with the base at a pivot point; and wherein the pushing portion is capable of moving the at least one utensil.

328. The method of dispensing a utensil of claim 327, wherein dispensing includes the at least one utensil being dispensed by a user moving the actuating member which moves the shaft portion which moves the translating portion, which causes the first end of the translating portion to move in the first direction and causes the second end of the translating portion to rotate at the pivot point, which causes the pushing portion to rotate toward the at least one utensil and then to move the at least one utensil to fall through the dispensing opening.

329. The method of dispensing a utensil of claim 327, wherein the pushing portion is configured to move only one utensil at a time.

330. The method of dispensing a utensil of claim 327, wherein the dispensing mechanism further includes a spring positioned around the shaft portion, wherein a first end of the spring contacts the actuating member and a second end of the spring contacts an outer edge of the base;

wherein, before dispensing, the actuating member is biased away from the at least one side wall of the housing so that the shaft portion is biased away from the at least one utensil; and wherein the user pushes the actuating member against the biasing force of the spring to dispense the at least one utensil.

331. The method of dispensing a utensil of claim 324, wherein a size and a shape of the dispensing opening is dependent on the type of utensil to be dispensed.

332. The method of dispensing a utensil of claim 324, further comprising providing a plurality of utensils in a stack, and wherein dispensing includes a bottommost utensil in the stack being dispensed by the dispensing mechanism moving the bottommost utensil to fall through the dispensing opening.

333. The method of dispensing a utensil of claim 332, wherein the bottommost utensil is dispensed with no raising of any of the utensils positioned above the bottommost utensil in the stack.

334. The method of dispensing a utensil of claim 332, wherein the bottommost utensil is dispensed with only incidental raising of any of the utensils positioned above the bottommost utensil in the stack.

335. The method of dispensing a utensil of claim 332, wherein the bottommost utensil is dispensed without substantially raising any of the utensils positioned above the bottommost utensil.

336. The method of dispensing a utensil of claim 332, wherein after the bottommost utensil falls through the dispensing opening, the stack of utensils realigns so that a utensil that had been adjacently above the dispensed bottommost utensil becomes a new bottommost utensil that is capable of being dispensed.

337. The method of dispensing a utensil of claim 324, wherein the housing is mounted on a wall.

338. The method of dispensing a utensil of claim 324, wherein a bin or tray is positioned under the housing so that a utensil dispensed from the housing falls into the bin or tray.

339. The method of dispensing a utensil of claim 338, wherein the bin or tray is mounted on a wall.

340. The method of dispensing a utensil of claim 324, further comprising providing a slider member under the housing; and wherein dispensing further includes, after the at least one utensil falls through the dispensing opening, that utensil sliding down the slider member.

341. The method of dispensing a utensil of claim 340, further comprising providing the siding member with a stopping member; and wherein dispensing further includes stopping the utensil from sliding on the slider member by the stopping member.

342. The method of dispensing a utensil of claim 324, wherein the housing comprises at least one side wall, and wherein at least a portion of the at least one side wall of the housing is transparent.

343. The method of dispensing a utensil of claim 342, wherein the at least one side wall of the housing is transparent.

344. The method of dispensing a utensil of claim 324, wherein at least one inclined portion is formed in at least a portion of a thickness of the base defining the dispensing opening, and wherein the inclined portion is inclined downward from the top surface of the base; and wherein the at least one utensil is dispensed by the dispensing mechanism moving the at least one utensil downward along the inclined portion to fall through the dispensing opening.

345. A method of dispensing at least one utensil, comprising:

providing a housing having at least one wall, wherein the at least one wall defines an opening therein, and wherein the housing defines an interior compartment;

providing at least one base in the interior compartment of the housing, wherein the at least one base defines a dispensing opening therein, and wherein at least one utensil is positioned on or adjacent to a top surface of the at least one base;

providing a dispensing mechanism capable of moving the at least one utensil, wherein the dispensing mechanism includes a translating mechanism for translating a motion from a first direction to a second direction perpendicular to the first direction; and dispensing the at least one utensil by the dispensing mechanism moving the at least one utensil to fall through the dispensing opening so that the at least one utensil is capable of being dispensed through the opening defined in the at least one wall of the housing.

346. The method of dispensing a utensil of claim 345, further providing a plurality of alignment members that extend generally perpendicularly from the base, wherein at least one of the alignment members is an alignment guard member that defines an opening at a bottom end of the alignment guard member;

wherein the at least one utensil is capable of being aligned by the plurality of alignment members; and wherein dispensing includes the dispensing mechanism moving the at least one utensil toward the alignment guard member to move through the alignment guard member opening to fall through the dispensing opening so that the at least one utensil is capable of being dispensed through the opening defined in the at least one wall of the housing.

347. The method of dispensing a utensil of claim 346, wherein the alignment guard member opening is configured to allow only one utensil to pass therethrough at a time.

348. The method of dispensing a utensil of claim 345, wherein the dispensing mechanism includes an actuating member and a shaft portion, wherein the actuating member is provided outside of the at least one wall of the housing and wherein the shaft portion is connected with the actuating member and extends through an opening defined in the at least one wall of the housing into the interior compartment of the housing;

wherein the translating mechanism includes a translating portion having a first end and a second end, and a pushing portion;

wherein the first end of the translating portion is connected with the shaft portion;

wherein the second end of the translating portion is connected with the pushing portion, wherein the second end of the translating portion and the pushing portion are connected together with the base at a pivot point; and wherein the pushing portion is capable of moving the at least one utensil.

349. The method of dispensing a utensil of claim 348, wherein the at least one utensil is dispensed by a user moving the actuating member which moves the shaft portion which moves the translating portion, which causes the first end of the translating portion to move in the first direction and causes the second end of the translating portion to rotate at the pivot point, which causes the pushing portion to rotate toward the at least one utensil and then to move the at least one utensil to fall through the dispensing opening so that the at least one utensil is capable of being dispensed through the opening defined in the at least one wall of the housing.

350. The method of dispensing a utensil of claim 348, wherein the pushing portion is configured to move only one utensil at a time.

351. The method of dispensing a utensil of claim 348, wherein the dispensing mechanism further includes a spring positioned around the shaft portion, wherein a first end of the spring contacts the actuating member and a second end of the spring contacts an outer edge of the base;

wherein, before dispensing, the actuating member is biased away from the at least one wall of the housing so that the shaft portion is biased away from the at least one utensil; and wherein the user pushes the actuating member against the biasing force of the spring to dispense the at least one utensil.

352. The method of dispensing a utensil of claim 345, wherein a size and a shape of the dispensing opening is dependent on the type of utensil to be dispensed.

353. The method of dispensing a utensil of claim 345, further comprising providing a plurality of utensils in a stack; and wherein dispensing includes the dispensing mechanism moving the bottommost utensil of the stack to fall through the dispensing opening so that the bottommost utensil is capable of being dispensed through the opening defined in the at least one wall of the housing.

354. The method of dispensing a utensil of claim 353, wherein the bottommost utensil is dispensed with no raising of any of the utensils positioned above the bottommost utensil in the stack.

355. The method of dispensing a utensil of claim 353, wherein the bottommost utensil is dispensed with only incidental raising of any of the utensils positioned above the bottommost utensil in the stack.

356. The method of dispensing a utensil of claim 353, wherein the bottommost utensil is dispensed without substantially raising any of the utensils positioned above the bottommost utensil.

357. The method of dispensing a utensil of claim 353, wherein after the bottommost utensil falls through the dispensing opening, the stack of utensils realigns so that a utensil that had been adjacently above the dispensed bottommost utensil becomes a new bottommost utensil that is capable of being dispensed.

358. The method of dispensing a utensil of claim 345, further comprising providing a slider member in the interior compartment of the housing, wherein the slider member is disposed under the at least one base, and wherein the slider member is inclined downward toward the opening defined in the at least one wall of the housing; and wherein dispensing includes, after the at least one utensil falls through the dispensing opening, the utensil sliding down the slider member to the opening defined in the at least one wall of the housing.

359. The method of dispensing a utensil of claim 345, further comprising providing a holding member in the interior compartment of the housing to support the at least one base in the housing, and wherein the holding member is spaced from a bottom of the housing.

360. The method of dispensing a utensil of claim 359, further comprising providing a slider member in the interior compartment of the housing, wherein the slider member is disposed under the at least one base, and wherein the slider member is inclined downward toward the opening defined in the at least one wall of the housing; and wherein dispensing includes, after the at least one utensil falls through the dispensing opening, the utensil sliding down the slider member to the opening defined in the at least one wall of the housing.

361. The method of dispensing a utensil of claim 360, further comprising providing a stopping member that extends outward and upward from a bottom of the at least one wall of the housing; and wherein dispensing further includes stopping the utensil from sliding on the slider member by the stopping member.

362. The method of dispensing a utensil of claim 345, wherein at least a portion of the at least one wall of the housing is transparent.

363. The method of dispensing a utensil of claim 362, wherein the at least one wall of the housing is transparent.

364. The method of dispensing a utensil of claim 345, wherein at least one inclined portion is formed in at least a portion of a thickness of the base defining the dispensing opening, and wherein the inclined portion is inclined downward from the top surface of the base; and wherein the at least one utensil is dispensed by the dispensing mechanism moving the at least one utensil downward along the inclined portion to fall through the dispensing opening.

* * * * *

UNITED STATES PATENT AND TRADEMARK OFFICE

CERTIFICATE OF CORRECTION

PATENT NO. : 6,832,694 B2
DATED : December 21, 2004
INVENTOR(S) : Harold J. Goeking et al.

It is certified that error appears in the above-identified patent and that said Letters Patent is hereby corrected as shown below:

Column 34,
Line 25, "thickness of base" should read -- thickness of the base --.

Signed and Sealed this

Third Day of May, 2005

JON W. DUDAS
*Director of the United States Patent and Trademark Office*